US009592179B2

(12) United States Patent
Wagner et al.

(10) Patent No.: US 9,592,179 B2
(45) Date of Patent: Mar. 14, 2017

(54) DISPOSABLE RIGID CONTAINER FOR PHARMACEUTICAL COMPOSITIONS

(71) Applicant: Medcomb Holding APS, København V (DK)

(72) Inventors: Flemming Wagner, Frederiksberg C (DK); John Wagner, Værløse (DK)

(73) Assignee: Medcomb Holding APS, København V (DK)

( * ) Notice: Subject to any disclaimer, the term of this patent is extended or adjusted under 35 U.S.C. 154(b) by 0 days.

(21) Appl. No.: 14/346,170

(22) PCT Filed: Sep. 21, 2012

(86) PCT No.: PCT/DK2012/000105
§ 371 (c)(1),
(2) Date: Mar. 20, 2014

(87) PCT Pub. No.: WO2013/041098
PCT Pub. Date: Mar. 28, 2013

(65) Prior Publication Data

US 2014/0216968 A1 Aug. 7, 2014

Related U.S. Application Data

(60) Provisional application No. 61/537,408, filed on Sep. 21, 2011.

(30) Foreign Application Priority Data

Sep. 21, 2011 (DK) ..... 2011 70518

(51) Int. Cl.
*A61J 1/03* (2006.01)
*B65D 75/32* (2006.01)
(Continued)

(52) U.S. Cl.
CPC ..... *A61J 1/035* (2013.01); *A61J 7/04* (2013.01); *B65D 75/327* (2013.01);
(Continued)

(58) Field of Classification Search
CPC ..... A61J 1/035; A61J 7/04; B65D 75/327; B65D 83/0463; B65D 83/0472
See application file for complete search history.

(56) References Cited

U.S. PATENT DOCUMENTS 3,246,746 A * 4/1966 Holley ..... B65D 73/0092 206/462
3,552,595 A * 1/1971 Gerner ..... B65D 43/162 206/364
(Continued)

FOREIGN PATENT DOCUMENTS

WO WO 2005/014437 A2 2/2005
WO WO 2007/072494 A1 6/2007
(Continued)

OTHER PUBLICATIONS

International Search Report for PCT/DK2012/000105 dated Nov. 9, 2012.

*Primary Examiner* — Anthony Stashick
*Assistant Examiner* — James Way
(74) *Attorney, Agent, or Firm* — Knobbe Martens Olson & Bear LLP

(57) ABSTRACT

A single use rigid package containing pharmaceutical compositions which protects tablets, capsules, soft shell pills against hard transporting conditions and undesired rupture. The package comprises at least four sections made from a single sheet foldable into a folded configuration. At least two sections are carrier sections pivotally connected to each other and each comprising cavities for housing pharmaceutical compositions. Two sections are end sections not comprising cavities, the end sections being foldable to adjacent
(Continued)

and at least partly covering the carrier sections when the sheet is folded so as to protect the carrier sections. The package allows for personal transportation, e.g. in a pocket, and it is easy and convenient to open for people of all levels of ability and dexterity. Its design allows for transport as standard mail withstanding temperature fluctuation, vibrations and shocks, mechanical pressure and variation in atmospheric pressure which may occur during transport.

20 Claims, 54 Drawing Sheets

(51) Int. Cl.
*A61J 7/04* (2006.01)
*B65D 83/04* (2006.01)

(52) U.S. Cl.
CPC ..... *B65D 83/0463* (2013.01); *A61J 2205/20* (2013.01); *F04C 2270/0421* (2013.01)

(56) References Cited

U.S. PATENT DOCUMENTS

| | | | | |
|---|---|---|---|---|
| 5,381,904 | A | 1/1995 | Thurell | |
| 5,788,079 | A | 8/1998 | Bouthiette | |
| 5,862,915 | A | 1/1999 | Plezia et al. | |
| 6,219,997 | B1 * | 4/2001 | Friberg et al. | 53/453 |
| 7,780,009 | B2 * | 8/2010 | Casanova | 206/705 |
| 2003/0098257 | A1 | 5/2003 | Robertson et al. | |
| 2003/0102247 | A1 | 6/2003 | Inoue et al. | |
| 2005/0077203 | A1 | 4/2005 | Morita et al. | |
| 2005/0084700 | A1 | 4/2005 | Ede et al. | |
| 2006/0289328 | A1 | 12/2006 | Hession | |
| 2007/0187273 | A1 | 8/2007 | Grosskopf | |
| 2009/0314664 | A1 | 12/2009 | Henke et al. | |
| 2011/0079530 | A1 * | 4/2011 | Killinger et al. | 206/462 |

FOREIGN PATENT DOCUMENTS

| | | |
|---|---|---|
| WO | WO 2008/014862 A1 | 2/2008 |
| WO | WO 2008/104765 A1 | 9/2008 |

* cited by examiner

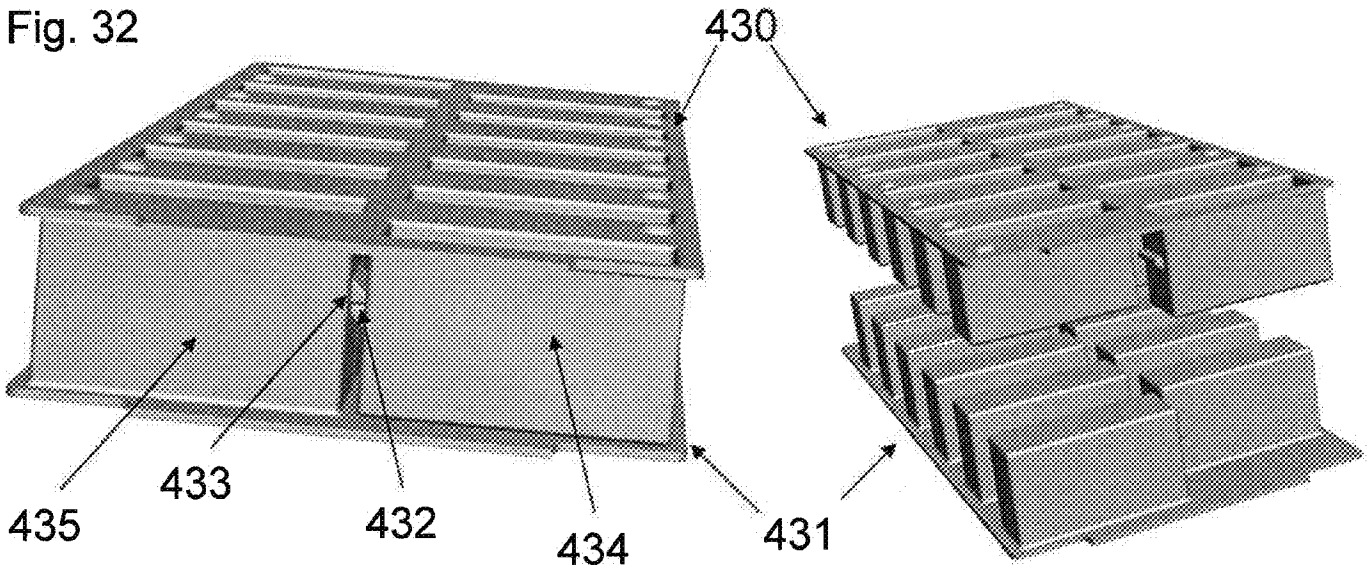
Fig. 32
Fig. 32a
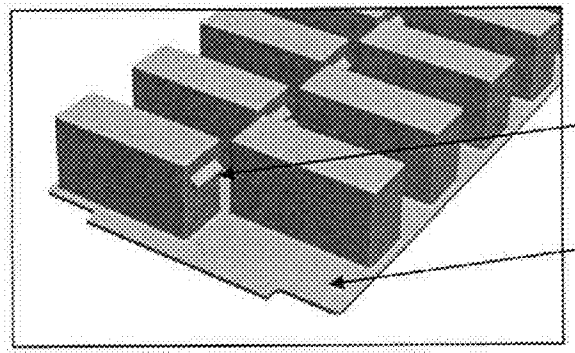
Fig. 32b

DISPOSABLE RIGID CONTAINER FOR PHARMACEUTICAL COMPOSITIONS

CROSS REFERENCE TO RELATED APPLICATIONS

This application is a U.S. National Phase Application of PCT International Application Number PCT/DK2012/000105, filed on Sep. 21, 2012, designating the United States of America and published in the English language, which is an International Application of and claims the benefit of priority to Danish Patent Application No. PA 2011 70518, filed on Sep. 21, 2011, and U.S. Provisional Application No. 61/537,408, filed on Sep. 21, 2011. The disclosures of the above-referenced applications are hereby expressly incorporated by reference in their entireties.

FIELD OF THE INVENTION

The present invention relates to pharmaceutical compositions containers, in particular to disposable containers for dispensing pills, tablets and capsules.

BACKGROUND OF THE INVENTION

Solid pharmaceutical compositions such as tablets and capsules are often contained for dispensing in blister packages. Generally a blister package comprises a moulded plastic sheet having one or more depressions each defining a blister chamber, typically for containing a tablet or capsule; these depressions are commonly referred to as 'blisters'. This sheet is generally covered by a thin layer of foil for sealing the tablets or capsules within the blisters. Pressing on a blister causes the tablet or capsule contained in that blister to penetrate the foil layer so that it can easily be removed from the package. The blister from which the tablet is removed is left deformed, and the foil is torn in the region below the blister, but the other blisters remain intact. Blister packages are usually further packed in a paper box together with a leaflet containing information about the medication. This secondary package has the function of holding items securely, avoiding tablets loss due to undesired rupture during transportation.

Blister packages are generally transported by air, sea or rail and travel by road for at least part of their journey from the manufacturer to the pharmacy and from the pharmacy to the end user. Further package handling involves dissembling into smaller units of big pallet loads for stacking on shelves in distribution warehouses and then picking off the shelves to assemble mixed product loads to meet the user needs. This means that packages and their content are subjected to vibrations and shocks, temperature fluctuations, mechanical pressure, humidity changes and variation in atmospheric pressure. These fluctuations can lead to seal failure, cracking of blisters, scuffing of labels and decorated surfaces. Packages may also experience reduced atmospheric pressure and temperature fluctuation during distribution, which may lead to deterioration of the properties of the material of the package leading to undesired ruptures.

Despite these fluctuations, the packages still need to meet several criteria like: i) if sterility is needed, it must be maintained for the duration of the specified shelf life; ii) normal distribution hazards must be tolerated without product or package damage; iii) the pharmaceutical composition must tolerate physical contact with the package without adverse reactions; iv) packages must tolerate the climatic conditions; v) the package surface must be of suitable material to accept labelling and/or printing and have sufficient area therefore; vi) comply with national regulations.

In order to protect a blister package and its content during transportation, several approaches have been used.

One known approach provides a solution to the aforementioned problem by using external "boxes" to contain the blister packages, e.g. typically used with blister packages containing oral contraceptives.

For example, WO 07072494 describes a multi-layer thermoformed, translucent pharmaceutical packaging blister container consisting of poly vinyl chloride (PVC), which can be metalized so as to achieve a degree of opacity.

US 2003/098257 describes a credit card-sized carrier for a medication. The carrier is composed of a lower housing having a cavity which houses a medicament wafer. A cover is removably attached to the lower housing to enclose the cavity.

WO 08104765 relates to a container suitable for use in packaging pharmaceutical products such as tablets and capsules. The container can be withdrawn from a box or sleeve to a fully extended position whereby a user can remove any item stored in the container.

In some other approaches an external carrier is used, where by external carrier is meant an external packaging, mainly hard paper or cardboard, which can house a variety of blister packages.

For example, US 2007/0187273 discloses a packaging container for displaying and housing products. The packaging container may include tear-resistant housing that encloses an opaque tray made from a paper material. An insert card may be used within the housing to reinforce the container so as to obtain a clamshell package.

US 2005/0077203 relates to a press through blister package (PTP) case with one or more pills therein. The PTP case includes foldable members to accommodate the blisters.

US 2006/289328 describes a foldable package including a blank having a face panel and a back panel, where a blister pack is sealed between them. In this way the blisters are aligned over gates and protrude through apertures and tabs and form a composite pull tab. To remove an item from a blister, the pull tab is pressed out of the panels, the tab strip is peeled from the back panel, and pressure is applied to force the item through the backing sheet of the blister pack and the exposed gate.

WO08014862A relates to a packaging for solid pharmaceutical forms which is further packed into a secondary container to improve its protection.

In same other approaches, solid dispensers for containing and dispensing pills have been used.

For example, U.S. Pat. No. 5,788,079 describes a pill sorting container which is characterized by three layers: i) a recessed support made of rigid plastic material with cavities therein, ii) a container defining sheet made of plastic, designed to fit into the support for containing the pills, and iii) a container sealing sheet made of self-adhesive paper.

U.S. Pat. No. 5,381,904 discloses a dispenser for medical preparations including a rectangular box which accommodates an insert for containing a series of compartments for receiving the medical preparations. The dispenser is opened by shutters which can slide.

US 2005/0084700 describes a pharmaceutical compositions container characterized by a solid carrier, which can be made of plastic, having cavities where cup-shaped inserts can be formed with a mould material. These inserts may be designed freely so as to fit the pharmaceutical compositions, e.g. tablets, to be contained.

An alternative solution to the problem is described by US 2003/102247 where blister packages are wound around each other into a container.

The above discussed holders, dispensers and pharmaceutical packages are deficient in several aspects. Significantly, none of the above references presents a convenient, simple and effective way of protecting a blister packaging for medical use and its content from undesired rupture during transportation and handling; e.g. boxes protecting medical packaging can generally not withstand pressure strain from mail delivery. The ability to withstand pressure strain from mail delivery is a requirement that has been arising in particular in recent times, because of the development of online pharmacy systems, where patients can order medicine on line and get them delivered to their addresses.

Further, none of the above references specifically addresses a way to facilitate the opening of a blister package where these conditions of safety are present. Such opening can be particularly difficult for elderly or weak people. Therefore, there remains a need for a simple, inexpensive and convenient means for providing a disposable container for pharmaceutical compositions which is easy to open and has a high degree of safety against undesired rupture and pressure. Automatic handling of medical packages may involve robotic intervention. Robotic handling may comprise systems which pick and transport medical packages by applying suckers to different surfaces of the package by means of vacuum. Generally, as medical packages have a high degree of flexibility, the packages may be deformed upon automatic handling. For example, upon application of suckers on the top surface of the package, this surface may bend inwards causing poor handling and failure in grasping of the medical package.

Hence, an improved medical package that can be robotically handled without risk of permanent damage would be advantageous.

Hence, an improved container for pharmaceutical compositions would be advantageous, and in particular an improved disposable container for pharmaceutical compositions which could be able to protect the contained pharmaceutical compositions during transportation in hard conditions, e.g. sent by normal mail, would be advantageous.

OBJECT OF THE INVENTION

It is an object of the invention to provide a disposable container for pharmaceutical compositions where the pharmaceutical compositions contained are protected against undesired rupture of the package while opening of the package is still easy and convenient for people of all levels of ability and dexterity.

It is also an object of the invention to provide a disposable container for pharmaceutical compositions in the form of soft shell pills.

It is a further object of the present invention to provide an alternative to the prior art for personal transportation of a disposable container for pharmaceutical compositions which allows it to be personally carried and transported, e.g. in a pocket, and at the same time provide a good protection against undesired rupture of the package.

In particular, it may be seen as an object of the present invention to provide a container for a pharmaceutical compositions that solves the above mentioned problems of the prior art with the use of a rigid structure.

It is an object of the present invention to provide a disposable pharmaceutical compositions container having cavities on its surface for dispensing pills, tablets and capsules comprising a rigid and compact structure to surround and protect the pharmaceutical compositions contained herein.

It is an object of the invention to allow for mechanical handling of those containers, i.e. medical packages.

It is an object of the invention to allow for mechanical handling of those containers avoiding the undesired bending of the lids due to the flexibility of the medical packages.

SUMMARY OF THE INVENTION

The present invention relates in particular to a disposable pharmaceutical compositions container for dispensing pills, tablets and capsules comprising a rigid structure of material having cavities on its surface to surround and protect the pharmaceutical compositions contained herein.

Disposable is herein defined as designed to be disposed of after use, so that it may be disposed of after one use. In particular, disposable is herein defined as adapted to be used only once, i.e. single use, meaning that further use of the package after the removal of the cover sheet in not feasible, e.g. the cover sheet cannot be re-attached to the carrier after being removed.

For the purpose of this application disposable is also referred herein as single use. The methods according to the invention may have the advantage of making the method of producing a single use medical package in a more efficient and less costly way as will be clear from the following.

Thus, the above described object and several other objects are intended to be obtained in a first aspect of the invention by providing a single use medical package comprising at least four sections made from a single sheet foldable into a folded configuration thereby producing a rigid structure, each section being pivotally connected to at least one of the other sections along fold lines in the single sheet, wherein at least two sections of the at least four sections are a first and a second carrier sections pivotally connected to each other, each comprising cavities for housing pharmaceutical compositions, the first and second carrier sections being adapted to mutually engage upon folding and/or pressing of the first and said second carrier sections onto each other, and wherein two sections are end sections not comprising cavities, the end sections being foldable to adjacent to and at least partly covering said carrier sections when the sheet is folded so as to protect the carrier sections.

By "mutually" is preferably meant that the carrier sections engage two-by-two so that when there are more than two carrier sections, they do not necessarily all engage with any of the other carrier sections. It is also covered by the scope of the present invention that have one or more of the carrier sections engaging with more than one other carrier section.

"Pivotally is herein defined as connected in a pivotal manner, e.g. by means of or on a pivot so that it can be turned around along a pivot such as a specific point, axes or edge, e.g. a fold line as indicated by the figures of the invention.

By stating that "the end sections do not comprise cavities" is preferably meant that they not contain cavities for housing pharmaceutical compositions. It does not exclude that they contain other types of cavities, if desired for other purposes. One of the advantages of the invention is that optimal mechanical handling of the package is achieved as the end sections of the single sheet, having the function of protecting the carrier sections when the sheet is folded, i.e. a lid, is supported by the rigid structure located underneath so that bending of the lid upon handling is avoided. The rigid structure underneath the lid is provided by the mutual engagement of the carrier sections. Hereby additional stiffness is provided both by the end sections and the rigidity due to the mutually engagement of the carrier sections.

Stiffness is defined as the resistance to deformation of an elastic body, i.e. the medical package resistance to deformation due to an applied force. For example, a desired degree of stiffness implies a resistance against deformation which allows for shipment by mail and prevents undesired rupture of the cover sheet, medical package or pharmaceutical compositions.

A further advantage of the invention is that the package allows for transport of pharmaceutical compositions in the form of soft shells tablets. Generally, soft shells tablets are not easy to transport as their soft shell or coating is more sensitive towards vibrations and pressure shocks. To allow transportation and handling of soft shells tablets, reinforcements are generally provided in the form of extra coating layers onto the tablets. This renders soft shells tables easier to handle. The present invention allows for transport of soft shells tablets protecting them from mechanical degradation and avoiding the need for further tablet treatments. Furthermore, soft shell tablets can be accessed avoiding undesired degradation and potential destruction which is generally caused by using push-through opening system, whereas in some embodiments of the present invention, the access to the tablets is gained by using a pull-off or tear-off opening system.

A rigid structure is herein defined as a structure with the characteristic of being firm, having a certain degree of stiffness, unbendability and inflexibility so as to allow for safe handling in transportation through normal post avoiding undesired rupture.

One of the disadvantages of the prior art is that lid surfaces generally bend inwards upon the application of suckers on the top surface of the package during manufacturing and filling of the packages.

The invention overcomes this disadvantage by providing carrier sections adapted to mutually engage upon folding and/or pressing on each other.

The rigid structure of the invention allows for optimization of the package size as well as its compactness, i.e. the way the blisters are arranged on the carrier sections uses the space in a very effective way. For example, the package of the invention may contain more tablets than a standard package of the same size due to its compactness, since tables and blisters are arranged closer than the ones in standard packages due to the blister arrangement. This is advantageous for both robotic handling and mail distribution, e.g. in relation to online pharmacy. In that, "rigid structure" is defined, meant and referred to in this application also as "rigid and compact structure".

In some embodiments the at least four sections are adapted to be folded into a folded configuration where the two carrier sections are located adjacent to each other with the cavities intermeshing and with open sides of the cavities facing away from each other.

Carrier sections are characterized by a top and a bottom surface. The top surface is defined as the surface comprising the open side of the cavities. The bottom surface of the carrier sections on the contrary is defined as the one comprising the bottom surface of the cavities.

In some embodiments the first and second carrier sections comprise members which mutually engage upon folding and/or pressing of the first and the second carrier sections onto each other.

In some further embodiments the members are located on the external surface of the cavities for housing pharmaceutical compositions.

Members may be protrusions or depressions having complementary shapes or dimensions.

In some embodiments all cavities have members. In some other embodiments at least two pair of opposite cavities have complementary members.

Members on the cavities may be protrusions on the cavities side walls or bottom wall which mechanically engage with depression on opposite adjacent cavities so as to achieve interlocking.

For example, members may be protrusions extending out of the external surface of the cavities. Members may be hollow or solid, e.g. empty depressions or protrusions filled with material such as the same or other material than the one of the carrier section.

In some other embodiments the cavities on a first and second carrier sections are characterized by members that interlock upon folding and/or pressing of the first and second carrier sections onto each other.

The external surface of the cavities is defined as the surface that is not in contact with the pharmaceutical composition contained in the cavities.

In some other embodiments the mutual engagement comprises interlocking between the members.

In some further embodiments the mutual engagement comprises interference fit between the members.

In some embodiments the members are protrusions extending out of the external surface of the cavities of the first carrier section and depressions on the external surface of the adjacent cavities of the second carrier section.

Adjacent cavities is referred to as when the package is folded, i.e. the corresponding and complementary cavities located on the opposite carrier section.

These protrusions and depression may interlock or press fit, e.g. male-female lock upon folding and/or pressing of the first onto the second carrier section.

In some further embodiments the members are apertures on a top surface of the first and second carrier section and protrusions on a bottom surface of the cavities.

In some other embodiments the members are hollow protrusions on the first carrier section extending out of the bottom surface of the first carrier section, and hollow spaces on the second carrier section which hollow protrusions and hollow spaces mutually engage upon folding and/or pressing of the first and the second carrier sections upon each other.

The hollow spaces may be characterized by wall structures raised above the surface of the carrier structure defining an interior region where the hollow protrusions engage by interlocking or by interference fit upon folding and/or pressing of the first and the second carrier sections onto each other.

In some further embodiments the cavities of each of the at least two carrier sections have complementary shapes so that cavities on a first carrier section are adapted to engage in an interference fit with cavities on a second carrier section when the sheet is folded.

Two complementary shapes can be combined together so that their surfaces mutually engage, e.g. plug-socket or key-lock.

An interference fit, also referred to as a press fit, provides fastening between two carriers simply by friction after the carriers, e.g. the complementary shapes of the cavities, are pushed in contact.

Shape is defined as its geometry as well as its dimensions, e.g. length, height, or width. In that "complementary shape" refers to cavities which are geometrically complementary. However complementary cavities may also be cavities having dimensions which are complementary.

In some embodiments the cavities of each of the at least two carrier sections have side walls having complementary curvatures so that side walls of cavities on a first carrier section are adapted to mutually engage with side walls of cavities on a second carrier section when the sheet is folded.

Curvature refers intuitively to the amount by which a geometric object deviates from being flat.

Opposite carrier sections folded to provide a rigid structure to the medical package may be kept in the folded configuration by fastening opposite cavities.

In some embodiments the cavities of the first carrier section have a distal end having an external diameter which is complementary to the proximal end of said cavities of a second carrier section.

In some further embodiments the cavities of the first carrier section have a proximal end having an external diameter which is complementary to the distal end of the cavities of a second carrier section.

The proximal end of the cavities of a first carrier section may have a shape engaging with the corresponding terminal end of the cavities of a second carrier section so as to interlock.

The proximal end is referred herein to as the portion of the cavity closer to its opening. The distal end, opposite to the proximal end is therefore referred herein to as the portion of the cavity closer to its bottom.

By being complementary, proximal and distal end of the cavities corresponding to the opposite carrier sections, i.e. the first and second carrier sections, may mechanically interlock. For example, the complementary shape may be the external diameter of the cavities.

Interlock is referred herein as mechanically locked, so that the carrier sections once interlocked cannot be separated upon the opening of the medical package, i.e. the opening of the end sections forming the outer cover parts.

Upon opening of the medical package, the cover parts are lifted providing access to the underneath carrier sections. As opposite carrier sections are interlocked two-by-two, the opening of the medical package does not cause unfolding of the carrier sections. Thereby the rigid structure of the package is kept also after the opening due to the fastening of the carrier sections. Access to the cavities may be achieved by removal of cover sheets, e.g. by peeling off the cover sheets, while the carrier sections are kept in the folded state.

The cover sheet material may be an aluminium foil or a laminate containing aluminium foil. The aluminium foil may be replaced by a plastic foil. The aluminium foil may be also replaced by a plastic that exhibits low elasticity and poor stretching properties. A plastic material having these properties may be obtained when large amounts of filler materials are added to the plastic.

Filler is herein defined as particles of a material which is added to plastic material to provide properties which are different in respect to the one of the plastic alone. In some other embodiments the cover sheet may be also made of plastic, plastic laminates, plastic/paper laminates or plastic/metal foil laminates, metal foils.

The cover sheet may cover at least partially the recessed carrier and, for example, by sealing or adhesive bonding and may be joined to the carrier. In some embodiments the cavities of the carrier may be surrounded by a shoulder, said shoulders together forming an interconnected flat plane. In these embodiments the cover sheet is jointed to the carrier by sealing or adhesive bonding at the shoulders. The cover sheets may be sealed or adhesively bonded to the shoulders over the whole area or, by choosing a special sealing tool or bonding pattern for the purpose, this sealing or bonding may be only partial.

The cover sheet may also feature a barrier layer against gases, vapours and light. Such barrier may be comprised in the material constituting the cover sheet or may be added as supplementary layers as described previously in relation to the carrier.

The access to the cavities of the carrier is obtained by removal of the cover sheet.

In some other embodiments, the access to the cavities is achieved by removal of the at least one cover sheet.

In some embodiments, the removal of the at least one cover sheet is achieved by peeling off the at least one cover sheet.

Removal of the cover sheet may be by peeling off, e.g. tearing off the sheet or by peeling, e.g. tearing off a gripping element connected to the cover sheet such as a tab, a strip, a snip, a notch or a flap. This gripping element has the characteristics of being at least partially not sealed or not strongly sealed to the carrier. It has the function of providing a better grip to the user for peeling off, e.g. tearing off the cover sheet and gain access to the cavities. Form, size and shape of the gripping element are linked to its function. The gripping element may have any form and size which allows for human or mechanical gripping. The gripping element shape may be of any geometrical form or combination of forms, e.g. triangular, circular or square. In some embodiments the gripping elements may have a user friendly shape, e.g. resembling a pad so as to provide a better user hold upon use. In some embodiments the gripping element may be made of non-slippery material, such as rubber or may have a certain degrees of surface roughness so as to provide a better grip. The gripping elements may be placed in different locations along the edges of the cover sheets.

The combination of a peeling-off, e.g. tearing-off, the at least one cover sheet and the carrier comprising a rigid structure with or without a helping element facilitates the opening of the package. Generally, medical staff or patients with chronic diseases or people with low level of ability and dexterity have a great deal of frequent opening of medical packaging. When these medical packages employ an opening push through system, frequent users may be affected by causing occasionally wrist medical condition e.g. wrist sprains or finger medical conditions such as finger pain. The problem is rather frequent as shown by the presence on the market of machineries adapted to push-through tablets, pills or capsules reducing strains on users' joints. The invention has the advantage of allowing for an easier opening system as peeling-off, e.g. tearing-off a flexible cover sheet from a rigid package is facilitated by the rigidity of the carrier. Generally when peeling-off or tearing-off of a cover sheet is part of the opening system, a user often faces the problem that peeling-off or tearing-off flexible layers from a soft and flexible carrier is rather difficult as the carrier may follow the peeling-off movement leading to a not efficient peeling-off.

In some embodiments a system to allow selective access to cavities on the carrier is employed. For example the cover sheet may be interrupted along specific lines determined by the cavities edges. In this way removal the cover sheet may be partial as to provide only access to a single cavity and the pharmaceutical composition contained herein at a time.

In some embodiments the single use medical package comprises at least two cover sheets wherein the carrier has at least two cavities for housing pharmaceutical compositions, the at least two cover sheets are at least partially sealed to the carrier around the at least two cavities for housing pharmaceutical compositions, and the at least two cover sheets overlap and delimit at least one element characterized in that the access to said at least one element is gained by removal of the precedent overlapping cover sheet and that the access to further elements is gained by sequential removal of the respectively precedent overlapping cover sheets.

In some embodiments the cover sheets overlap in predetermined areas delimiting elements which can be gripped and peeled or torn off by pulling upwards and backwards to provide access to the relative cavity located on the underneath carrier. Removal of the first cover sheet by peeling or tearing off of the cover sheet or of a gripping element connected to it provides access to a first cavity and to an element which in turn can be peeled or torn off to provide access to the second cavity and its content and to a second element and so on. Removal of cover sheets may be obtained in a predetermined and specific sequential way determined by the overlapping of the cover sheets delimiting the elements. This has the advantage of allowing for access to the content of the relative cavity in a desired and predetermined sequential way.

Sequential is defined as occurring in regular succession, while preceding is defined as previous following a specific spatial order, e.g. the top cover sheet precedes the immediate bottom overlapping one. Therefore, the access to the first element is gained by removal of the first cover sheet through a determined action, e.g. pull-off or tear-off, on the cover sheet or of a gripping element connected to it and access to the second element is gained by removal of the second cover sheet through a determined action, e.g. pull-off or tear-off, of the first element and so on.

The element at least partially delimited by the overlapping of the cover sheets may take the form of a tab, a strip, a snip, a notch or a flap. The element has the characteristics of being at least partially not sealed or not strongly sealed to the carrier. It has the function of providing a better grip to the user for peeling off or tearing off the cover sheet and gain access to the cavity.

Day and time indicia, which may be also identified by a colour code, may also be incorporated into the disposable package of the present invention.

In some other embodiments the access to the cavities on the carrier may be obtained by other opening system, e.g. bend and peel off or tear and peel off of the cover sheet.

In some embodiments to prevent unfolding of the carrier sections, opposite carrier sections are further joined two-by-two not only by interlorcking means but also by means of adhesive, such as hot melt adhesive, located on the abuting surfaces of the carriers sections. This further prevent mutual movement of the two carrier sections once folded.

In some embodiments the fold lines between the first and the second carrier sections pivotally connected to each other are at least two fold lines defining a walled structure upon folding and/or pressing of the first onto said second carrier sections.

The walled structure is created by folding the single sheet along the two fold lines providing extra rigidity to the structure also from side handling.

In some further embodiments at least a first end section has a rim, the rim protruding out of the first end section, the rim being located at least partially around an internal peripheral edge of the first end section thereby when folded the rim is pressed fit with at least part of a wall of a second end section.

In some embodiments the medical package has a rim located on the internal surface of the first end section which by being in press fit contact with the internal surface of the side wall of the second end section allow for optimal mechanical handling. The press fit contact between the rim of an end section and the walls, such as side walls of another end section provides the outside surface of an end section with a plane and stiff surface. The rigidity or stiffness of the package is increased by the press fit contact of the rim to the internal surface of the side wall of the second end section when the medical package is folded. Therefore, a more robust surface for mechanical or robotic side handling of the medical package is achieved through the support of the rim.

In some embodiments the at least four sections are arranged in a row. In some other embodiments the at least four sections have different arrangements.

Once the at least four sections of the single sheet are folded, the medical package achieves the desired degree of stiffness, e.g. for being mechanically handled and sent by normal mail without the need of additional external packaging, such as bubble envelopes or boxes with soft interior. Indeed the desidered degree of stiffness can be achieved reducing packaging volumes, cost for distribution and environmental costs. In that respect it is an advantage of the present invention that the compact size of the disposable package is so that the package can be delivered directly through letter slots (mail drop) in a standard mail box.

In some embodiments according to one of the aspect of the invention each of the two end sections of the at least four sections constitutes an outer cover part for at least one of the carrier section, each of the two end sections being pivotally connected the correspondent carrier section.

In some embodiments, the carrier sections are more than two. These embodiments have the advantage of providing a package with a larger capacity. The carrier sections in these embodiments folded two-by-two may preferably be joined by adhesive or an interlocking mechanism. In this way a medical package having double or multiple carrier sections joint two-by-two may be obtained. In this configuration the two end sections, i.e. the outer covers, provide direct cover only over the external carrier sections. A package with multiple carrier sections joint two-by-two may provide better rigidity to the package and increase the number of cavities available for carrying pharmaceutical compositions, with a limited increase of the package thickness.

A package with multiple carrier sections according to the invention has the advantage that it can be extended without losing rigidity, protection or compactness. This is not always the case with standard packages when one expands their capacity.

In some embodiments, the at least one cover sheet is protected by a lid. Herein lid is defined as a removable film, foil, rigid sheet, panel or a hollow body which protects the cover sheet from undesired rupture.

In some other embodiments the lid may also contain a leaflet with information of interest to the patient, e.g. instructions on how to use the pharmaceutical compositions contained, or commercial for related medicaments.

In some other embodiments these information of interest for the patient may be printed, embossed, carved, stamped or etched on the internal or external surface of the at least one lid.

This embodiment has the advantage of preventing wrong uptake of medicine and providing correct compliance to therapeutically regimen. Generally leaflets are inserted into external packages separated from the blister package. These leaflets can easily get lost as the external paper package experiences frequent rupture or simply for forgetfulness of the patients. In some cases the blister package is carried alone by the patient without the external package and the instruction leaflet is mostly left with it. The embodiment according to the invention has the advantage that allows for carrying of the leaflets together with the pharmaceutical composition carrier so that it is always possible to check posology of the pharmaceutical composition to be used before uptaking and therefore avoiding mistake in adherence to the therapeutically regimen.

The at least one lid may be made of plastic, plastic laminates, plastic/paper laminates or plastic/metal foil laminates or metal. Non-limiting exemplary suitable plastics for the carrier are laminates containing PVC, polyamides, polyolefins, polyesters, polycarbonates, teflon and combinations thereof. The at least one lid may be also made of material which is at least partially transparent in visible range of light as to allow for visual inspection pharmaceutical composition contained in the cavities of the carrier.

In some embodiments the at least one lid is fully removable. In other embodiments the at least one lid may be opened through a rotation of the lid along at least one rotational joint located on the carrier.

In some other embodiments the at least one lid is or comprises at least one adhesive element, such as a long thin piece of plastic, cloth or paper with binding capabilities, e.g. a piece of tape. In those embodiments access to the cover and carrier can be obtained through a rotation of the lid along one of the edges of the carrier.

In some embodiments the at least one rotational joint may be a hinge. In some embodiments the at least one rotational joint may be a pivot hinge. In some other embodiments the at least one rotational joint may be a pivot hinge with spring means for producing of a counter rotation moment. The presence of a pivot hinge allows for opening of the lid by a lateral rotation movement. In this embodiment closing of the lid is then obtained by the overlay of the lid onto the carrier by the opposite lateral rotation movement.

In some other embodiments the at least one lid is or comprise at least one hollow body, such a sleeve.

In some embodiments the at least one cover sheet may be protected by different lid system, for example access to the at least one cover sheet may be obtained through a slidable windows/shutters system.

In some embodiments the lid is one of the at least two end sections.

In a second aspect of the invention a method of manufacturing a medical package as described above is presented. The method comprises: providing a sheet of plastic material comprising at least four sections, each section being pivotally connected to at least one of the other sections along a fold line in the single sheet wherein at least two sections of said at least four sections are a first and a second carrier sections pivotally connected to each other and each comprising cavities, and two sections are end sections not comprising cavities; filling the cavities with pharmaceutical compositions; attaching at least one cover sheet to the carrier sections so that open sides of the cavities are sealingly covered by the at least one cover sheet; folding the carrier sections so that the cavities mutually engage; fastening the carrier sections together and folding the end sections to adjacent carrier sections.

In some embodiments the fastening comprises interlocking the at least two carrier sections.

In some further embodiments the interlocking comprises pressing the at least two carrier sections together so that corresponding cavities and/or members on the first and second carrier sections interlock.

In some embodiments the folding of said carrier sections comprises: folding said carrier sections by 180° into an overlapping configuration so that the carrier sections lie on top of each other.

In some embodiments the folding of the carrier sections comprises: folding the carrier sections by 180° into an overlapping configuration so that the carrier sections lie on top of each other with the cavities intermeshing and with the open sides of the cavities facing away from each other.

In some further embodiments the folding of the end sections comprises: folding the end sections by 180° into an overlapping configuration onto the carrier sections so that each end section overlaps the carrier section to which is pivotally connected to.

In any of the methods as described, the sheet of plastic material may be provided by injection moulding. Alternatively, it may be provided by thermoforming or any other suitable process including 3D-printing.

Some embodiments of a medical package according to the first aspect of the invention is provided by a method comprising: processing a sheet of a plastic material; filling the cavities with pharmaceutical compositions; attaching at least one cover sheet to the carrier halves so that the open sides of the cavities are sealingly covered by the at least one cover sheet; punching fully or partly through the sheet of plastic material at locations where the carrier halves are to be separated from the rims areas; attaching the outer foil to the rims areas; folding the carrier halves together so that the cavities intermesh, and joining the carrier halves.

Rims areas are defined as the areas of the carrier sheet adjacent to the rims.

Joining may be done by means of glue deposited before or after the folding.

In some embodiments manufactured in this way, the folding of the carrier halves comprises: before separating the carrier halves from said rims areas, folding the carrier halves and the rims areas by 180° into an overlapping configuration so that the carrier halves lie on top of each other.

In some other embodiments the folding of the carrier halves comprises: after separating the carrier halves from the rims areas, folding the carrier halves by 180° into an overlapping configuration so that the carrier halves lie on top of each other.

In some embodiments according to this aspect of the invention, the punching is fully through the sheet of the plastic material allowing for folding of the carrier halves by 180° into an overlapping configuration so that the carrier halves lie on top of each other, while the rims areas remains unfolded in the same plane.

As is clear from the above, the single use medical package according to the invention is characterized by a carrier, formed by two carrier sections, which is a robust and rigid structure with cavities for housing pharmaceutical compositions. The rigid structure allows for safety in transportation and for protection of pharmaceutical composition during transportation by avoiding undesired ruptures even in harsh conditions of transport. For example, the disposable package of the present invention could be sent and delivered by standard postal mail without the needs of further external packaging for protection; providing therefore a better protection and reducing packaging volumes and environmental costs, e.g. of more than 50%, due to reduction of packaging material needed and package disposure. In that respect it is an advantage of the present invention that the size and dimensions of the disposable package are so that the package can be delivered directly in a standard mail box.

In some embodiments the rigid structure is or comprises an internal hollow structure. In some embodiments the rigid hollow structure may be internally filled with air or other gases, e.g. inert gases, in order to protect the pharmaceutical compositions.

The material constituting the carrier comprising the rigid structure with the function of pharmaceutical composition container may be plastic, plastic laminates, plastic/paper laminates or plastic/metal foil laminates or metal. Non-limiting exemplary suitable plastics for the carrier are laminates containing PVC, polyamides, polyolefins, polyesters, polycarbonates, teflon and combinations thereof. The carrier may also feature a barrier layer against gases, vapours and light. Such barrier may be comprised in the material constituting the carrier or may be added as supplementary layers for example as a metal foil such as an aluminium foil embedded in a plastic laminate or ceramic layers or metallic layers embedded between two plastic layers. Ceramic layers may be produced by evaporating metals, oxides or nitrides of aluminium, silicon and other metals and semimetals in vacuum and depositing the substances on a plastic substrate. The ceramic layers may be preferably contain aluminium oxides or silicon oxides or may be mixtures of various oxides, if desired also mixed with metals such as silicon or aluminium. Metal layers may be created by evaporating metals in vacuum and depositing the metals on a plastic substrate; aluminium layers may be mentioned here by way of example. The plastic substrate may be a plastic film or a plastic base made of the above mentioned plastics.

Two engaging carrier sections may be called a carrier in the following as it can be considered as one unit. In some embodiments the carrier has at least one cavity for housing pharmaceutical compositions on the top and at least one cavity for housing pharmaceutical compositions on the bottom surface of said carrier, i.e. the cavities are present on the top and on the bottom surface of the carrier.

A pharmaceutical composition herein referred may comprise any biologically-active substance, without limitation. Preferably, the dosage units of the present invention comprise vitamin A, B vitamins, vitamin C, vitamin D, vitamin E, vitamin K, essential fatty acids, folic acid, iron, calcium, magnesium, potassium, copper, chromium, zinc, molybdenum, iodine, boron, selenium, manganese, derivatives thereof or combinations thereof. Non-limiting exemplary biologically-active substances of the present inventive subject matter may include thiamine, thiamine pyrophosphate, riboflavin, flavine mononucleotide, flavine adenine dinucleotide, niacin, nicotinic acid, nicotinamide, niacinamide, nicotinamide adenine dinucleotide, tryptophan, biotin, pantothenic acid, ascorbic acid, retinol, retinal, retinoic acid, beta-carotene, 1,25-dihydroxycholecalciferol, 7-dehyrdocholesterol, alpha-tocopherol, tocopherol, tocotrienol, menadione, menaquinone, phylloquinone, naphthoquinone, calcium, calcium carbonate, calcium sulfate, calcium oxide, calcium hydroxide, calcium apatite, calcium citrate-malate, calcium gluconate, calcium lactate, calcium phosphate, calcium levulinate, phosphorus, potassium, sulfur, sodium, docusate sodium, chloride, magnesium, magnesium stearate, magnesium carbonate, magnesium oxide, magnesium hydroxide, magnesium sulfate, copper, iodine, zinc, chromium, molybdenum, carbonyl iron, ferrous fumarate, polysaccharide iron, and combinations and derivatives thereof, without limitation. Non-limiting exemplary derivatives of vitamin compounds include salts, alkaline salts, esters and chelates of any vitamin compound.

Pharmaceutical composition may be prescription or non-prescription substances or excipients for use in prescription or non-prescription substances. Non-limiting exemplary prescription substances include 13 C-urea (*Helicobacter* test), 15-Methyl-prostaglandin F2α, 1α-Hydroxyvitamin D3, 2,4-dichlorbenzylalkohol, 5-aminolevulinic acid hydrochloride, 5-aminolevulinsyre (5-ALA), abacavir, abacavir/lamivudine, abacavir/lamivudine/zidovudine, abatacept, abciximab, acamprosat, acarbose, acebutolol, acepromazin, acetaminofene, acetate, acetazolamide, acetophenazine, acetylcysteine, acetylsalicylic acid, aciclovir, acipimox, acitretin, acrivastin, acyclovir, adalimumab, adapalen, adefovir dipivoxil, adenosin, adrenalin, aesculin, agalsidase alfa, agalsidase beta, agalsidase-alfa, agalsidase-beta, agomelatin, agomelatine, alanin, albumin, humant, aldesleukin, alemtuzumab, alendronat, alendronate sodium/colecalciferol, alendronic acid/colecalciferol, alfacalcidol, alfentanil, alfuzosin, alginsyre, alglucosidase alfa, alimemazine, aliskiren, aliskiren hemifumarate/hydrochlorothiazide, alitretinoin, allopurinol, almitrin, almotriptan, alprazolam, alprenolol, alprostadil, alteplase, aluminiumaminoacetat, aluminiumhydroxid, aluminiumsaccharosesulfat, alkalic, amantadine, ambenon, ambrisentan, ambroxol, amfepramon, amidotrizoat, amiloride, aminofyllin, aminoglutethimid, aminosalyl, amiodaron, amisulprid, amitriptylin, amlodipin, amlodipine besylate/valsartan/hydrochlorothiazide, amlodipine besylate/valsartan, amlodipine/valsartan, amorolfin, amoxicillin, amphotericin B, ampicillin, amprenavir, amsachrin, amylase, amylmetacresol, anagrelide, anakinra, anastrozol, anidulafungin, antazoline, antithrombin, antithrombin alfa, anti-thymocytglobulin, apomorphine, apraclonidin, aprepitant, aprotinin, arcitumomab, argatroban, arginin, aripiprazole, arsenic trioxide, articain, ascorbic acid, asparagin, atazanavir, atenolol, atomoxetin, atorvastatin, atosiban, atovaquon, atropine, auranofin, aurothiomalat, aviptadil, azacitidin, azacitidine, azapropazone, azathioprin, azelaic acid, azelastine, azetazolamide, azithromycin, aztreonam, aztreonam C1-esterase-inhibitor, human, bacampicillin, bacillus Calmette Guérin (Danish strain 1331), bacillus Calmette Guérin (strain RIVM derived from strain 1173-P2), baclofen, balsalazid, bambuterol, bariumsulfat, basiliximab, bazedoxifene, becaplermin, bechiomethasone, beclometasondipropionat, benazepril, bendroflumethiaziede, bensatropine, benserazid, bensylpenicillin, benzalkonium chloride, benzene carboxylic acid, benzenmethanol, benzocain, benzoic acid, benzoylperoxid, benzydamin, benzylpenicillin, betacarotene, betahistin, betain, betaine anhydrous, betamethason, betamethason-17-valerat, betamethason-21-acetat, betamethasondipropionat, betamethasonphosphat, betanidine, betaxolol, bevacizumab, bexarotene, bicalutamid, bimatoprost, bimatoprost/timolol, biotin, biperiden, bisachodyl, bisoprololfumarat, bivalirudin, black rubber-mix (PPD-mix), bleomycin, borax, bortezomib, bosentan, botulinum toxin type a, botulinum toxin type B, brimonidin, brimonidintartrat, brinzolamide, brinzolamide/timolol, bromazepam, bromhexine, bromocriptine, brompheniramine, budesonide, bumetanide, bupivacain, buprenorphine, buprenorphine/naloxone, bupropion, buserelin, buspiron, busulfan, butyiscopolamin, cabergolin, cadexomer-iodine, caffeine, cain-mix, calcipotriol, calcitirol, calcitonin, calcitonin (salmon), calcium, calciumacetate, calciumcarbonate, calciumchloride, calciumfluoride, calciumfolinate, calciumgluconate, calciumlactogluconate, calciumpolystyrensulfonate, canakinumab, candesartancilexetil, capecitabine, capsaicin, captopril, carbamazepine, carba-mix, carbetocin, carbidopa, carbimazol, carbomer, carbon, active, carboplatin, carboprost, carglumic acid, carmelloseSodium, carmustin, carvedilol, caspofungin, catumaxomab, cefalexin, cefotaxim, cefoxitin, ceftazidim, ceftriaxon, cefuroxim, celecoxib, cephaclor, cephadroxil, cephalexin, cephalotin, cephradin, certolizumab pegol, cetirizin, cetrorelix, cetuximab, chinidine, chlofibrate, chiomethiazol, chiomipramin, chlonazepam, chioprothixene, chioraihydrat, chlorambucil, chloramphenicol, chlordiazepoxid, chiorhexidine, chloride, chioriongonadotropin, chioroquin, chlorpromazine, chiorpropamid, chlorprothixen, chiorthalidon, chlorzoxazon, chiotrimazol, cholecalciferol, vitamin D3, cholinetheophyllinate, choriogonadotropin alfa, choriongonadotropin, humant (hCG), choriongonadotropin-α (hCG), chrome, ciclopirox, ciclopiroxolamin, ciclosporin, cidofovir, cilastatin, cimetidine, cinacalcet, cinchocain, cinetazon, cinnamaldehyd, cinnamylalcohol, cinnarizine, ciprofloxacin, cis(Z)-flupenthixoldecanoat, cisatracurium, cisplatin, citalopram, Cl+Me-isothiazolinon (Kathon CG), cladribin, cladribine, clarithromycin, clavulansyre, clemastin, clemastine, clindamycin, clioquinol, clobazam, clobetasolpropionat, clobetason-17-butyrat, clodronat, clofarabin, clomiphene, clomipramin, clonazepam, clonidine, clopamide, clopidogrel, clotrimazol, cloxacillin, clozapin, cobalt(II), cobber, cobber acetate, codeine, colesevelam, colestipol, colestyramin, colistimethatSodium, corticotropin, cortisone, cyanochobalamine, cyanocobalamin, vitamin B12, cyclandelar, cyclizine, cyclopentolat, cyclophenile, cyclophosphamid, cyproheptadine, cyproteron, cyproteronacetat, cysteamin, cystein, cystin, cytarabin, cytarabine, dabigatran etexilate, dacarbazine, daclizumab, dalteparin, dantron, dapson, daptomycin, darbepoetin alfa, darifenacin, darifenacin, darunavir, dasatinib, daunorubicin, deferasirox, deferiprone, deferoxaminmesilat, degarelix, demeclocycline, depreotide, desfiuran, desipramin, desirudin, deslanoside, desloratadine, desloratadine (as sulphate), desmopressin, desogestrel, desoximethason, dexamethason, dexchlorpheniramine, dexibuprofen, dexketoprofen, dexpantenol, dexpanthenol, Vitamin B5, dexrazoxane, dextran 1, dextran 40, dextran 70, dextromethorphan, dextropropoxyphene, diazepam, diazoxide, dibotermin alfa, dichiophenamide, diclofenac, diclofenacSodium, dicloxacillin, diculmarole, didanosin, dienogest, digoxine, dihydralazine, dihydroergotamine, dihydrogesteron, dihydrotachysterol, dihydroxyaluminium sodiumcarbonat, dikaliumchlorazepat, diltiazem, dimeglumingadopentetat, dimenhydinate, dimethylaminodiphenylbuten, dimeticon, dimeticon, ferrofumarate, dinitrogenoxid, dinoprost, dinoproston, diosmin, diphenhydramin, diphenolxylate, dipyradamol, diSodiumclodronate, diSodiumetidronate, diSodiumphosphate, disopyramide, disulfiram, dixyrazine, dobutamine, docetaxel, docosahexaenoinsyre (DHA), docusat, dofetilide, domperidon, donepezil, dopamine, doripenem, dornase alfa, dorzolamid, dosulepin, doxapram, doxazosin, doxepin, doxorubicin, doxorubicin hydrochloride, doxycyclin, doxycycline, droperidol, drospirenon, drotrecogin alfa (activated), duloxetine, dutasterid, ebastin, econazol, eculizumab, efalizumab, efavirenz, efavirenz/emtricitabine/tenofovir disoproxil (as fumarate), eflornithine, eicosapentaenoinsyre (EPA), ekonazol, eletriptan, emedastine, emepron, emtricitabine, emtricitabine/tenofovir disoproxil, enalapril, enfuvirtide, enoxaparin, entacapone, entecavir, ephedrine, epinephrine, epirubicin, eplerenon, epoetin alfa, epoetin beta, epoetin delta, epoetin zeta, epoprostenol, epototermin alfa, epoxyresin, eprosartan, eptacog alfa (activated), eptifibatid, eptifibatide, eptotermin alfa, erdostein, ergocalciferol, vitamin D2, ergotamine, erlotinib, erlotinib, ertapenem, erythromycin, escitalopram, eslicarbazepin, eslicarbazepine acetate, esmolol, esomeprazol, estradiol, estradiolvalerat, estradiolvalerianate, estramustin, estramustinphosphat, estriol, etambutol, etanercept, etanercept, ethacrynacide, ethambutol, ethinylestradiol, ethosuximide, ethylendiamin, ethylmorphine, etidronat, etilephrine, etodolac, etonogestrel, etoposide, etoricoxib, etravirin, etravirine, etulos, eugenol, everolimus, exemestan, exenatid, exenatide, ezetimibe, eziocillin, factor IX, factor VIII, famciclovir, febuxostat, felodipin, felypressin, fenoterol, fentanyl, fentanyl citrate, ferri-salts, ferritetrasemisodium, ferrosalts, ferrosuccinate, ferumoxsil, fesoterodine, fexofenadin, fibrinogen, fibronektin, filgrastim, finasterid, fiskeolie, flavoxat, flecainide, flucloxacillin, fluconazol, flucytosin, fludarabinphosphat, fludrocortison, fludrocortisonacetat, flumazenil, flumedroxon, flumetasonpivalat, flunarizin, flunitrazepam, fluocinolonacetonid, fluocinonid, fluocortolon 21-pivalat, fluorid, fluormetolon, fluoruracil, fluoxetin, fluoximesteron, flupentizol, fluphenazindecanoat, fluphenazine, flurbiprofen, flutamid, fluticasone furoate, fluticasonpropionat, fluvastatin, fluvoxamin, folic acid, folic acid heparin, follitropin alfa, follitropin beta, follitropin-α (rfSH), follitropin-β (rfSH), fomivirsen, fondaparinux, fondaparinux sodium, formaldehyde, formoterol, fosamprenavir, fosaprepitant, fosaprepitant dimeglumine, fosinoprilSodium, fosphenytoin, framycetin, frangulabark, frovatriptan, fulvestrant, furosemide, fusidic acid, gabapentin, gadobutrol, gadodiamid, gadofosveset, gadoteridol, gadoterinsyre, gadoversetamide, galantamin, galsulfase, ganciclovir, ganirelix, gefitinib, gelatine, gemcitabin, gemeprost, gemfibrozil, gentamicin, geraniol, gestoden, glatirameracetat, glibenclamid, gliclazid, glimepirid, glipizid, glucagon, glucopyrron, glucosamin, glucose, glutamin, glutathion, glycerol, glycerophosphat, glyceryl nitrate, glycerylnitrate, glyceryltrinitrate, glycin, glycopyrron, glycyl-glutamin, glycyltyrosin, golimumab, goserelin, gramicidin, granisetron, griseofulvin, guanetidine, guanfacine, haloperidol, heparin, heparin co-factor, heparinoid, hesperidin, hexaminolevulinat, histamine, histidine, histrelin, human coagulation factor IX, human fibrinogen/human thrombin, human normal immunoglobulin, human normal immunoglobulin (IVIg), hydralazine, hydrochloride, hydrochlorthiazide, hydrocortisonacetat, hydrocortisone, hydrocortisone-17-butyrat, hydrocortisonsuccinat, hydrogenperoxid, hydromorphon, hydroxichloroquine, hydroxiprogresterone, hydroxizine, hydroxocobalamin, vitamin B12, hydroxycarbamide, hydroxychloroquin, hydroxycitronellal, hydroxyethylrutosider, hydroxyethylstivelse starch, hydroxyurea, hyoscin, hyoscinbutylbromid, hyoscyamine, hypromellose, ibandronic acid, ibandronsyre, ibritumomab tiuxetan, ibuprofen, icatibant, ichthammol, icodextrin, idarubicin, idursulfase, ifosfamid, iloprost, imatinib, imatinib mesilate, imiglucerase, imipenem, imipramin, imiquimod, immunglobulin G, humant, immunglobulin, humant (anti-D), indapamid, indinavir, indomethacine, infliximab, inositolnico-tinate, insulin, insulin aspart, insulin aspart protamin, insulin detemir, insulin glargine, insulin glulisine, insulin human (rDNA), insulin lispro, insulin lispro protamin, insulin, humant, insulin, isophan, humant, interferon alfa-2b, interferon alfacon-1, interferon beta-1a, interferon idoxuridin, interferon-alfa, interferon-alfa-2b, interferon-beta-1a, interferon-beta-1b, interferon-gamma-1b, interleukin-2, iobitridol, iodidine, iodixanol, ioflupane (123 I), iohexol, iomeprol, iopromid, iotrolan, ioversol, ipratropium, irbesartan, irbesartan/hydrochlorothiazide, irinotecan, isocarboxazid, isoeugenol, isofluran, isoleucin, isoniazid, isophaninsulin, humant, isoprenaline, isosorbiddinitrate, isosorbidmononitrate, isotretinoin, isradipin, itraconazol, ivabradine, ketobemidon, ketobemidone, ketokonazol, Ketoprofen, ketorolac, ketotifen, Kolofon, kreatinin monohydrate, kreatinin monohydrate, labetalol, lacidipin, lacosamide, lactat, lactic acid, lactic acid producing bacteria, lactulose, lamivudine, lamivudine/zidovudine, lamotrigin, lanolin, lanreotid, lansoprazol, lanthanum, lapatinib, laronidase, laropiprant, lasofoxifene, latanoprost, lecithin, leflunomide, lenalidomide, lenograstim, lepirudin, lercanidipin, letrozol, leucin, leucovorin, leuprorelin, levetiracetam, levocabastin, levocetirizin, levodopa, levofloxacin, levofolic acid, levomepromazine, levonorgestrel, levotyroxin, lidocain, lincomycin, linezolid, liotyronin, lipase, liraglutide, lisinopril, lithiumcarbonat, lithiumcitrat, lodoxamid, lofepramin, lomustine, loperamide, lopinavir, loratadin, lorazepam, lormetazepam, lornoxicam, losartan, lovastatin, lutropin alfa, lymecycline, lynestrenol, lypressin, lysine, macrogol 3350, magnesium, magnesium carbonate, magnesium chloride, magnesium hydroxide, magnesiumoxide, magnesiumsulfate, malathion, mangafodipir, mangane, mannitol, maptrotilin, maraviroc, mebendazol, mebeverin, mecasermin, mecillinam, meclozine, medroxiprogresterone, medroxyprogesteronacetate, mefloquine, mefruside, megesterol, megestrolacetat, melatonin, melfalan, meloxicam, melperon, melphalan, memantine, meningokokpolysaccharid, menotropin (hmG), mepensolar, mepivacain, meprobamat, mepyramin, mercaptamine bitartrate, mercaptobenzothiazol, mercapto-mix, mercaptopurin, meropenem, mesalazin, mesna, mesterolon, mestranol, metacycline, metaoxedrin, metenamine, metformin, meth idopa, methadone, methenamin, methionin, metholazone, methotrexat, methoxy polyethylene glycol-epoetin beta, methylaminolevulinat, methyldopa, methylergometrin, methylergotamine, methylnaltrexon, methylnaltrexone bromide, methylperon, methyiphenidat, methylprednisolon, methyiprednisolonacetat, methyiprednisolonsuccinat, methyiscopolamine, methyprylon, metixene, metoclopramide, metopimazin, metoprolol, metronidazole, metychiothiazide, mexiletin, mianserin, micafungin, miconazole, midazolam, mifamurtide, miglustat, minoxidil, mirtazapin, misoprostol, mitomycin, mitotane, mitoxantron, mivacurium, moclobemid, modafinil, molybdenum, mometasonfuroat, moroctocog alfa, morphine, moxaverine, moxifloxacin, moxonidin, mupirocin, mycophenoic acid, mycophenolate mofetil, nabumeton, nadolol, nafarelin, nalbuphin, nalidixic acid, naloxone, naltrexon, nandrolon, naphazolin, naproxen, naratriptan, natalizumab, natamycine, nateglinide, nebivolol, nelarabin, nelarabine, nelfinavir, neomycin, neomycinsulfat, neostigmin, nepafenac, nevirapine, nicheritrol, nickel, nicomorphin, nicorandil, nicotin, nicotinamid, nicotinic acid, nicotinic acid/laropiprant, nicotinyl aichol, nifedipine, nilotinib, nimodipin, niphedipin, nitisinone, nitrazepam, nitrendipin, nitric oxide, nitrofurantoin, nitrogen, nitrogen oxide, nitroprusside, nizatidin, nonacog alfa, noradrenalin, norelgestromin, norelgestromin/ethinyl estradiol, norethisteronacetat, noretisterone, norfloxacin, norgestimat, nortriptylin, noscapine, nystatin, oak moss, octocog alfa, octreotid, ofloxacin, olanzapine, olmesartan-medoxomil, olopatadine, olsalazin, omalizumab, omeprazol, ondansetron, opipramol, opium, oral Cholera vaccine, orciprenaline, orlistat, ornidazol, ornithin, orphenadrine, oseltamivir, osteogent protein-1: BMp-7, oxaliplatin, oxazepa, oxazepam, oxcarbazepin, oximetolon, oxiphencyclimine, oxitetracycline, oxprenolol, oxybutynin, oxycodon, oxygen, oxymetazolin, oxytetracyclin, oxytocin, paclitaxel, paclitaxel albumin, palifermin, palifermin, paliperidone, palivizumab, palonosetron, pamidronat, panitumumab, pantoprazole, pantotenol, vitamin B5, pantothenic acid, papaverine, paracetamol, paraffinolie, parathyroid hormone (rDNA), parecoxib, paricalcitol, paroxetin, pegaptanib, pegaptanib sodium, pegfilgrastim, peginterferon alfa-2a, peginterferon alfa-2b, pegvisomant, pegylated interferon-alfa-2a, pegylated interferon-alfa-2b, pemetrexed, penciclovir, penfluridol, penicillamine, pentaeritrityltetranitrate, pentazocine, pentobarbital, pentoxifyllin, pentoxiverine, perfiutren, pergolid, periciazin, perindopril, permethrin, perphenazindecanoat, perphenazine, pertussistoksoid, pethidin, pethidine, phenazone, phenazonsalicylat, phenemal, phenfluramin, phenobarbital, phenoperidine, phenoxymethylpenicillin, phenprocoumon, phentanyl, phentolamin, phenylamine, phenylbutazone, phenylephrin, phenylpropanolamine, phenytoine, phosphat, phosphestrol, phytomenadion, vitamin K1, phytominadion, pilocarpin, pimecrolimus, pimozid, pindolol, pioglitazone, pioglitazone/glimepiride, pioglitazone/metformin, pioglitazone/metformin hydrochloride, pipamperon, piperacillin, piritramide, piroxicam, pivampicillin, pivmecillinam, pizitifen, pizotifen, plasminogen, plerixafor, podophyllotoksin, polydocanol, polyestradiolphosphat, polygelin, polymyxin B, polythiazide, posaconazole, potassium, potassium acetate, potassium chloride, potassium dihydrogen phosphate, potassium dikromat, potassium hydroxide, potassium phosphate, p-phenylendiamin, pramipexole, prasugrel, pravastatin, prazosine, prednisolon, prednisolon sodiumphosphate, prednisone, pregabalin, prenalterol, prilocain, primidone, probanteline, probenecid, procain, procainamide, procarbazine, prochlorperazine, procylidine, proetazine, progesteron, proguanil, prolin, promethazine, propafenon, propanthelinbromid, propionmazine, propofol, proproanolol, propylthiouracil, propyphenazon, proscillaridin, protamin, protein C, protein C, human, protein S, protriptylin, proxiphylline, prucalopride, pseudoephedrine (as sulphate), p-t-butylphenol-formaldehyd-resin, pyrazinamid, pyridostigmine, pyridoxin, pyridoxin, Vitamin B6, pyrityldion, pyrvin, quetiapin, quinagolid, quinapril, quinin, quinolin-mix, rabeprazol, raffinose, raloxifene, raltegravir, ramipril, ranibizumab, ranitidine, ranolazine, rasagiline, rasburicase, reboxetin, recombinant human erythropoietin alfa, remifentanil, repaglinide, reserpine, resorcinol, retapamulin, reteplase, retinol, retinol, vitamin A, ribavirin, riboflavin, vitamin B2, rifabutin, rifampicin, riiterol, rilonacept, riluzole, rimexolon, rimonabant, risedronat, risperidon, ritonavir, rituximab, rivaroxaban, rivastigmine, rizatriptan, rocuronium, romiplostim, ropinirol, ropivacain, rosiglitazone, rosiglitazone/glimepiride, rosiglitazone/metformin, rosuvastatin, rotavirus, rotigotine, roxithromycin, rufinamide, sagradaextract, salazosulfapyridin, salazosulfapyridine, salbutamol, salicylic acid, salicylic amide, salmeterol, samarium [153sm] lexidronam pentasodium, sapropterin, saquinavir, saxagliptin, scopolamine, selegilin, selenium, selenium disulfid, sennaglycosides, serin, sertindol, sertralin, sevelamer, sevelamer (carbonate), sibutramin, sildenafil, simeticon (aktiveret dimeticon), simvastatin, sirolimus, sitagliptin, sitagliptin/metformin hydrochloride, sitagliptin phosphate monohydrate/metformin hydrochloride, sitaxentan, sitaxentan sodium, s-ketamin, sodium oxybate, sodium phenylbutyrate, sodium-chromoglicate, sodiummaurothiomalate auronofin, sodiumpicosulfat, solifenacin, sølvsulfadiazin, somatotropin, somatrem, somatropin, sorafenib, sorbitol, sotalol, spectinomycin, spiramycin, spironolactone, stanozolol, stavudine, stiripentol, streptokinase, strontium ranelate, sucralfat, sufentanil, sugammadex, sulbentin, sulesomab, sulfamethizol, sulfamethoxazol, sulfasalazin, sulfat, sulfisomidine, sulphur hexafluoride, sulpirid, sumatriptan, sunitinib, suxamethon, synstigmine, tacrolimus, tadalafil, tafluprost, tamoxiphene, tamsulosin, tasonermine, taurin, tazobactam, tegafur, teicoplanin, telbivudine, telithromycin, telmisartan, telmisartan/hydrochlorothiazide, temoporfin, temozolomide, temsirolimus, tenecteplase, teniposide, tenofovir disoproxil, tenoxicam, terazosin, terbinafin, terbutalin, teriparatide, terlipressin, terodiline, testosterone, testosteronenantat, testosteronundecanoat, tetanustoksoid, tetrabenazin, tetracosactid, tetracycline, tetryzolin, thalidomide, theophiline, theophyllin og ethylendiamin, thiamazol, thiamin, vitamin B1, thiethylperazine, thioguanine, thiomersal, thiopental, thioridazine, thiotepa, thithixen, threonin, thrombin, human, thyrotropin alfa, tiagabin, tiamazol, tiamin, tiaprofenic acid, tibolon, tigecyclin, tigecycline, timolol, tinidazole, tinzaparin, tiotropium, tipranavir, titandioxide, tizanidin, tobramycin, tocilizumab, tocofersolan, tocopherol, vitamin E, tokoferol, tolazamid, tolbutamid, tolcapone, tolfenamic acid, tolterodin, tolvaptan, topiramat, topotecan, toremifene, trabectedin, tramadol, trandolapril, tranexamic acid, trastuzumab, travoprost, travoprost, travoprost/timolol, treosulfan, treprostinil, triacelluvax, triamcinolonacetonid, triamcinolonhexacetonid, triazolam, trifluoperazine, triglycerid, trimetazidin, trimethaphan, trimethoprim, trimipramin, triptorelin, trombin, tropicamid, tropisetron, trospiumchlorid, tryptophan, tyrotropin, ulipristal, ulipristalacetat, urofollitropin (uFSH), urokinase, ustekinumab, valaciclovir, valdecoxib, valganciclovir, valin, vaiproat, valsartan, vancomycin, vardenafil, vareniclin, varenicline tartrate, vasopressin, venlafaxin, verapamil, verteporfin, vigabatrin, vildagliptin, vildagliptin metaformin hydrochloride Idagliptin, vildagliptin/metformin hydrochloride, vinbiastin, vinchristin, vindesin, vinflunine ditartrate, vinorelbin, zonisamide, zopiclon, zuclopenthixol, zuclopenthixolacetat, zuclopenthixoldecanoat, zuclopentizol, α1-proteinaseinhibitor (human), α-amylcinnamaldehyd and combinations thereof.

Pharmaceutical composition may be prescription or non-prescription substances such as vaccines. Non-limiting exemplary vaccines can be characterised viable autologous cartilage cells expanded ex vivo expressing specific marker proteins, combined diptheria, tetanus, acellular pertussis and hepatitis B recombinant vaccine, combined hepatitis A and hepatitis B vaccine, diphtheria, tetanus, pertussis, hepatitis B, Haemophilus influenzae type b conjugate vaccine, Diphtheria, tetanus, whole cell pertussis and hepatitis B vaccine, diptheria, tetanus, acellular pertussis, hepatitis B recombinant (adsorbed), inactivated poliomyelitis and absorbed conjugate haemophilus influenzae type b vaccine, diptheria, tetanus, acellular pertussis, hepatitis B recombinant (adsorbed), inactivated poliomyelitis vaccine, haemophilus b conjugate (Meningoccocal Protein conjugate) and hepatitis B (recombinant) vaccine, hepatitis A (inactivated), hepatitis B(rDNA)(HAB) antigen vaccine (adsorbed), hepatitis B (rDNA) vaccine (adjuvanted, adsorbed), hepatitis B (Recombinant) Vaccine, human papillomavirus vaccine, human papillomavirus vaccine [types 6, 11, 16, 18] (recombinant, adsorbed), human rotavirus, live attenuated, Inactivated Hepatitis A virus HBsAg recombinant purified, influenza vaccine (split virion, inactivated), Influenza vaccine (surface antigen, inactivated, prepared in cell culture), Japanese Encephalitis Vaccine (inactivated, adsorbed), measles, mumps and rubella vaccine (live), measles, mumps, rubella and varicella vaccine (live), Pandemic influenza vaccine, Pandemic influenza vaccine (H1N1) (split virion, inactivated, adjuvanted); A/California/7/2009 (H1N1)v like strain (X-179A), Pandemic influenza vaccine (surface antigen, inactivated, adjuvanted); A/California/7/2009 (H1N1)v like strain (X-179A), pandemic influenza vaccine (whole virion, vero cell derived, inactivated) pneumococcal polysaccharide conjugate vaccine (adsorbed), pneumococcal saccharide conjugated vaccine, absorbed, prepandemic influenza vaccine (H5N1) (split virion, inactivated, adjuvanted) A/Vietnam/1194/2004 NIBRG-14, rotavirus vaccine, shingles (herpes zoster) vaccine (live) and combinations thereof.

Non-prescription substances can be a vitamin or derivative thereof, or a mineral compound or derivative thereof. The vitamin or mineral compound may be thiamine, thiamine pyrophosphate, riboflavin, flavine mononucleoride, flavine adenine dinucleotide, niacin, nicotinic acid, nicotinamide, niacinamide, nicotinamide adenine dinucleotide, tryptophan, biotin, folic acid, pantothenic acid, ascorbic acid, retinol, retinal, retinoic acid, beta-carotene, 1,25-dihydroxycholecalciferol, 7-dehydrocholesterol, alpha-tocopherol, tocopherol, tocotrienol, menadione, menaquinone, phylloquinone, naphthoquinone, calcium, calcium carbonate, calcium sulfate, calcium oxide, calcium hydroxide, calcium apatite, calcium citrate-malate, calcium gluconate, calcium lactate, calcium phosphate, calcium levulinate, phosphorus, potassium, sulfur, sodium, docusate sodium, chloride, magnesium, magnesium stearate, magnesium carbonate, magnesium oxide, magnesium hydroxide, magnesium sulfate, copper, iodine, zinc, chromium, molybdenum, carbonyl iron, ferrous fumarate, polysaccharide iron, and combinations and derivatives thereof, without limitation. Derivatives of vitamin compounds include salts, alkaline salts, esters and chelates of any vitamin compound, without limitation. The non-prescription substances can also be a herbal compound, herbal extract, derivative thereof or combinations thereof, without limitation.

Pharmaceutical composition herein referred may take any form, and combinations thereof. Examples of such forms include, without limitation, chewable tablet, quick dissolve tablet, effervescent tablet, reconstitute powder, elixir, liquid, solution, suspension, emulsion, tablet, multi-layer tablet, bi-layer tablet, capsule, soft gelatine capsule, hard gelatine capsule, caplet, lozenge, chewable lozenge, bead, powder, granules, dispersible granules, cachets, douche, suppository, cream, topical, inhalant, aerosol inhalant, patch, particle inhalant, implant, depot implant, dragee, ampoule, ingestible, injectable, infusion, health bar, liquid, food, nutritive food, functional food, yogurt, gelatine, cereal, cereal coating, animal feed or combinations thereof. The preparation of any of the above forms may be performed by techniques and methods well known and readily available to persons of ordinary skill in the art.

The first and other aspects of the present invention may each be combined with any of the other aspects. These and other aspects of the invention will be apparent from and elucidated with reference to the embodiments described hereinafter.

In the following, a number of preferred and/or optional features, elements, examples and implementations will be summarized. Features or elements described in relation to one embodiment or aspect may be combined with or applied to the other embodiments or aspects where applicable. As an example, a feature or element described in relation to the opening system may be implemented as a step in the method where appropriate. Also, explanations of underlying mechanisms of the invention as realized by the inventors are presented for explanatory purposes, and should not be used in ex post facto analysis for deducing the invention.

BRIEF DESCRIPTION OF THE FIGURES

The single use medical package according to the invention will now be described in more detail with regard to the accompanying figures. The figures show one way of implementing the present invention and is not to be construed as being limiting to other possible embodiments falling within the scope of the attached claim set.

FIGS. 32, 32*a* and 32*b* show schematically 3-dimensional views of carrier sections in their unfolded and folded state having members located on the side walls of the cavities according to one embodiment of the invention.

DETAILED DESCRIPTION OF EMBODIMENTS OF THE INVENTION

Figure 1:
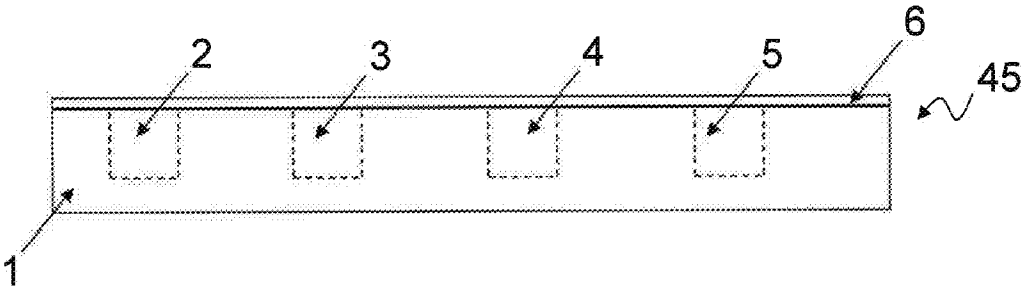
FIG. 1 shows a side view of a disposable package according to one embodiment of the invention.

FIG. 1 shows a side view of a disposable package 45 according to one embodiment of the invention. The package is shown containing a number of four cavities in its carrier. This is simply for descriptive reasons and should not be considered as a limitation to the scope of protection. Any commercially practicable number of cavities may be produced into a single carrier.

The package is characterized by a carrier 1 on which at least two cavities 2-5 extending from the plane of the carrier 1 are present to house pharmaceutical compositions in different forms, e.g. capsules, tablets or pills.

The package 45 also includes at least one cover sheet 6 at least partially sealed to the carrier 1 and around the cavities 2-5, protecting the pharmaceutical compositions contained in the cavities and allowing upon its removal the access to the cavities 2-5 housing the pharmaceutical compositions.

Figure 7:
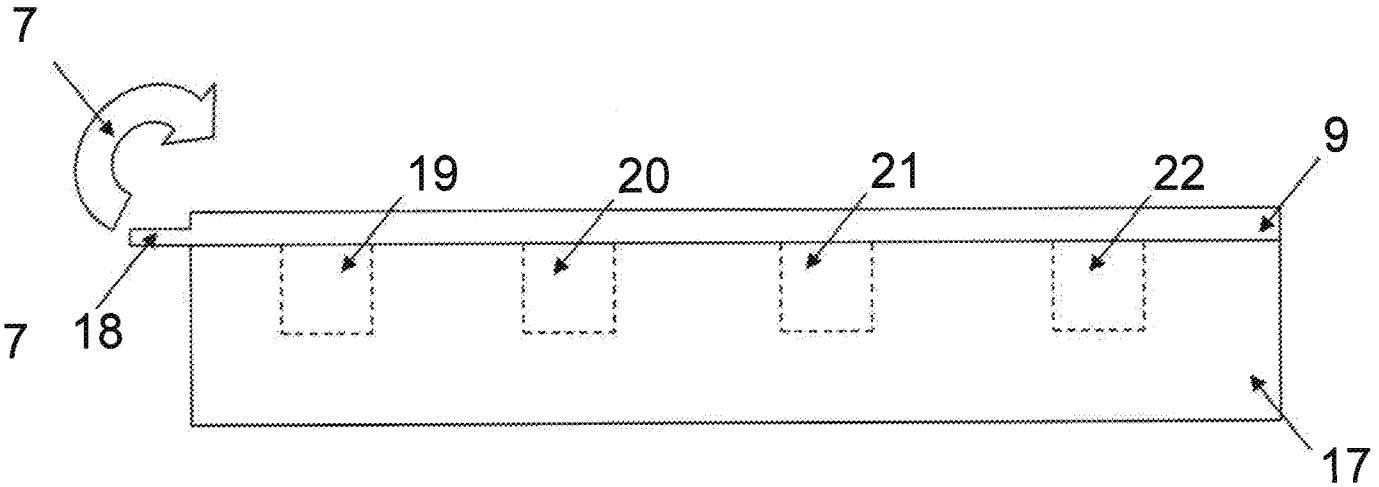
FIGS. 7 and 8 show different way to gain access to the cover sheet for its removal.
Figure 8:
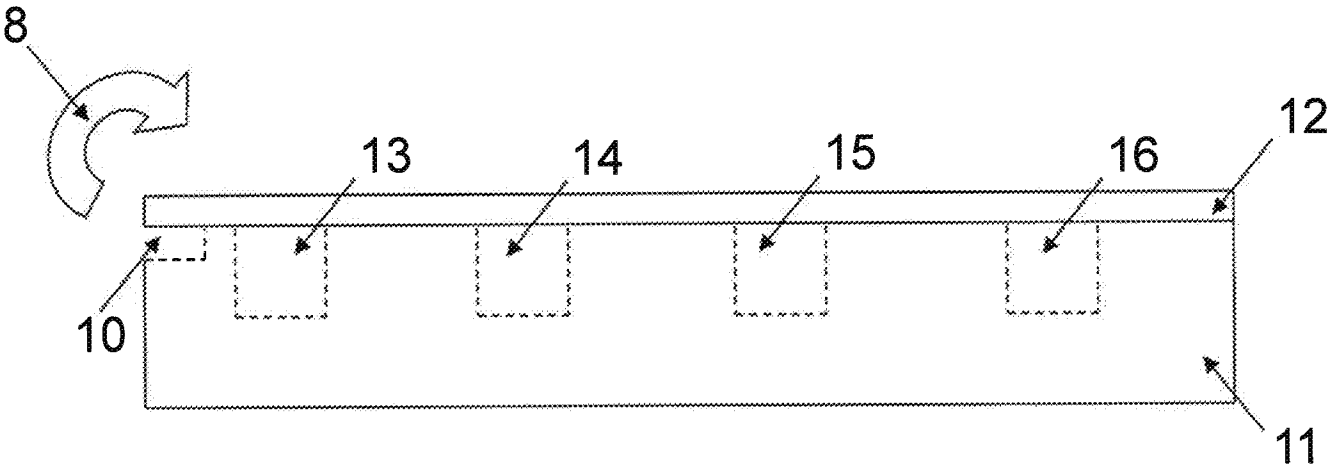

The access to the cavities 2-5 is gained by removal of the cover sheet which may be peeled off as shown by arrows 7 and 8 in FIGS. 7 and 8.

FIG. 8 shows a package according to an embodiment of the invention where a recess 10 is present on the carrier 11. This allows for an easy patient grip of the cover sheet 12. The access to cavities 13-16 is gained by gripping the cover sheet 12 through the access provided by recess 10 on the carrier 11 and by peeling or tearing off the cover sheet 12 following arrow 8, i.e. cover sheet 12 is pulled upwards and back following arrow 8.

While shown as an indentation into the carrier 11, recess area 10 may have different shape and form and be located in different areas of the carrier 11.

In another embodiment one or more recesses may be not present so that gripping of cover sheets may be made feasible by leaving a small portion of the cover sheet unsealed around part of the edges of the carrier or of the cavities.

FIG. 7 shows a package according to another embodiment of the invention where the cover sheet 9 has tab 18 which extends over the edge of the carrier 17. This allows for patient grip without the need of a recess area. The access to the cavities 19-22 is gained by gripping the tab 18 of the cover sheet 9 and by peeling or tearing tab 18 off so that the cover sheet 9 is pulled upwards and back following arrow 7.

In another embodiment, the patient grip of the cover sheet of the package may be achieved by using a cover sheet which does not extend beyond the carrier edge and by leaving part of the cover sheet partially unsealed along the carrier edge.

Figure 8A:
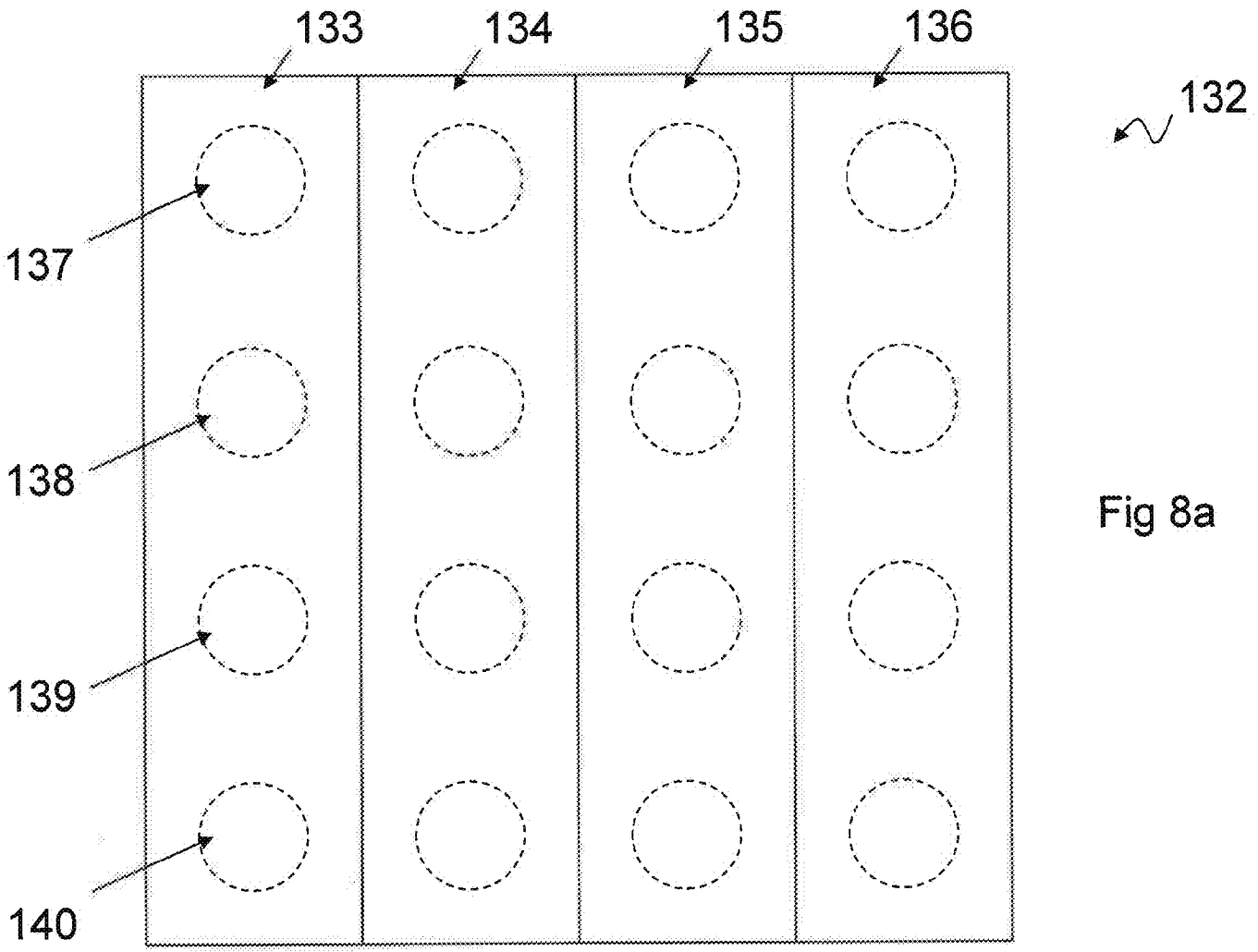
FIG. 8*a* shows a further embodiment of the invention where the blister package comprises four cover sheets.

In some embodiments the access to the multiple cavities may be provided by removal of a single cover sheet. FIG. 8*a* shows a further embodiment of the invention where the blister package 132 comprises four cover sheets 133-136, each providing multiple access to four cavities. For example removal of cover sheet 133, by gripping and pulling cover sheet 133 upwards and, back, provides access simultaneously to the cavities 132-140. In this way multiple dispensing of the pharmaceutical composition present in the cavities is achieved and by removal of a single cover sheet, several depressions are accessible. Access to cover sheets 133-136 may be possible by the presence of a recess on the carrier or by presence of a tab on the cover sheets or by leaving a small portion of the cover sheet unsealed around part of the edges of the carrier.

An advantage of these embodiments is that separated pharmaceutical compositions which may have interactions so that they need to be stored separately may be accessed through a single opening action, e.g. the removal of a single cover sheet provides access to multiple separated cavities.

In another embodiment the access to the cavities of the carrier may follow a specific sequence of opening. For example FIG. 9 shows an embodiment of the invention where the cover sheet is formed by several overlapping cover sheets.

Figure 9:
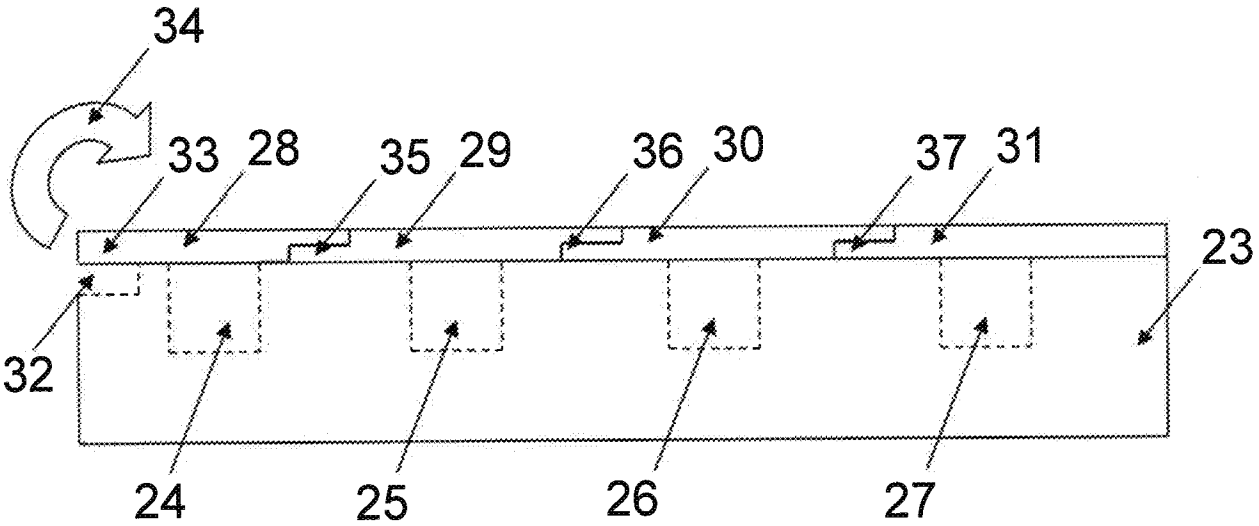
FIG. 9 shows an embodiment of the invention where the cover sheet is formed by several overlapping cover sheets.

FIG. 9 shows a disposable package which is characterized by a carrier 23 on which at least two cavities 24-27 are present to house pharmaceutical compositions in different forms, e.g. capsules, tablets or pills. The package also includes a number of cover sheets 28-31 at least partially sealed to the carrier 23 and around the respective cavities 24-27, with the function of regulating access to the cavities 24-27 housing pharmaceutical compositions.

The cover sheets 28-31 are characterized in that the previous sheet partially overlap the following one so as to provide a predetermined and sequential access to the cavities 24-27 and therefore to the pharmaceutical compositions therein contained.

In some other embodiments (not shown) the previous cover sheets completely overlap the following ones.

Figure 9A:
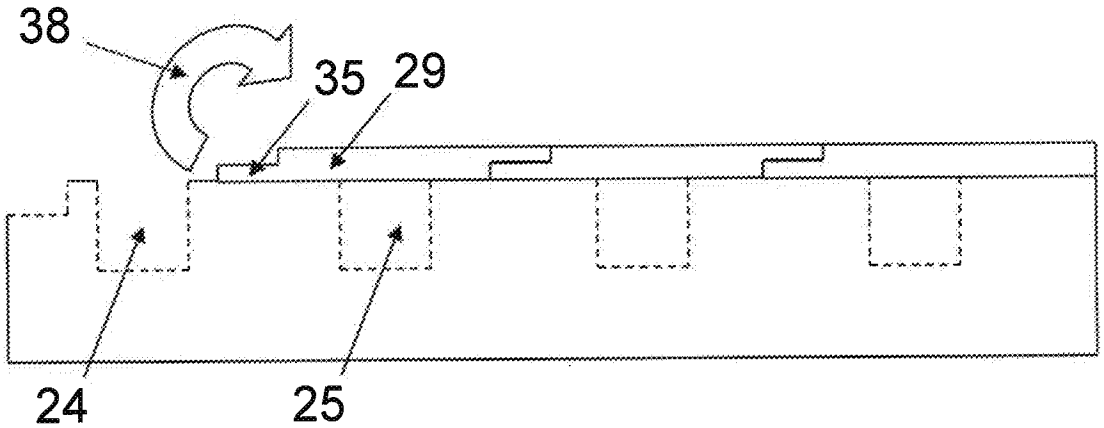
FIG. 9*a* shows the sequence of opening the embodiment of the invention in FIG. 9.

The carrier 23 may also have one or more recess, (here only one recess is shown, recess 32) being adjacent to each respective cavities. In FIG. 9 the first recess 32 is shown as a stepped recess with the function of leaving a small portion of the edge of the cover sheet 28 unsealed. Thus a tab 33 is created. By gripping the tab 33 of the cover sheet 28 and by peeling or tearing tab 33 off, the cover sheet 28 is pulled upwards and back following arrow 34 and therefore removed providing access to the first cavity 24 containing a pharmaceutical composition. Upon removal of the cover sheet 28, as shown in FIG. 9*a*, cavity 24 is open and access to the tab 35, i.e. the overlapping area between cover sheets 28 and 29, for removing cover sheet 29, is obtained. A second recess (not shown) may be present to allow for gripping of tab 35 so that by peeling or tearing tab 35 off, the cover sheet 29 is pulled upwards and back following arrow 38 and cover sheet 29 is removed providing access to cavity 25 and so on. In another embodiment, one or more recesses may be non-present so that gripping of cover sheets may be made feasible by leaving a small portion of the cover sheet unsealed around part of the edges of the respective depressions. The small portion may generally correspond to the overlapping area between the cover sheets or to the tab present in the previous cited embodiment.

Figure 2:
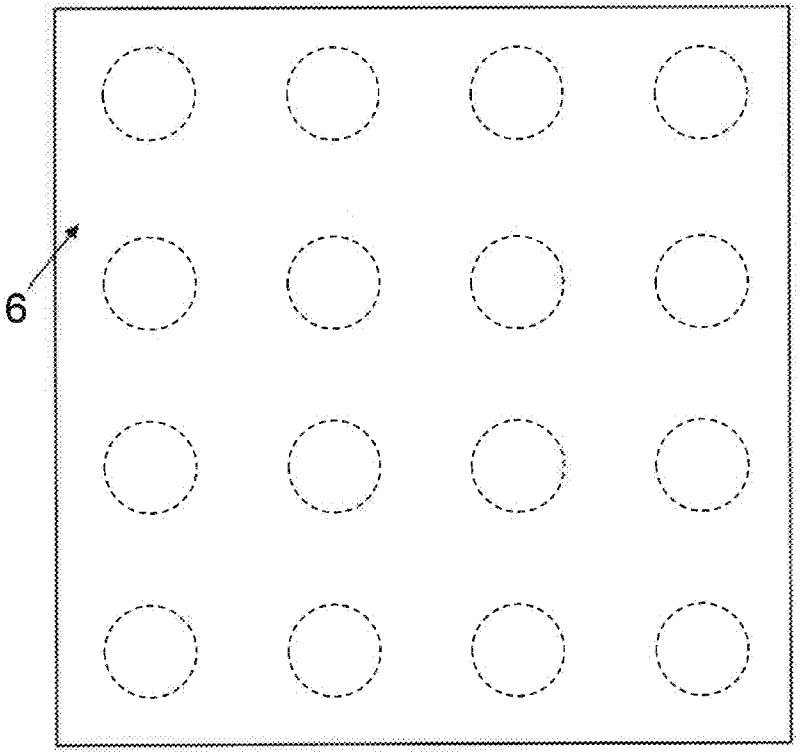
FIG. 2 shows a top view of a disposable package for medical use according to one embodiment of the invention.

FIG. 2 shows a top view of the disposable package shown in FIG. 1.

Figure 10:
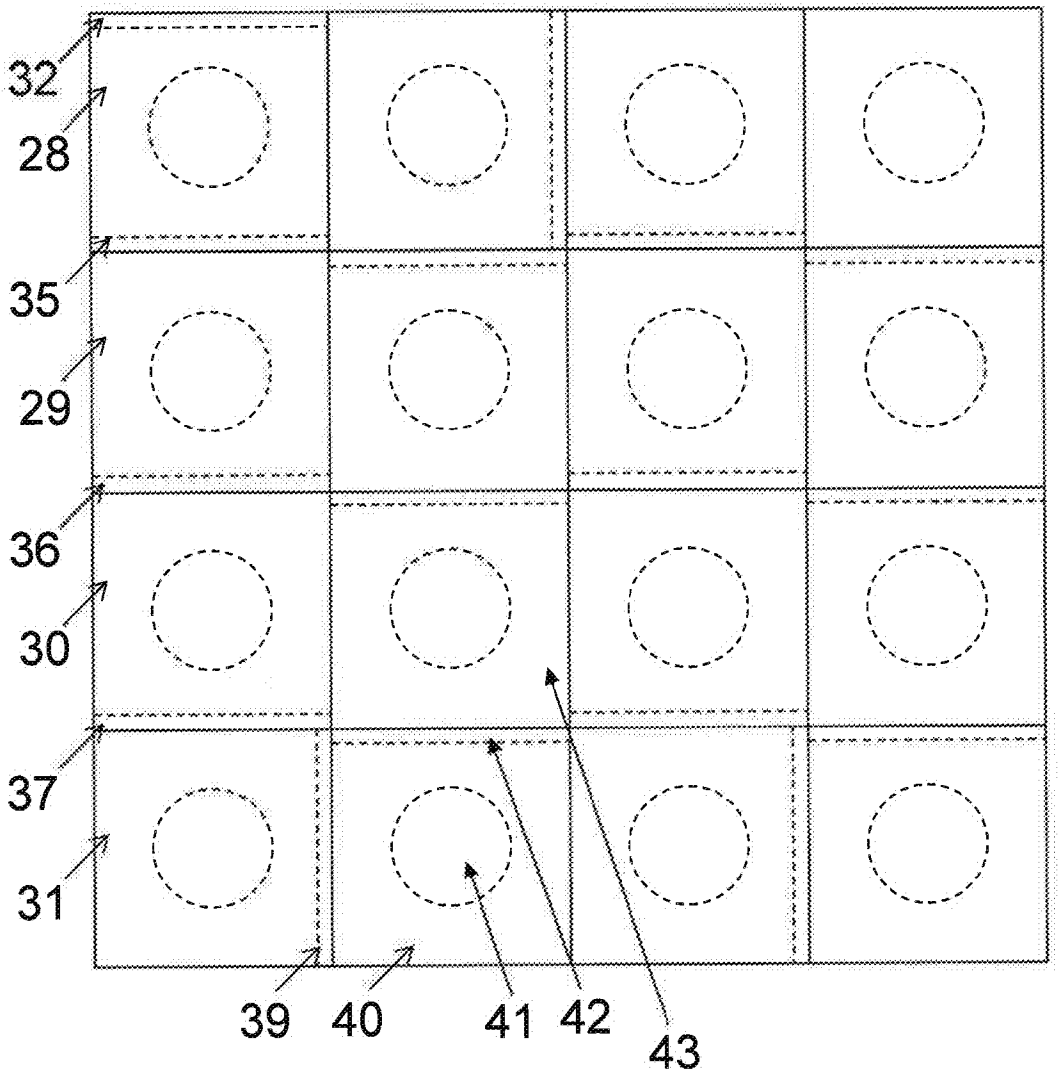
FIG. 10 shows a top view of a blister package according to one embodiment of the invention where the cover sheet is formed by several overlapping cover sheets.
Figure 10A:
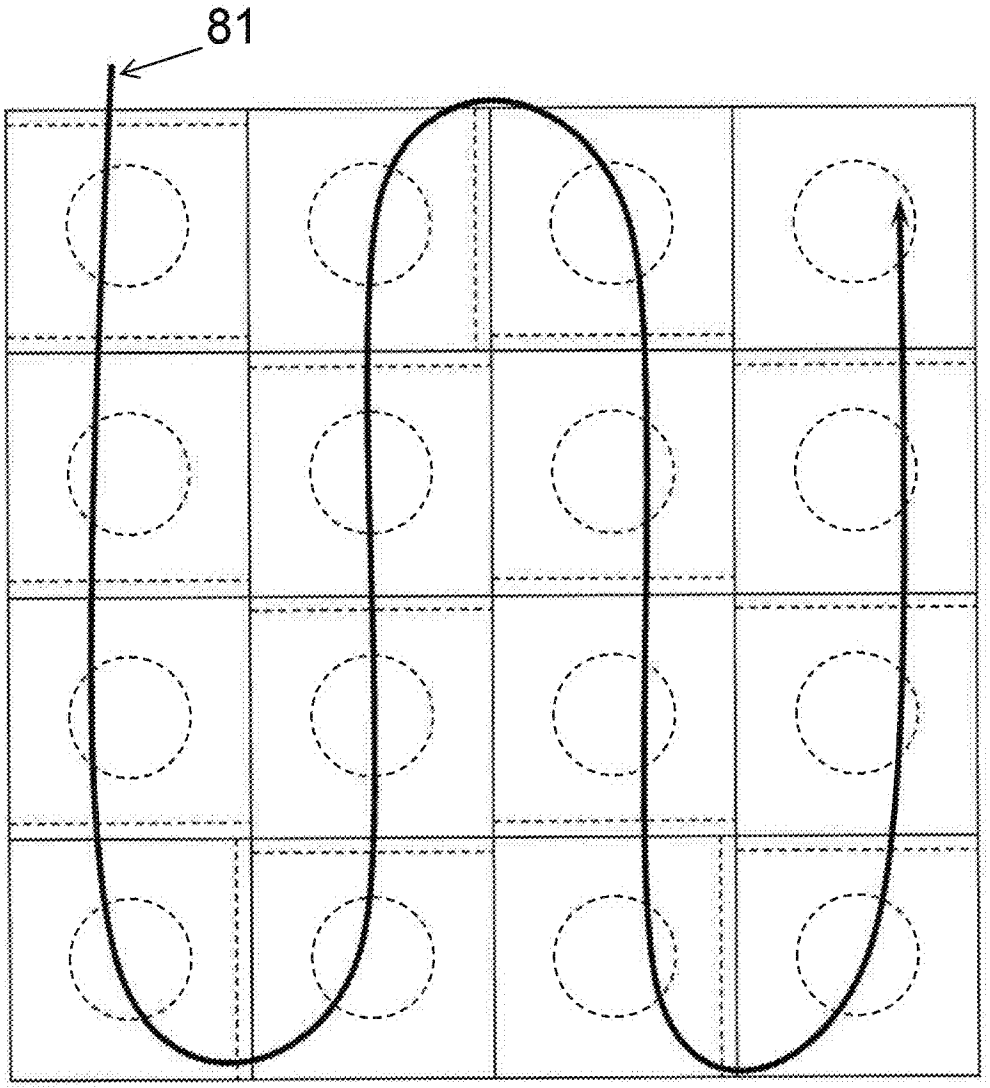
FIG. 10*a* shows the sequence of opening the embodiment of the invention in FIG. 10.

While in this embodiment 16 cavities are shown, this is simply for descriptive reasons and should not be considered as a limitation to the scope of protection. Any commercially practicable number of cavities may be produced into a single disposable package. The access to the different cavities is gained by removal of the cover sheet following the description of FIG. 7, 8 or 9. In particular when the cover sheet is a series of overlapping sheets as described by FIG. 9, the opening may follow a sequence that can be predetermined by providing a specific overlapping of the cover sheets. As shown by FIGS. 9 and 9*a*, the overlapping areas 35-37 between the cover sheets 28-31 determine the sequence of access. FIG. 10 also shows cover sheet 40 and tab 39. Cover sheet 31 hinders access to tab 39, so that to the removal of cover sheet 31 follows the removal of cover sheet 40 allowing access to depression 41. Accordingly, cover sheet 43 can be removed by peeling or tearing off tab 42, which can be accessed only following removal of cover sheet 40. In FIG. 10*a* the sequence of access to the several depressions, following arrow 81 is obtained by using an overlapping between cover sheets and tabs as shown in FIG. 10.

Several opening directions may be obtained by predetermined overlapping sequences, e.g. round, zig-zag, up-down, left-right or by using multiple starting points.

Figure 2A:
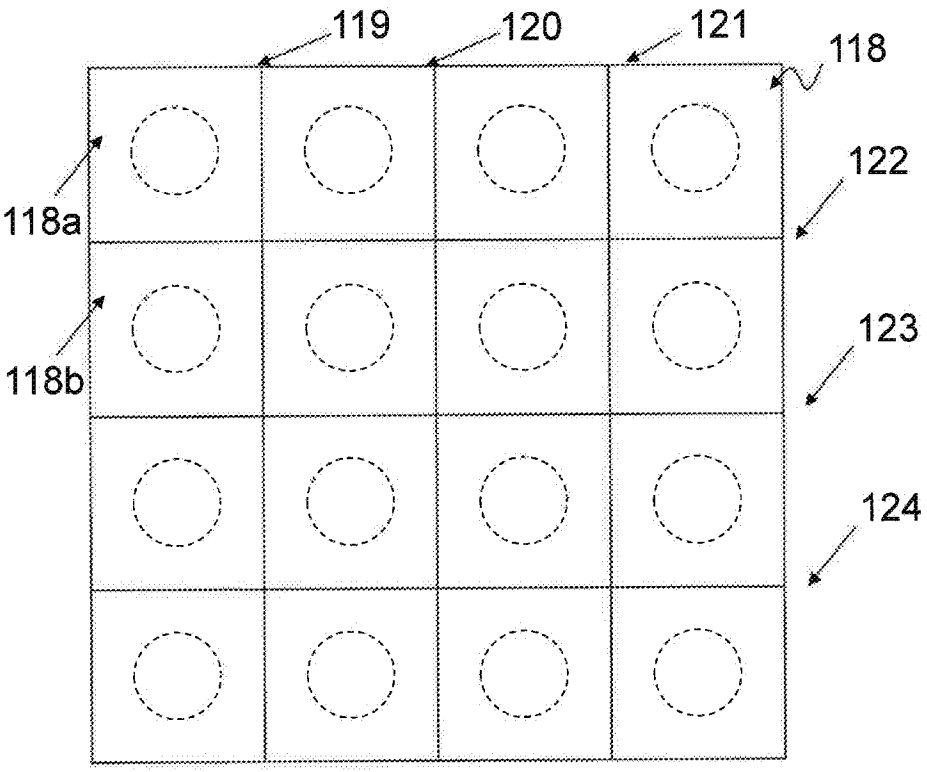
FIG. 2*a* shows a top view of a disposable package for medical use according to one embodiment of the invention where the cover sheet is perforated along specific lines.
Figure 1A:
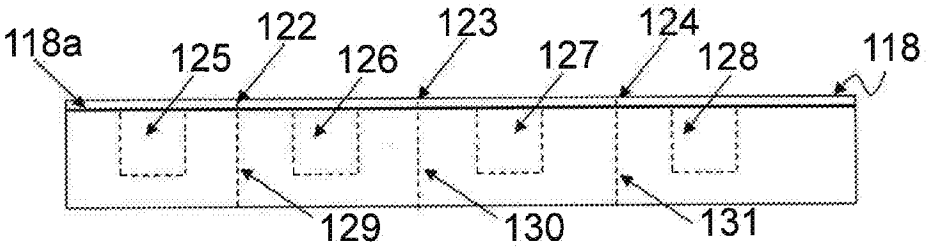
FIG. 1*a* shows a side view of a disposable package for medical use according to one embodiment of the invention where the cover sheet is perforated along specific lines.

FIG. 2*a* shows a top view of the disposable package shown in FIG. 1*a* where the access to the different cavities is gained by removal of cover sheet 118 which is perforated along some specific lines 119-124 so as to provide only access to a single cavity and to the pharmaceutical composition contained herein at a time. In some other embodiments the perforation of the cover sheet 118 may be carried out also through the whole carrier thickness, therefore identifying discrete sections, e.g. 118*a* and 118*b*, which are fully detachable from the package and contain a single pharmaceutical composition.

FIG. 1*a* shows a side view of the disposable package for medical use shown in FIG. 2*a*. Cover sheet 118 is perforated along the lines 122-124 so as to provide access to cavities 125-128. Access to cavity 125 is gained by removal of part of the cover sheet 118, i.e. 118*a*. In some embodiments the perforation is carried out through the carrier as shown by lines 129-131.

Figure 3:
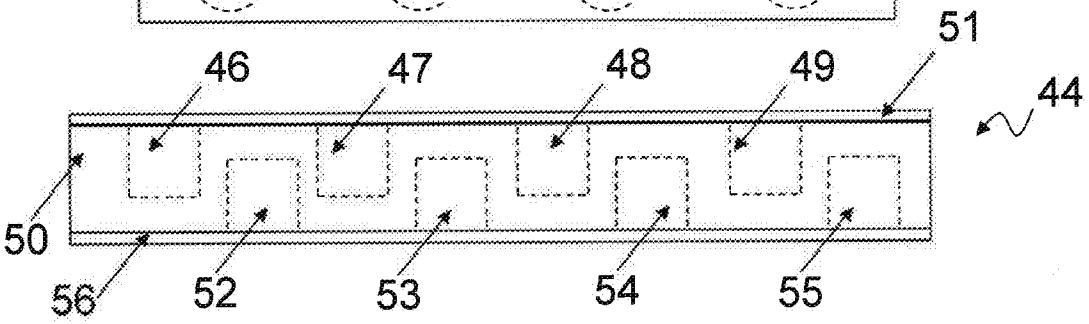
FIG. 3 shows a side view of a disposable package for medical use according to the embodiment of the invention where cavities are present onto top and bottom surface of the carrier.

FIG. 3 shows a side view of a disposable package for medical use according to the embodiment of the invention where cavities are present on top and bottom surfaces of the carrier. The disposable package 44 has cavities 46-49 on the top surface of carrier 50. These cavities are accessible by removal of cover sheet 51. On the bottom surface of carrier 50 cavities 52-55 are located off-set with respect to cavities 46-49 in an intermeshing fashion. Cavities 52-55 are accessible by removal of cover sheet 56. In this way twice the amount of pharmaceutical compositions, such as pills, tablets or capsules, may be transported in a package having the same dimensions and occupied space as the one shown by FIGS. 1 and 2.

In some other embodiments the carrier 50 is characterized in that the rigid structure is a hollow rigid structure, i.e. no material is present between the cavities of the carrier. The carrier in these embodiments comprises a rigid and thin structure of plastic material, which may be closed at the sides.

Figure 3A:
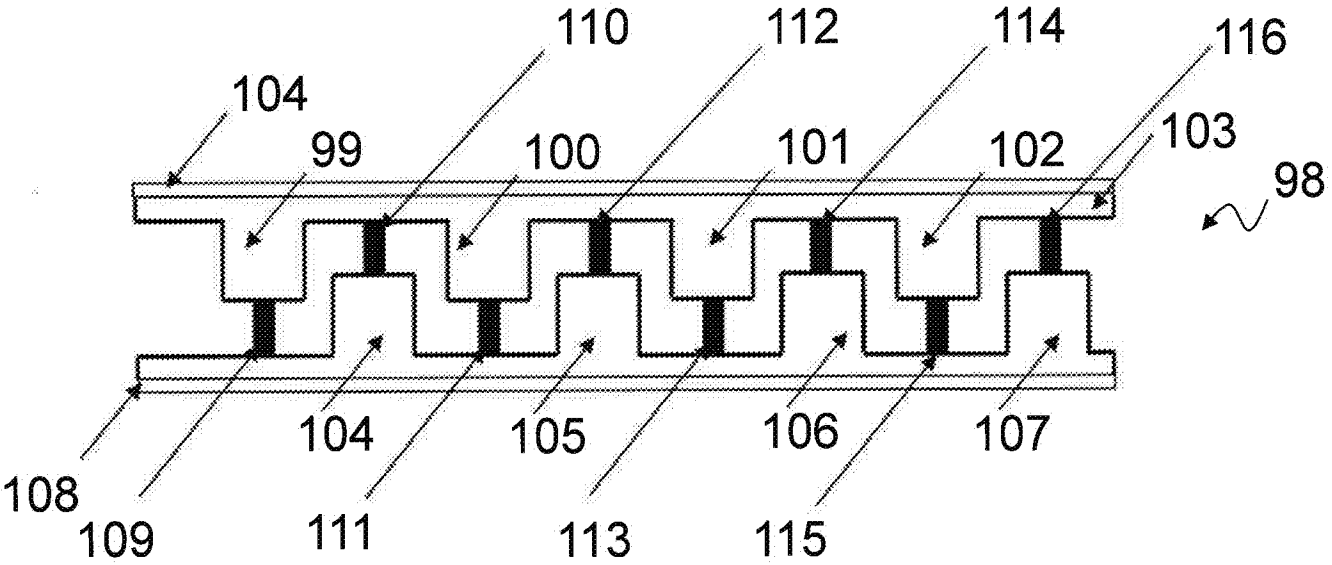
FIG. 3*a* shows a top view of a disposable package for medical use according to the embodiments of the invention where the rigid structure is a hollow structure.
Figure 3B:
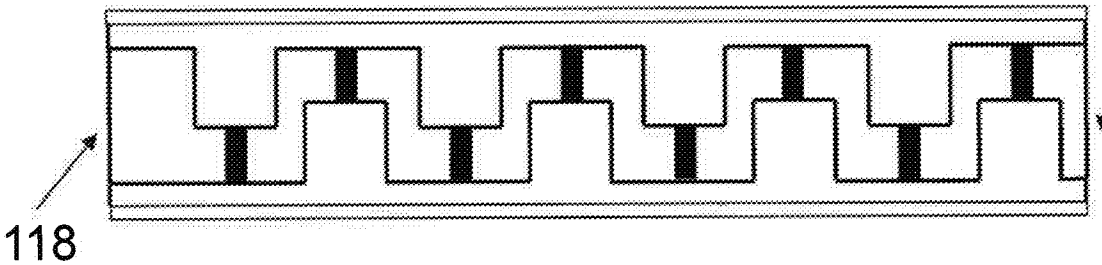
FIG. 3*b* shows a top view of a disposable package for medical use according to the embodiments of the invention where the rigid structure is a hollow structure and two side walls of the structure are present.

FIG. 3*a* shows a sectional view of a disposable package for medical use according to the embodiments of the invention where the rigid structure is a hollow structure.

The disposable package 98 has cavities 99-102 on the top surface of carrier 103. These cavities are accessible by removal of cover sheet 104. On the bottom surface of carrier 103 cavities 104-107 are located off-set with respect to cavities 99-102 in an intermeshing fashion. Cavities 104-107 are accessible by removal of cover sheet 108. The area between the top on bottom surface of the carrier 103 is hollow, e.g. empty and may be filled with air or gases. Supporting elements, e.g. 109-116, may be present to provide rigidity to the structure. These elements may be supporting walls or columns. These elements may be made of the same or different material than the carrier. The advantage of this structure is the light weight and the minimized use of material for its production. In some other embodiments the rigid structure may have at least one side wall connecting the top and the bottom surface of the carrier. FIG. 3 *b* shows the same embodiment of FIG. 3*a* where two side walls 117 and 118 of the structure are present. In other embodiments the opening systems disclosed in FIG. 1*a*, 7, 8, 9, 9*a*, 10 or 10*a* may be applied used on the disposable package described by this embodiment.

Figure 4:
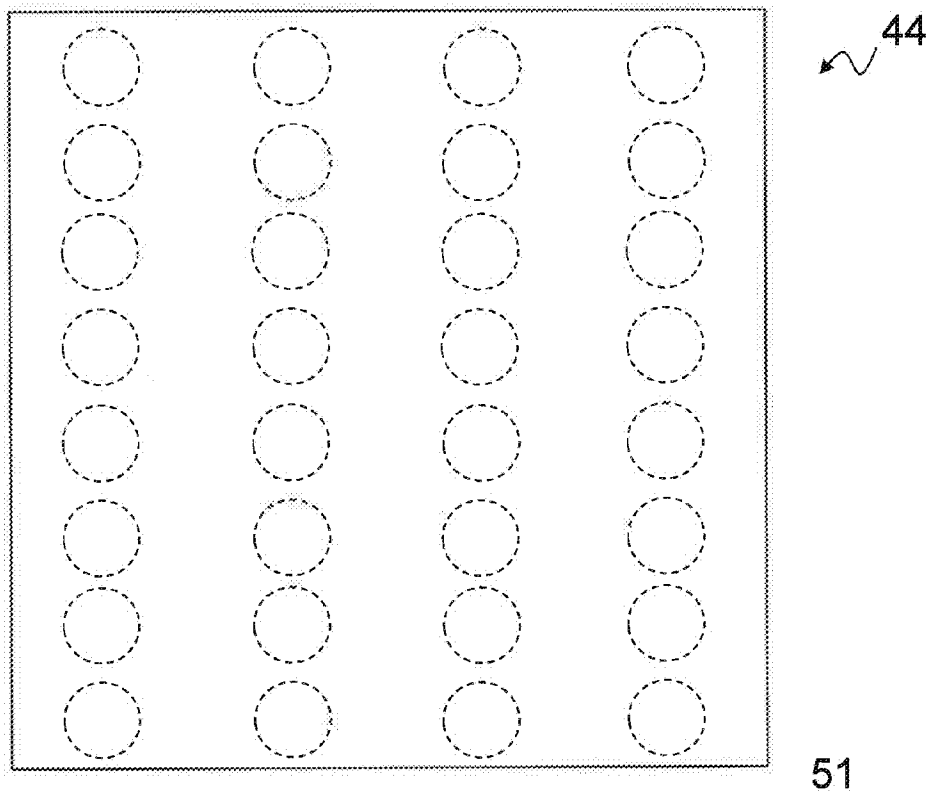
FIG. 4 shows a top view of a disposable package for medical use according to the embodiments of the invention where cavities are present on top and bottom surfaces of the carrier.

FIG. 4 shows a top view of the disposable package shown in FIG. 3. For comparative reasons it is shown that 32 cavities are possible in this configuration for a carrier having the same dimension of the carrier shown in FIG. 2. While in this embodiment 32 cavities are shown, this is simply for descriptive reasons and should not be considered as a limitation to the scope of protection.

Figure 4A:
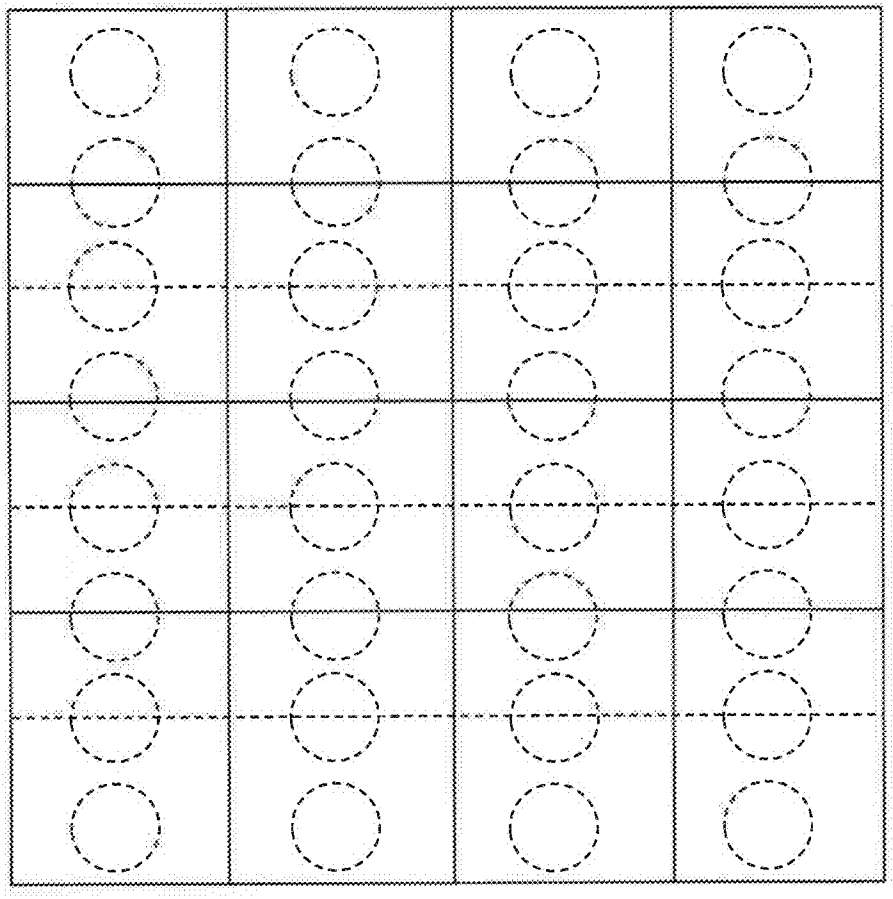
FIG. 4*a* shows a top view of a disposable package for medical use according to the embodiments of the invention where cavities are present on top and bottom surfaces of the carrier, where the cover sheet is perforated along specific lines.

FIG. 4*a* shows a top view of the disposable package shown in FIG. 3 where the cover sheet is perforated along specific lines so as to provide access only to a single cavity and to the pharmaceutical composition contained herein at a time in analogy of the embodiment shown in FIG. 2*a*.

Figure 11A:
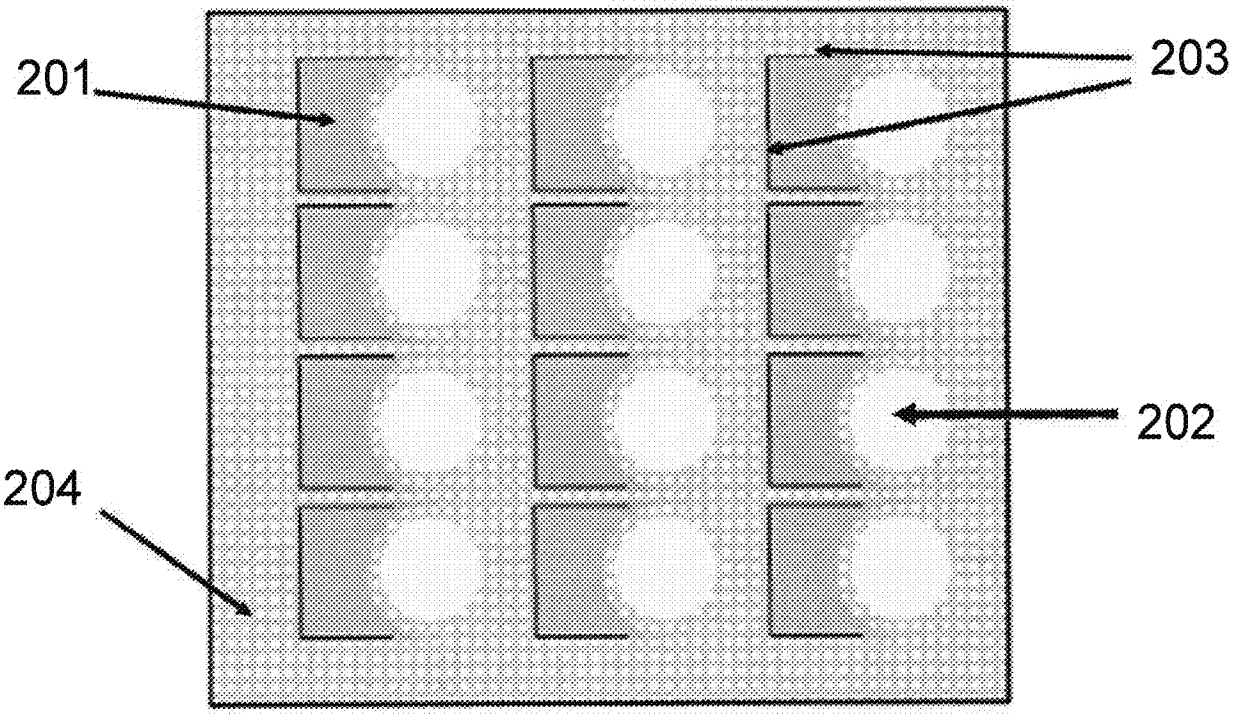
FIG. 11*a* shows schematically a top view of an embodiment of the invention.
Figure 11B:
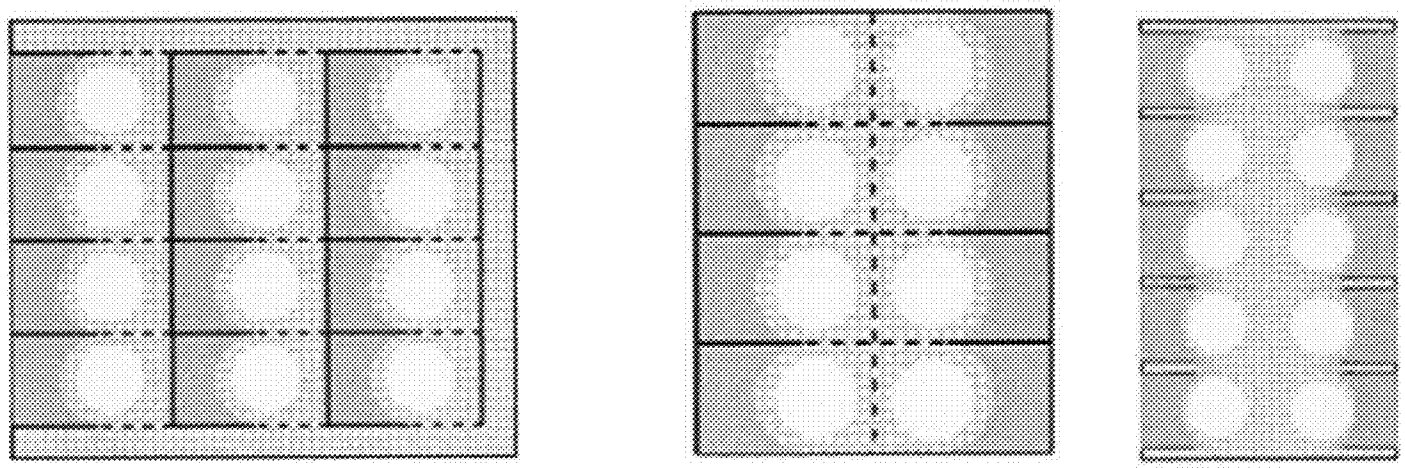
FIG. 11*b* shows different embodiments having different arrangements of the flaps and cavities.

FIG. 11*a* shows schematically a top view of an embodiment of the invention where a flap 201 is provided next to each cavity 202. The flaps 201 are obtained by leaving the areas underneath each flap 201 unsealed during manufacturing when the cover sheet is fastened to the carrier. In a, preferably subsequent, process step, the edges 203 of the flaps 201 are separated from the sealed part 204 of the cover sheet, typically by punching. The punching can be either through the cover sheet only, or fully or partly through the carrier as well. An advantage of punching through the cover sheet only is that the carrier is left intact and thereby stiffer and less prone to failure. An advantage of allowing the punching to go fully or partly through the carrier is that the tolerances on the punching tools and the punching action can be less strict. FIG. 11*b* shows different embodiments having different arrangements of the flaps and cavities.

Figure 12B:
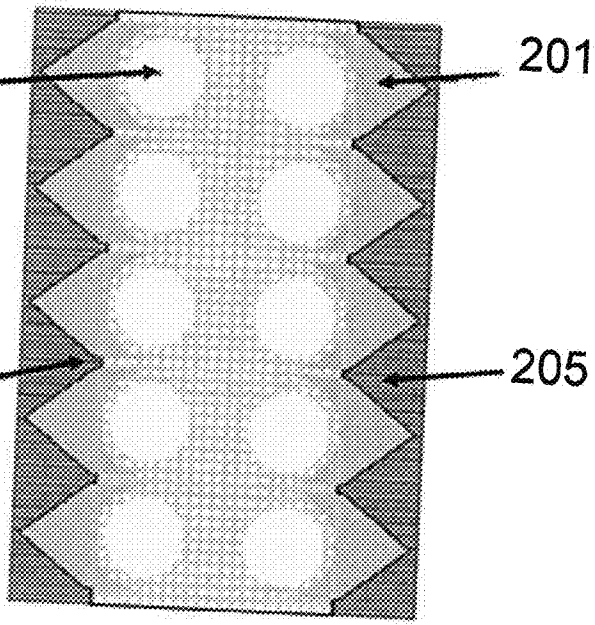
FIGS. 12*a* and 12*b* show schematically a top view of an embodiment of the invention where a part of the cover sheet is removed during or after the punching process.
Figure 12A:
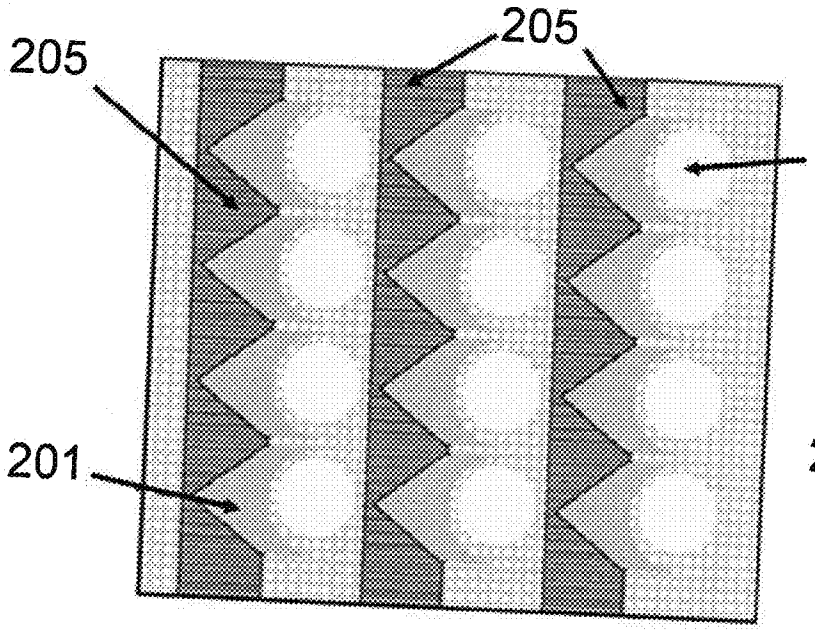

In an alternative embodiment to the one shown in FIGS. 11*a* and 11*b*, selected parts of the cover sheet are removed during or after the punching process. An example of such an embodiment is shown schematically in FIGS. 12*a* and 12*b*. The part of the cover sheet being removed is marked as 205 in the figures. This process may result in the flaps 201 being easier to grip. As shown in FIG. 12*b*, the cover sheet may project over the edges of the carrier e.g. by an amount corresponding to the size of the flaps 201 and the parts 205 of the cover sheet being removed. Hereby the flaps 201 may be even easier to grip than when they overlap the carrier.

Figure 13B:
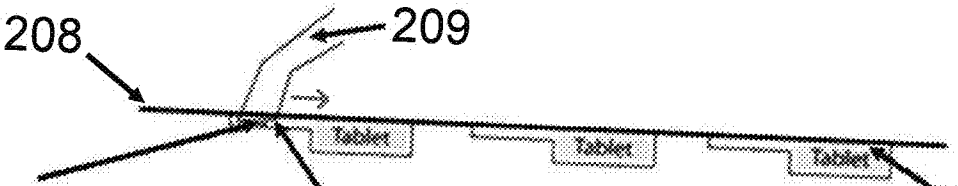
FIG. 13*b* shows a cross section of the embodiment of the invention in FIG. 13*a*.
Figure 13A:
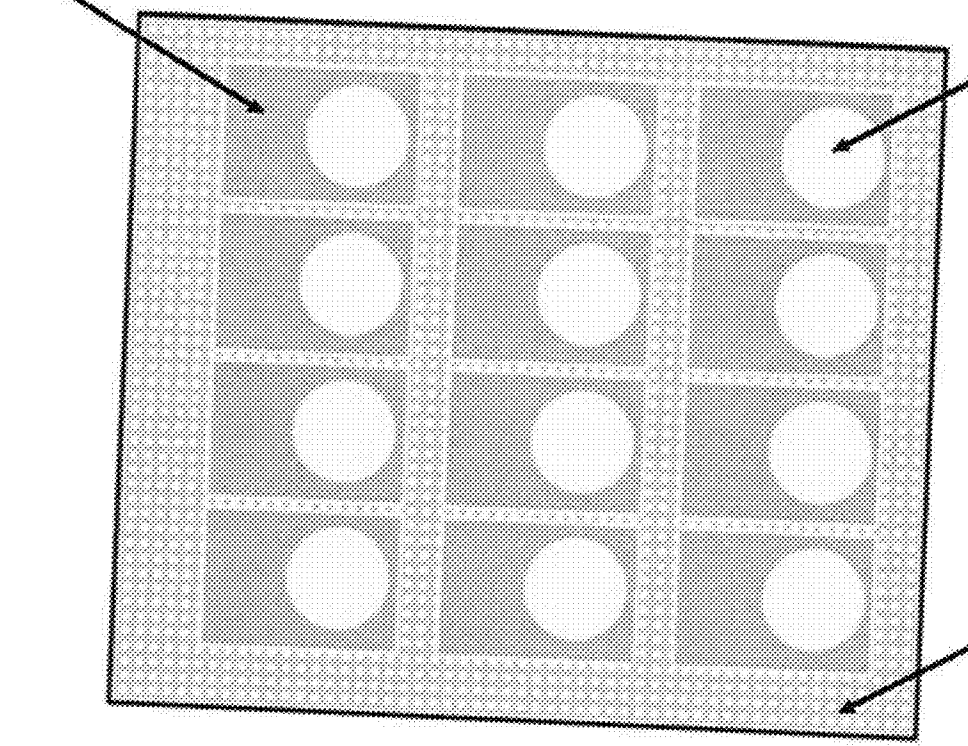
FIG. 13*a* shows schematically a top view of an embodiment of the invention where parts of the cover sheet are left unsealed.

In still another embodiment shown schematically in FIGS. 13*a* and 13*b*, parts of the cover sheet are left unsealed to the carrier as in the embodiment in FIGS. 11*a* and 11*b*. The embodiments differ in that in the one shown in FIGS.

13*a* and 13*b*, the manufacturing does not include the providing of flaps 201 by punching. Instead there is a recess 206 next to each cavity 207, and to gain access to the content of a cavity, the cover sheet 208 is pressed into the recess 206 and the cover sheet 208 is removed from above the actual cavity 207. This action is typically performed by using a finger 209, but an appropriate tool could also be used. In this embodiment, the cover sheet 208 is preferably sealed to the carrier over the whole area not being a recess 206 or a cavity 207. An advantage of this embodiment is that no punching step is needed in the manufacturing process.

Figure 5:
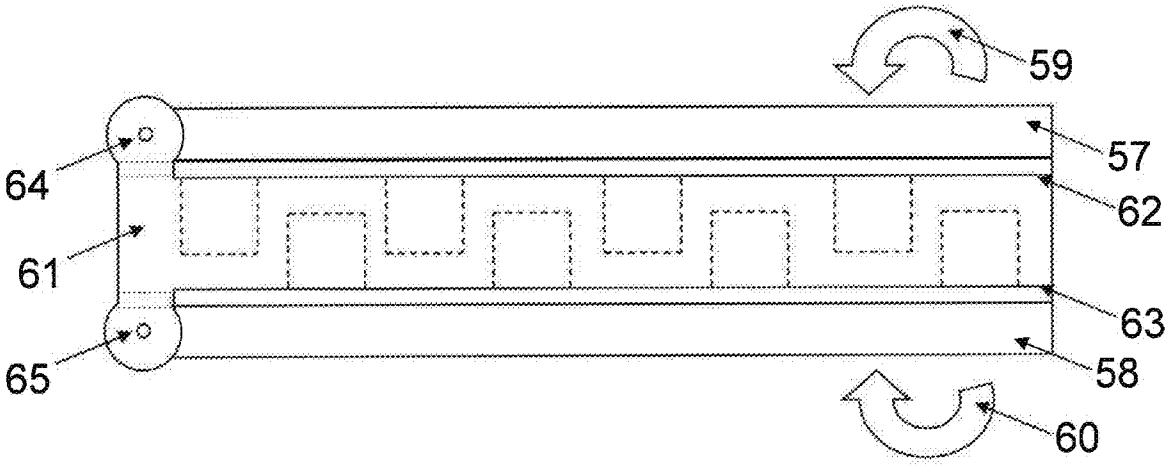
FIG. 5 shows a side view of a disposable package for medical use according to one embodiment of the invention where cavities are present on top and bottom surfaces of the carrier and the access to the cover sheets is protected by a lid.
Figure 5A:
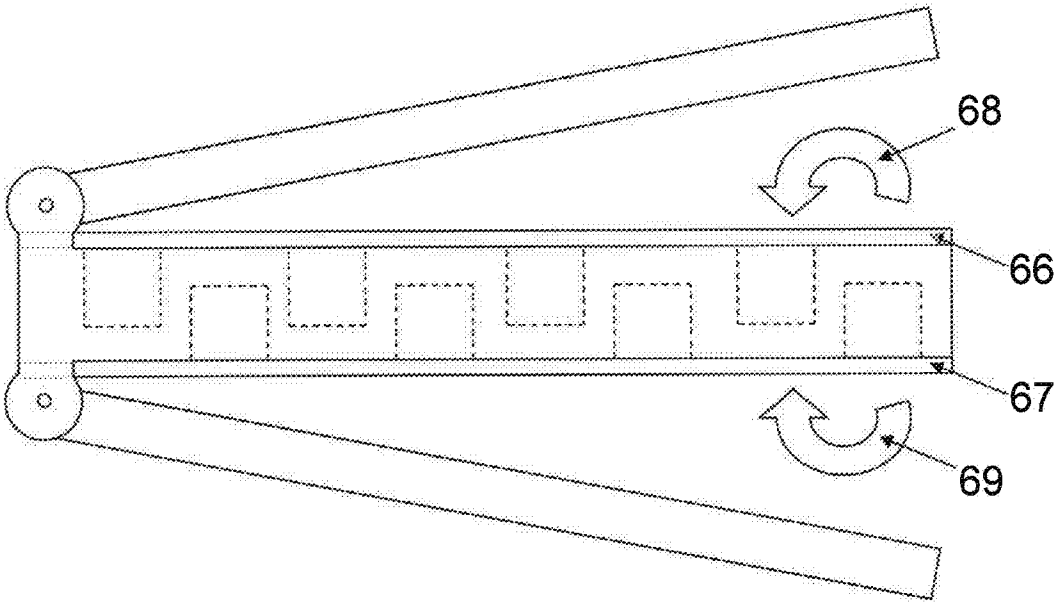
FIG. 5*a* shows the sequence of opening according to the embodiment of the invention in FIG. 5.

FIG. 5 shows a side view of a disposable package for medical use according to the embodiment of the invention where cavities are present on the top and the bottom surfaces of the carrier, and the access to the cover sheets is protected by two lids 57 and 58. The lids 57 and 58 are hinged to the same end of the carrier 61 but onto top and bottom surfaces 62 and 63 respectively. Hinges 64 and 65 enable lids 57 and 58 to be moved between open and closed position following a movement along arrows 59 and 60 respectively as shown in FIG. 5*a*. Once in the open position, the access to cover sheets 66 and 67 is possible and removal of the cover sheets following arrows 68 and 69 leads to access to the underneath cavities.

Figure 6:
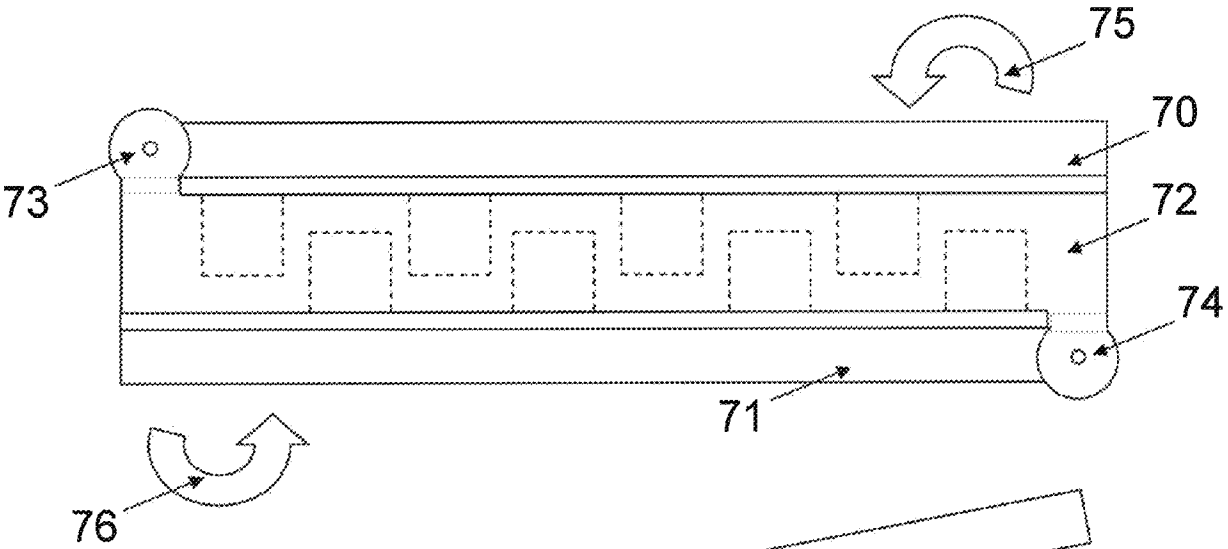
FIG. 6 shows a side view of a disposable package for medical use according to another embodiment of the invention where cavities are present on top and bottom surfaces of the carrier and the access to the cover sheets is protected by a lid.
Figure 6A:
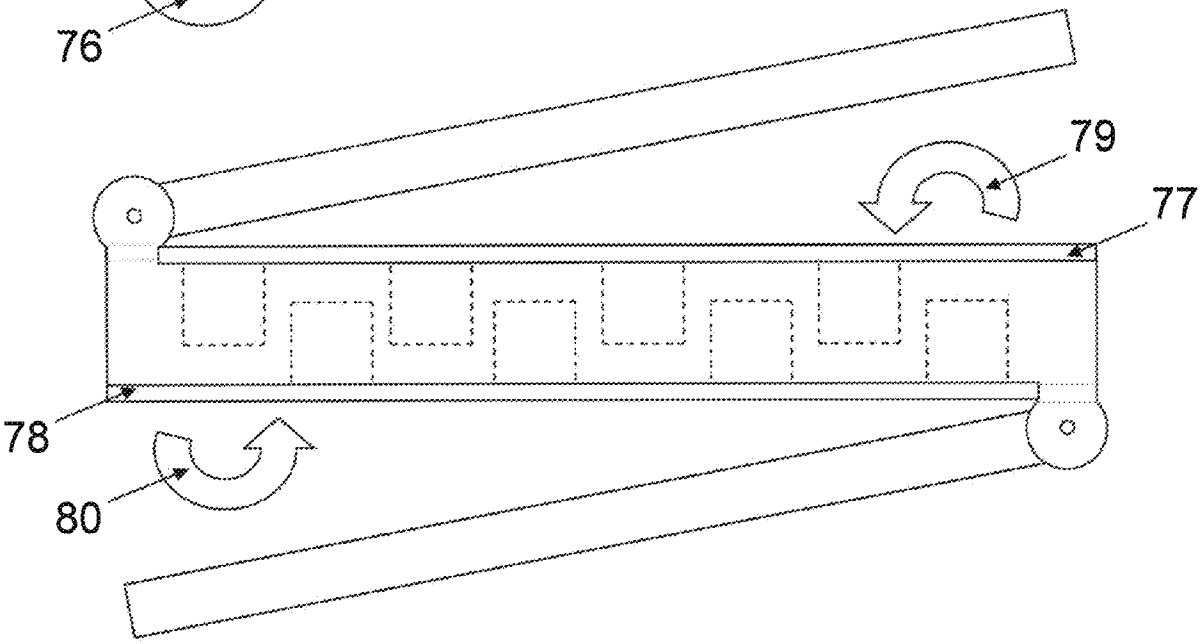
FIG. 6*a* shows the sequence of opening according to the embodiment of the invention in FIG. 6.

FIG. 6 shows a side view of a disposable package for medical use where the access to the cover sheets is protected by two lids 70 and 71 hinged to opposite ends of carrier 72. Hinges 73 and 74 enable lids 70 and 71 to be moved between open and closed position following an asymmetric movement along arrows 75 and 76 respectively as shown in FIG. 6*a*. Once in the open position, the access to cover sheets 77 and 78 is possible, and removal of the cover sheets following arrows 79 and 80 leads to access to the underneath cavities.

Figure 6B:
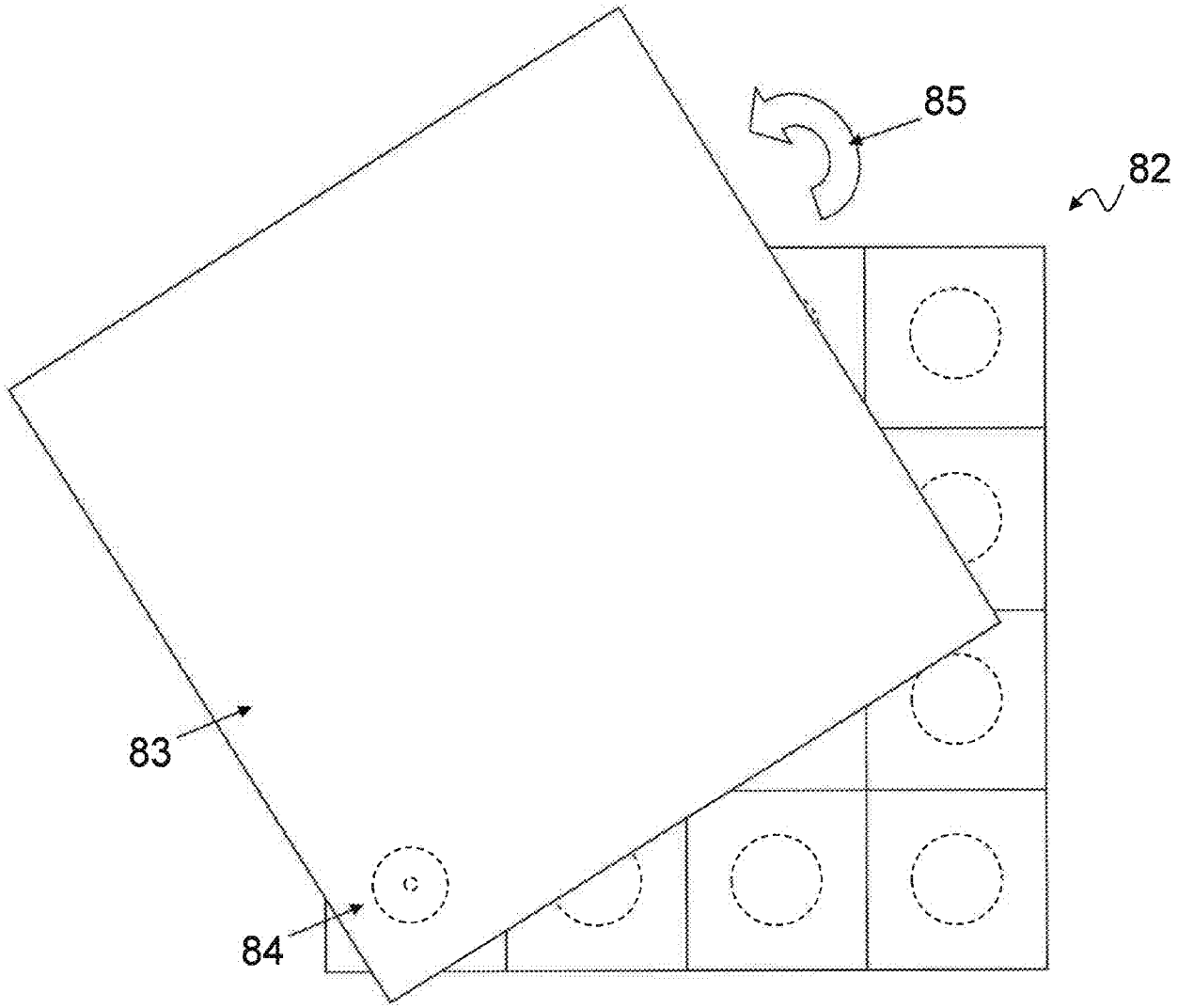
FIG. 6*b* shows a top view of a disposable package for medical use according to the embodiments of the invention where the package comprises a rotational joint.

FIG. 6*b* shows a top view of a disposable package for medical use 82 where the access to the cover sheets is protected by a lid 83, or by two lids in case cavities are present on top and bottom surfaces of the carrier. In this embodiment the cover sheet is protected by lid 83 which can be opened by a rotational movement along the axis of hinge 84, so that lid 83 can rotate laterally following arrow 85. Closure of the lid may be obtained by the opposite rotational movement.

Hinge 84 may be a pivot hinge or any rotational joint which allows the rotational movement showed in FIG. 6*b*.

Figure 6D:
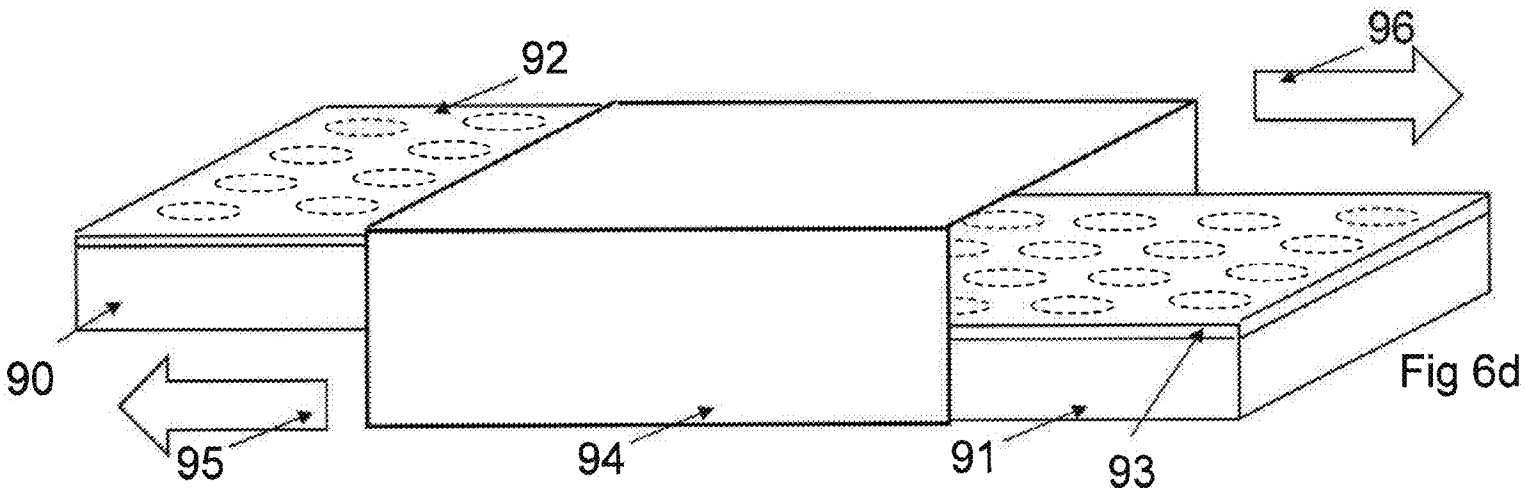
FIG. 6*d* shows a 3 dimensional view of a disposable package for medical use where the hollow rectangular body with the function of a lid protects two carriers.
Figure 6C:
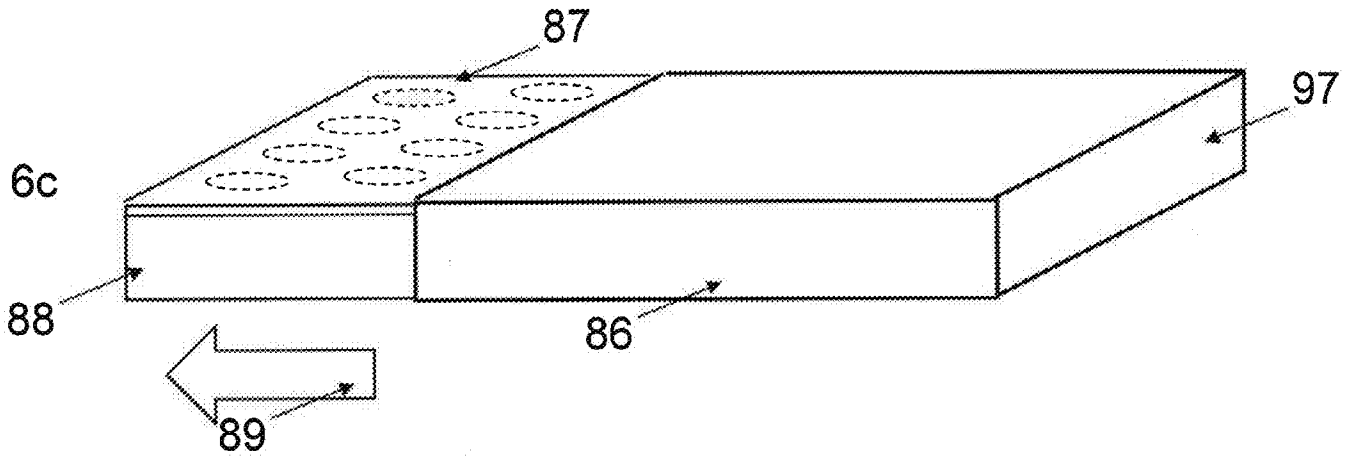
FIG. 6*c* shows a 3 dimensional view of a disposable package for medical use where the protection of the cover sheet is provided by a hollow rectangular body with the function of a lid.

FIG. 6*c* shows a 3 dimensional view of a disposable package for medical use where the protection to the cover sheet is provided by a hollow rectangular body 86 with the function of a lid. To gain access to the cover sheet 87 protecting the carrier 88, a lateral sliding movement of the carrier 88 is required by following arrow 89.

In other embodiments, carriers and cover sheets and opening system disclosed in previous embodiments, e.g. in FIG. 1, 1*a*, 3, 7, 9, 10 or 10*a* may be applied to this embodiment.

FIG. 6*d* shows a similar embodiments to FIG. 6*c* where two carriers 90 and 91 and their respective cover sheets 92 and 93 are protected by a hollow rectangular body 94 with the function of a lid. To gain access to the cover sheet 92 protecting the carrier 90, a lateral sliding movement of the carrier 90 is required by following arrow 95. Accordingly, to gain access to the cover sheet 93 protecting the carrier 91, a lateral sliding movement of the carrier 91 is required by following arrow 96. The carrier and cover sheet are for simplicity shown with cavities only on one surface of the carrier. In other embodiments, carriers and cover sheets may be the ones described in the previous embodiments, e.g. in FIGS. 1, 1*a*, 3, 7, 9, 10 or 10*a*.

In other embodiments the hollow rectangular body may have only a single opening to the hollow, e.g. in FIG. 6*c* the body 86 has also a lateral wall 97.

In these embodiments described by FIGS. 6*b*, 6*c* and 6*d*, the open space between the cover sheets and the lid, e.g. the hollow body, may be used for carrying a leaflet with information of interest to the patient, e.g. instructions on how to use the pharmaceutical compositions contained, or a commercial for related medicaments. In some embodiments the sheet forming the carrier and the end sections may be produced by a single injection moulding process. They sheet may alternatively be made by thermoforming. This can be done by forming separate sheets or by forming a plurality of sheets which are then separated, e.g. by punching, in a subsequent manufacturing step. Another alternative manufacturing process will be 3-dimensional printing. In these and other embodiments the top and the bottom surface of the carrier may be produced separately and then welded together.

In some embodiments the hollow body 94 or 86 may have the function of an envelope, so the carrier, cover sheet and the pharmaceutical compositions contained therein can be sent by standard mail. In these embodiments hollow body 94 or 86 may have the receiver address provided, e.g. printed or attached through a label, on one of the external surfaces of the hollow body.

Figure 6E:
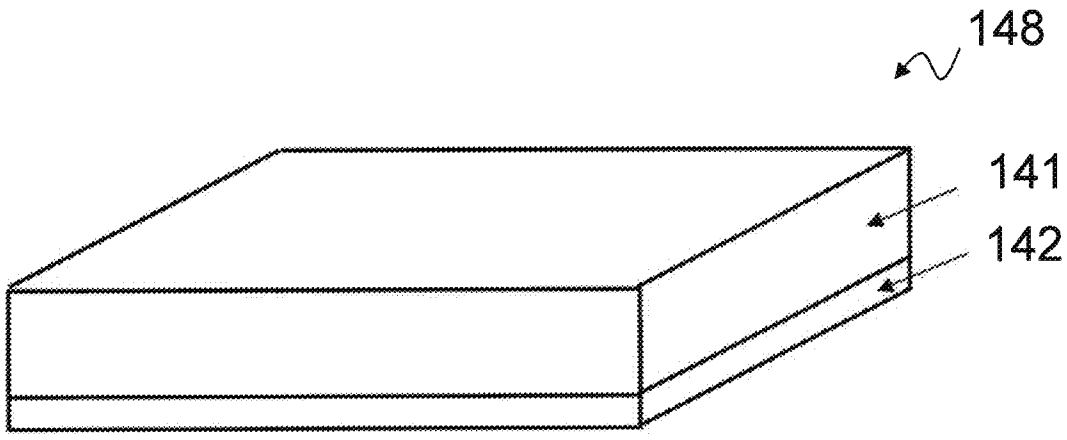
FIG. 6*e* shows a 3 dimensional view of a disposable package for medical use where the protection of the cover sheet is provided by a fully removable lid.
Figure 6F:
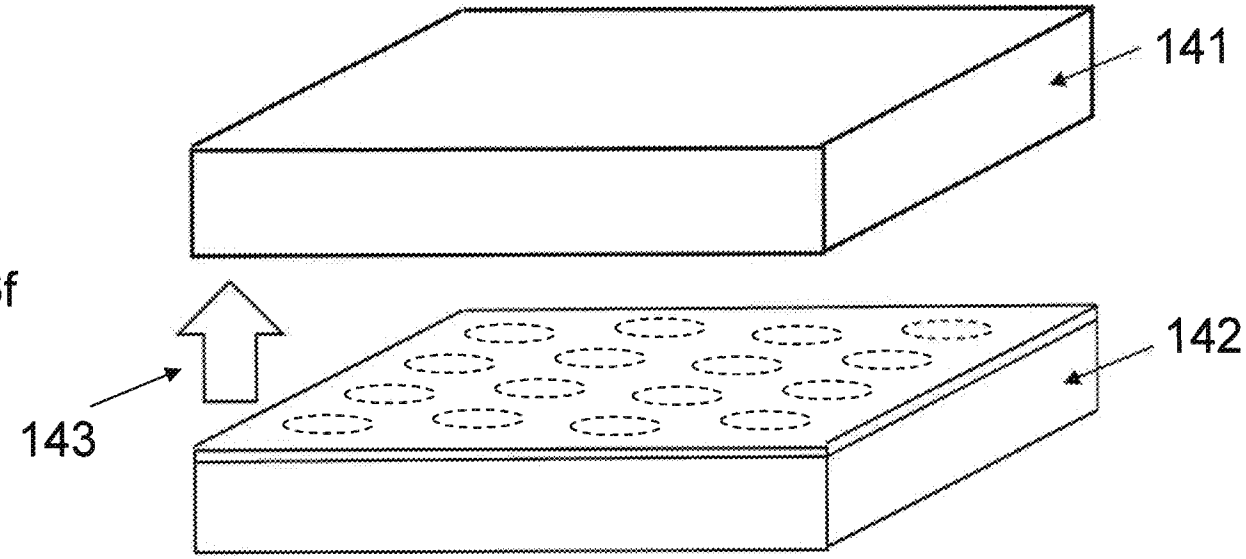
FIG. 6*f* shows the sequence of opening of the embodiment of the invention in FIG. 6*e*.

FIG. 6*e* shows a 3 dimensional view of a disposable package 148 for medical use where the protection to the cover sheet is provided by a fully removable lid 141. In order to access the carrier 142, the lid 141 needs to be fully removed following the direction indicated by arrow 143 as shown in FIG. 6*f*.

Figure 6G:
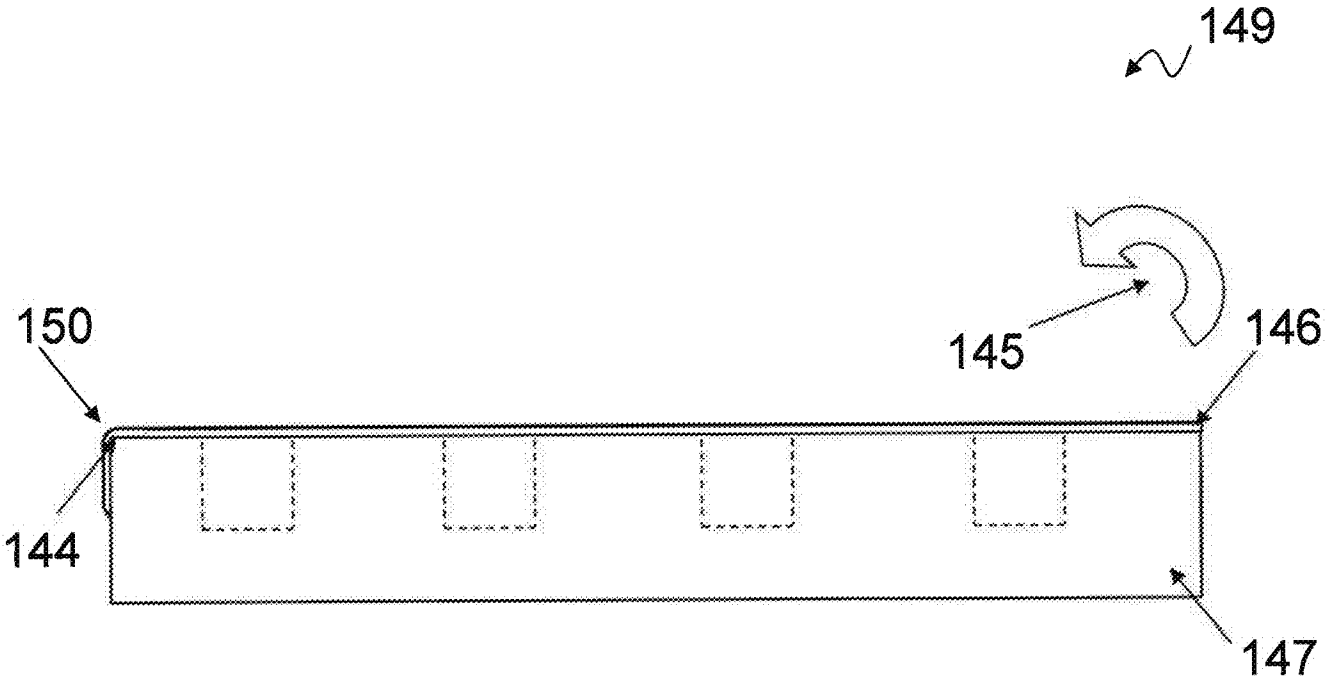
FIG. 6*g* shows a side view of a disposable package for medical use where the lid comprises an adhesive element.

FIG. 6*g* shows a side view of a disposable package 149 for medical use where the lid 146 is at least partially fastened to the cover sheet (not shown) or to the carrier 147. Access to the cover sheet (not shown) or to the carrier 147 may be achieved by opening the lid 146 following arrow 145. This is possible as the lid 146 had an adhesive element 150 which is fasten, e.g. by means of glue, along one of the edges 144 of the carrier 147.

An object of the invention is to provide a container for pharmaceutical compositions as a rigid structure.

For example in a single use medical package according to one aspect of the invention, the carrier sheet further comprises at least two rims areas each at least partly surrounding a carrier half, the rims protruding in a direction perpendicular to said cover sheet and being adapted to engage with each other, when said medical package is closed.

An outer foil may be attached to areas adjacent the rims at a surface of the carrier sheet being the outer surface of the package when the package is closed.

Figure 14A:
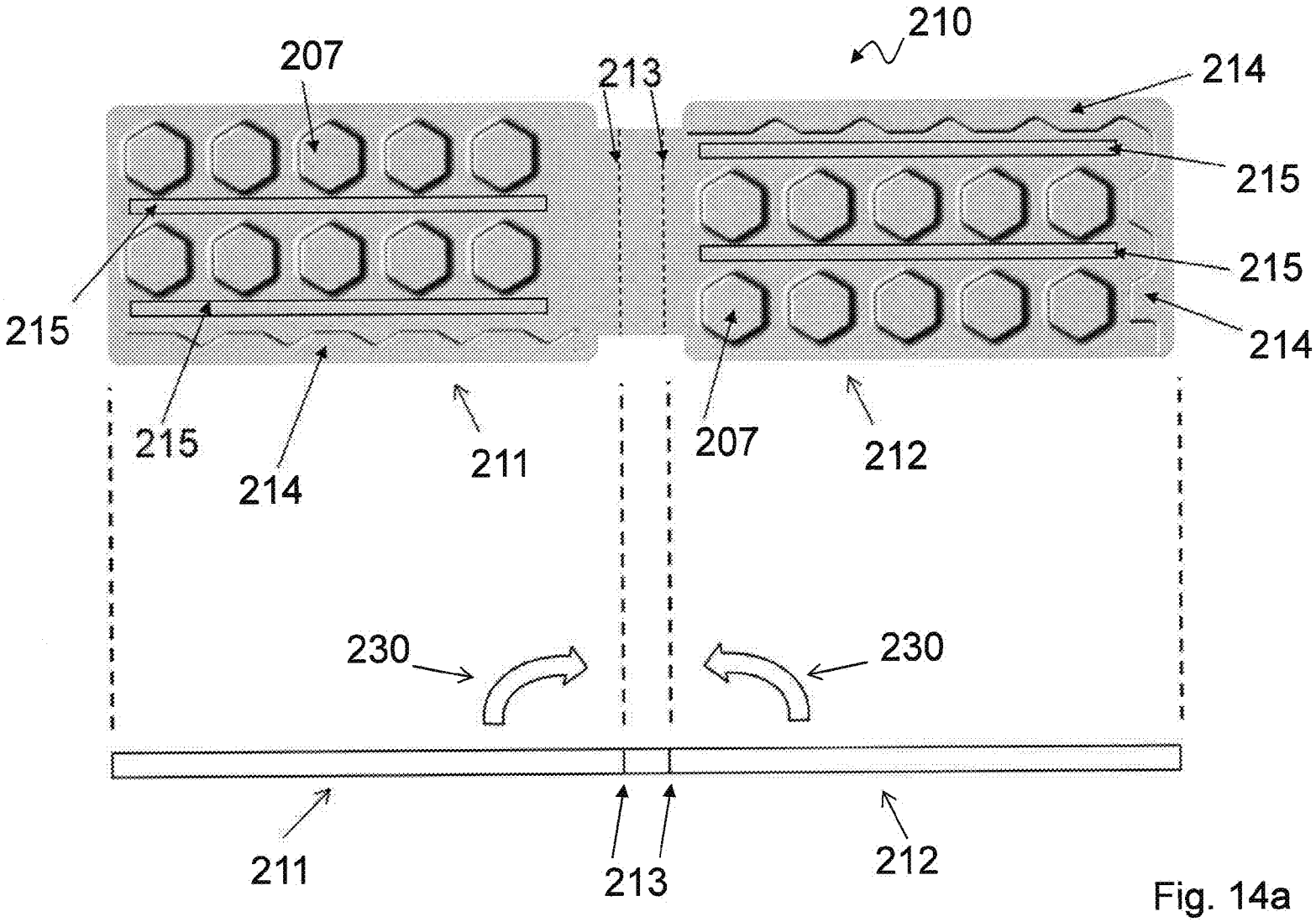
FIG. 14*a* shows schematically a top view of an embodiment of the invention where the carrier sheet is in an un-folded state.
Figure 14B:
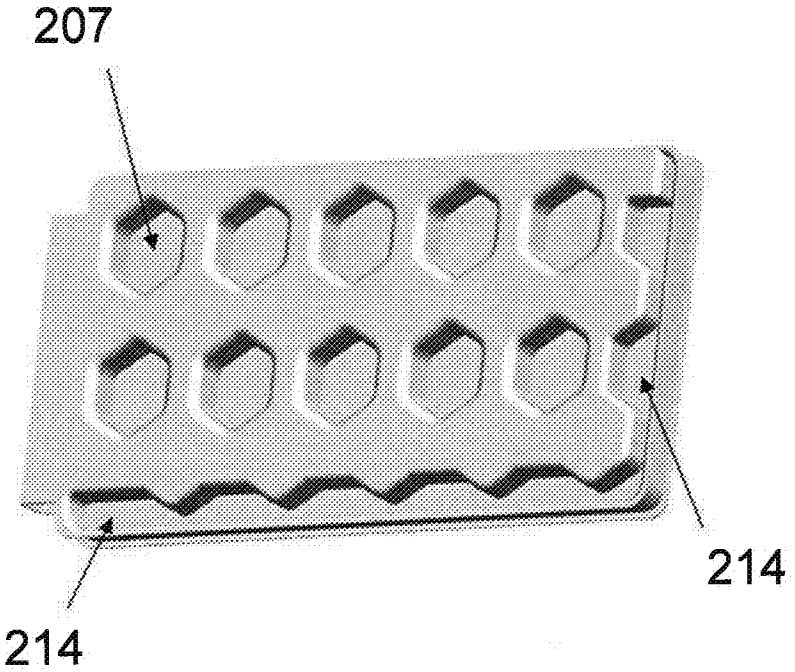
FIG. 14*b* shows schematically a 3-dimensional view of the embodiment of the invention of FIG. 14*a* in its folded state.

This rigid structure can e.g. be obtained by a carrier 210 as shown in FIGS. 14*a* and 14*b*. The carrier 210 may be produced in a single foil in which two halves 211,212 each comprising cavities 207 arranged in rows may be identified. FIG. 14*a* and FIG. 14*b* show the carrier 210 in un-folded and folded state, respectively. The two halves 211,212 are adapted to be folded in such a way that the cavities 207 intermesh and thereby provide both stiffness and compactness to the carrier 210. The carrier 210 is preferably folded along two fold lines 213 following arrows 230 so that the closed end of the cavities 207 lies on the opposite half, i.e. the closed end cavities 207 of half 211 lies on half 212 and vice versa, as shown in FIG. 14*a*. Such a design results in a carrier 210 where the pharmaceutical compositions are to be accessed from both sides of the carrier 210. The cavities 207 are covered by a cover sheet 208 as described above;

preferably the same cover sheet covers both halves 211,212; it could also be that two separate cover sheets covers each half 211,212. The cover sheet 208 is preferably sealed to the carrier 210 before folding, but it can in principle also be attached after folding the carrier 210. In FIGS. 14*a* and 14*b*, the cavities 207 are honeycomb-shaped and arranged in two rows on each half 211,212 of the carrier 210. This configuration provides extra rigidity to a flexible blister structure once folded. In general in the folded state, the closed bottom part of the cavities 207 of the half 212 may support a correspondent area on half 211 and vice versa. Any other shape of intermeshing cavities which in the folded state can support the carrier sheet and provide rigidity to the final structure may be envisaged.

Figure 20:
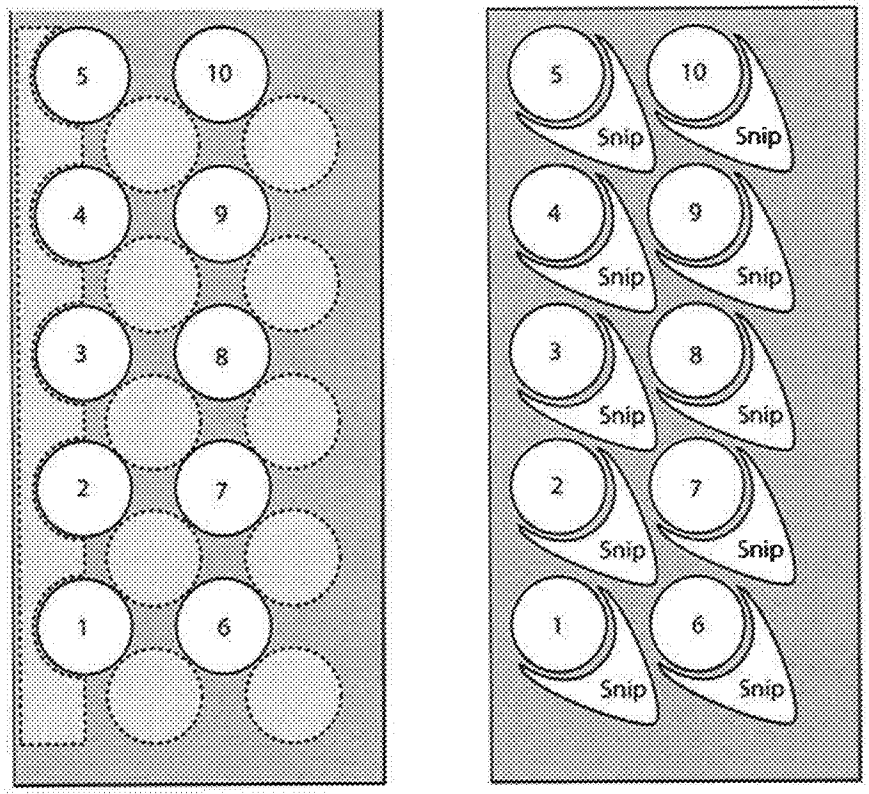
Figure 21:
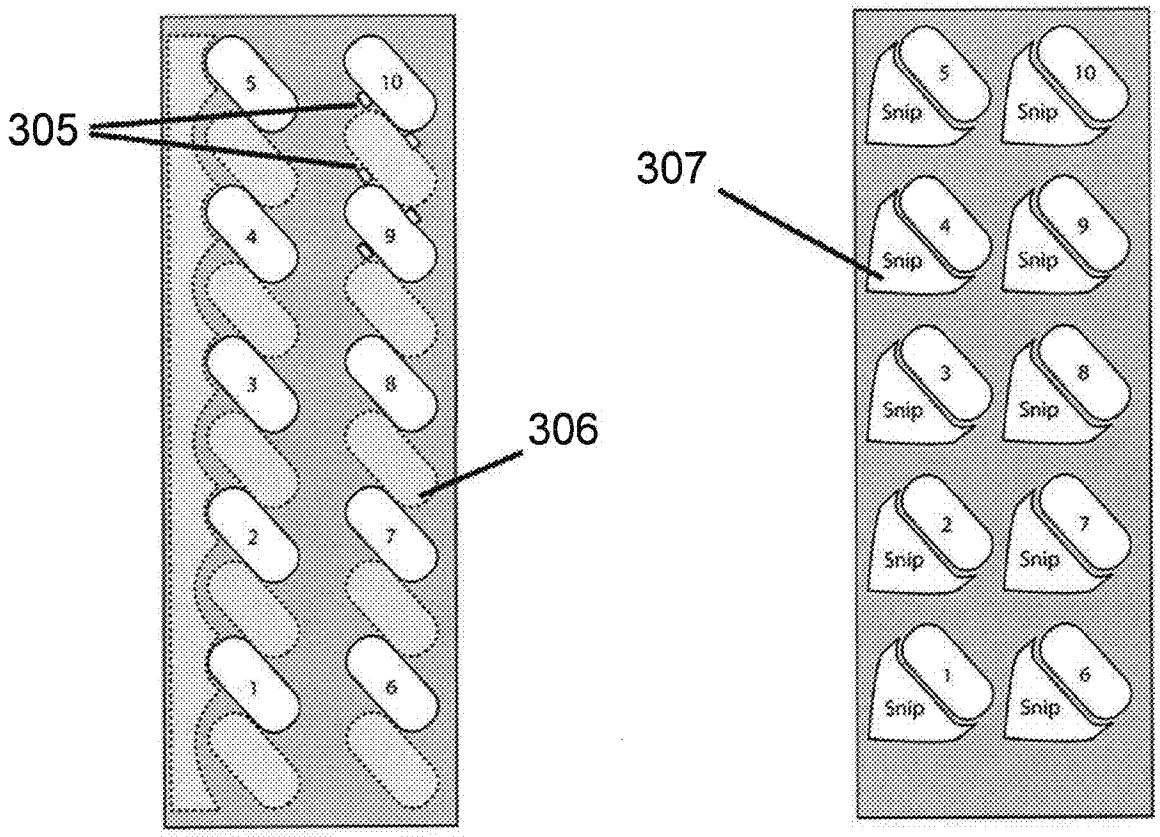

Furthermore, the location of the cavities on the surface of the carrier sheet can be optimized, e.g. by computer simulations or by experimentation, so as to provide an optimal structure supporting the rigidity of the package. FIGS. 19-23 show examples of packages where the location of the cavities on the surface of the carrier sheet may provide an optimal structure to increase the rigidity of the package. For example in FIG. 19, the different locations of the cavities, e.g. 301 and 302, may also be coupled to different locations and designs of the snip, e.g. 304 for removing the cover sheet and providing access to the cavity underneath. 303 identifies the glued area connecting top and bottom surfaces of the carrier sheet carrying blisters, e.g. 301 and 302. FIGS. 20 and 21 show two embodiments of the medical package with cavities and snips having an alternative shape. In FIG. 21 small bulges are 305 present between the cavities, e.g. 306 and the snips, e.g. 307.

Figure 22:
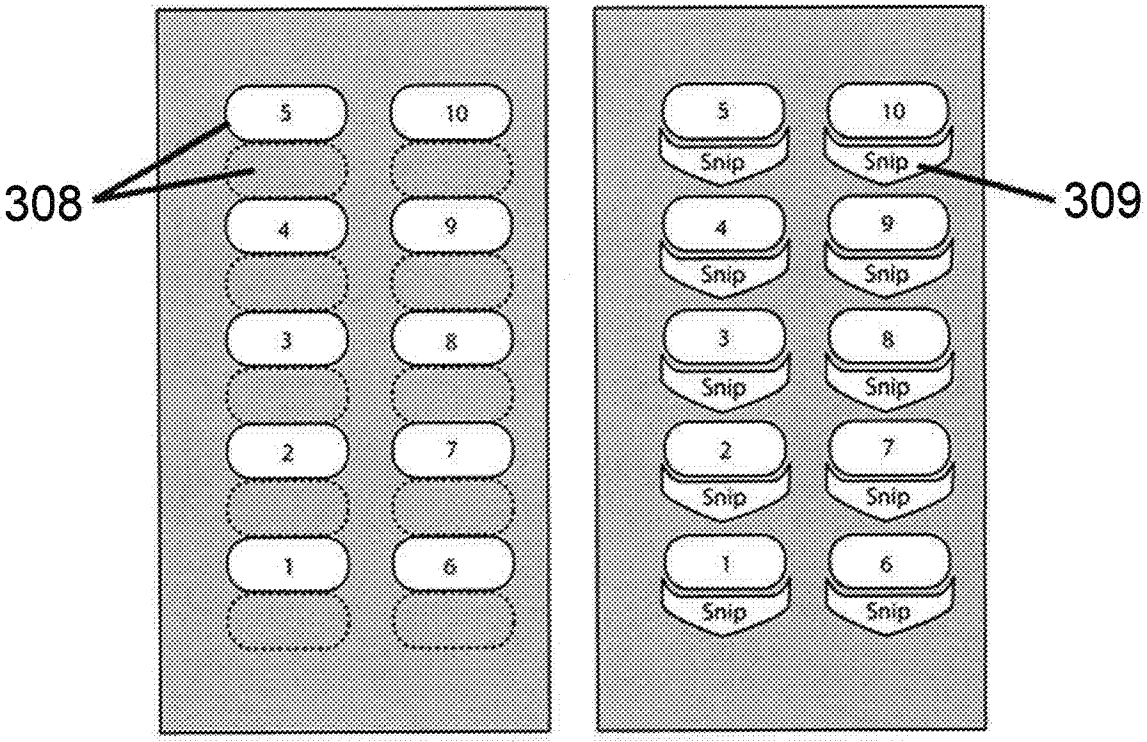
Figure 23:
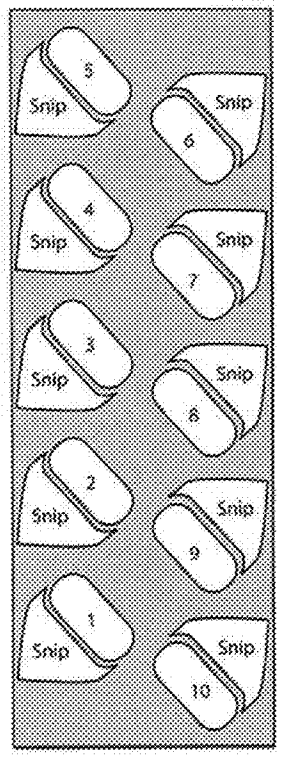
Figure 23:
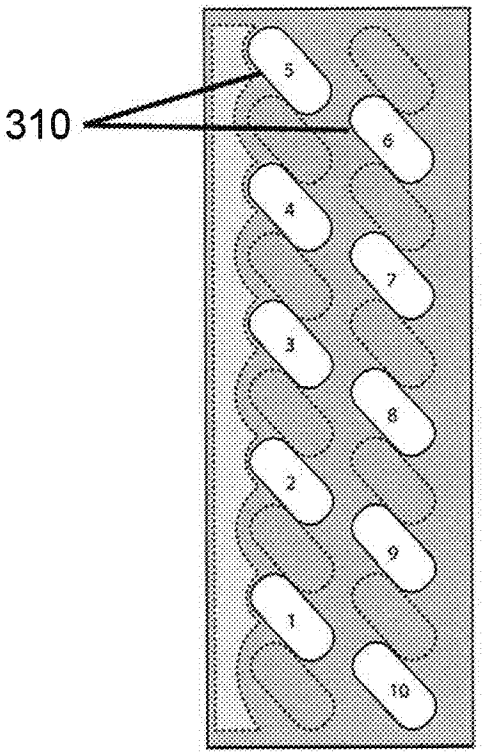

FIGS. 22 and 23 show further embodiments of the medical package with different combinations of cavities, e.g. 308 or 310, and snips, e.g. 309, also providing more rigidity to the structure.

Referring again to FIG. 14, the rigidity and thereby protection of the pharmaceutical composition arranged in the cavities 207 is also provided by the edge parts 214 being formed to provide barriers and support for the carrier sheet along the edges of the carrier 210 when folded. Other shapes and arrangements fulfilling the same purpose are also covered by the scope of the present invention. The fact that the two halves 211,212 are made from one folded sheet of material instead of using two separate sheets means that they are kept in a more fixed mutual relationship which adds to the rigidity of the carrier 210. To prevent the carrier 210 from unfolding, the two halves 211,212 of the carrier 210 can be joined e.g. by strings of adhesive 215, such as hot melt adhesive. Such joining will further prevent mutual movement of the two halves 211,212 and thereby also provide further rigidity to the carrier 210.

Figure 15A:
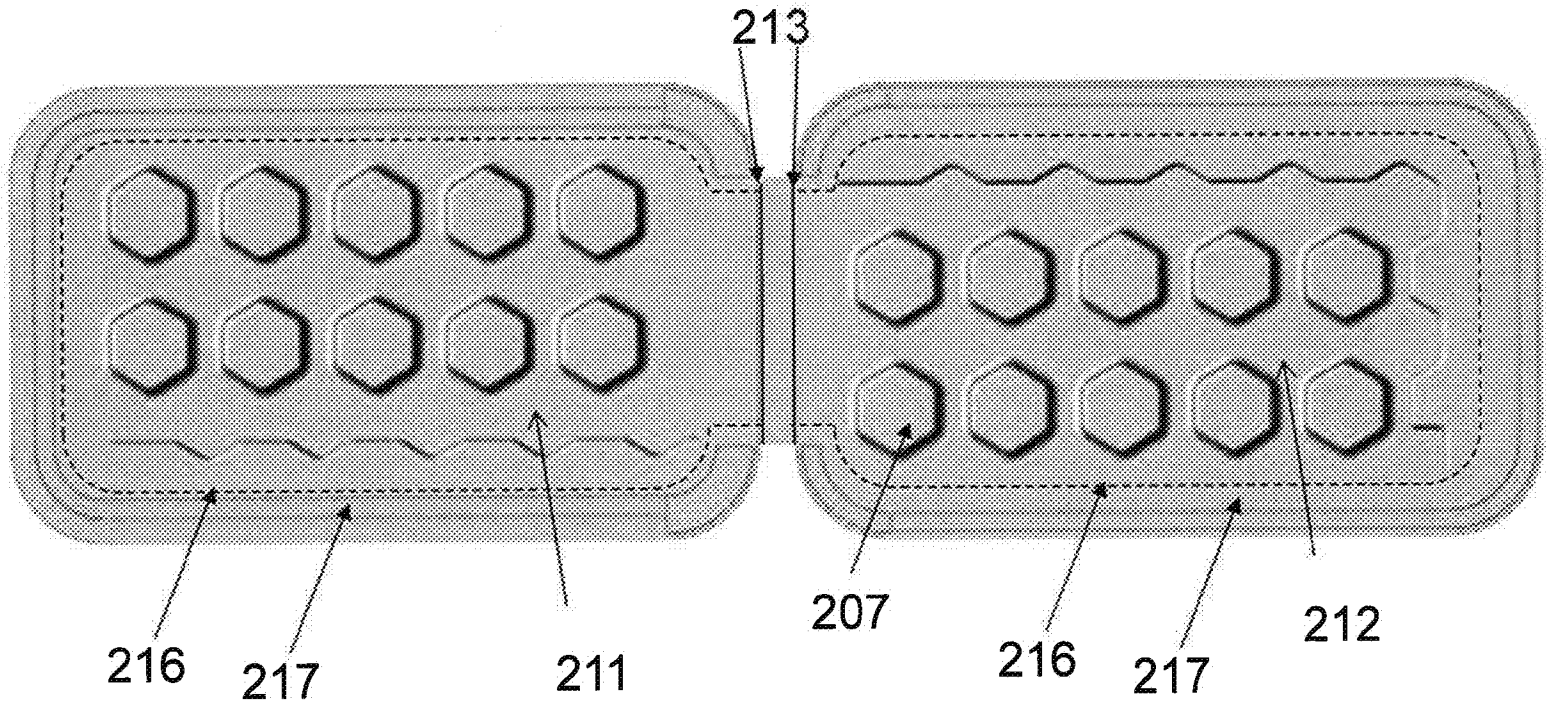
FIGS. 15*a,b,c,d* show an alternative embodiment based on the same principle of folding as in FIGS. 14*a* and 14*b*.
Figures 15B, 15D:
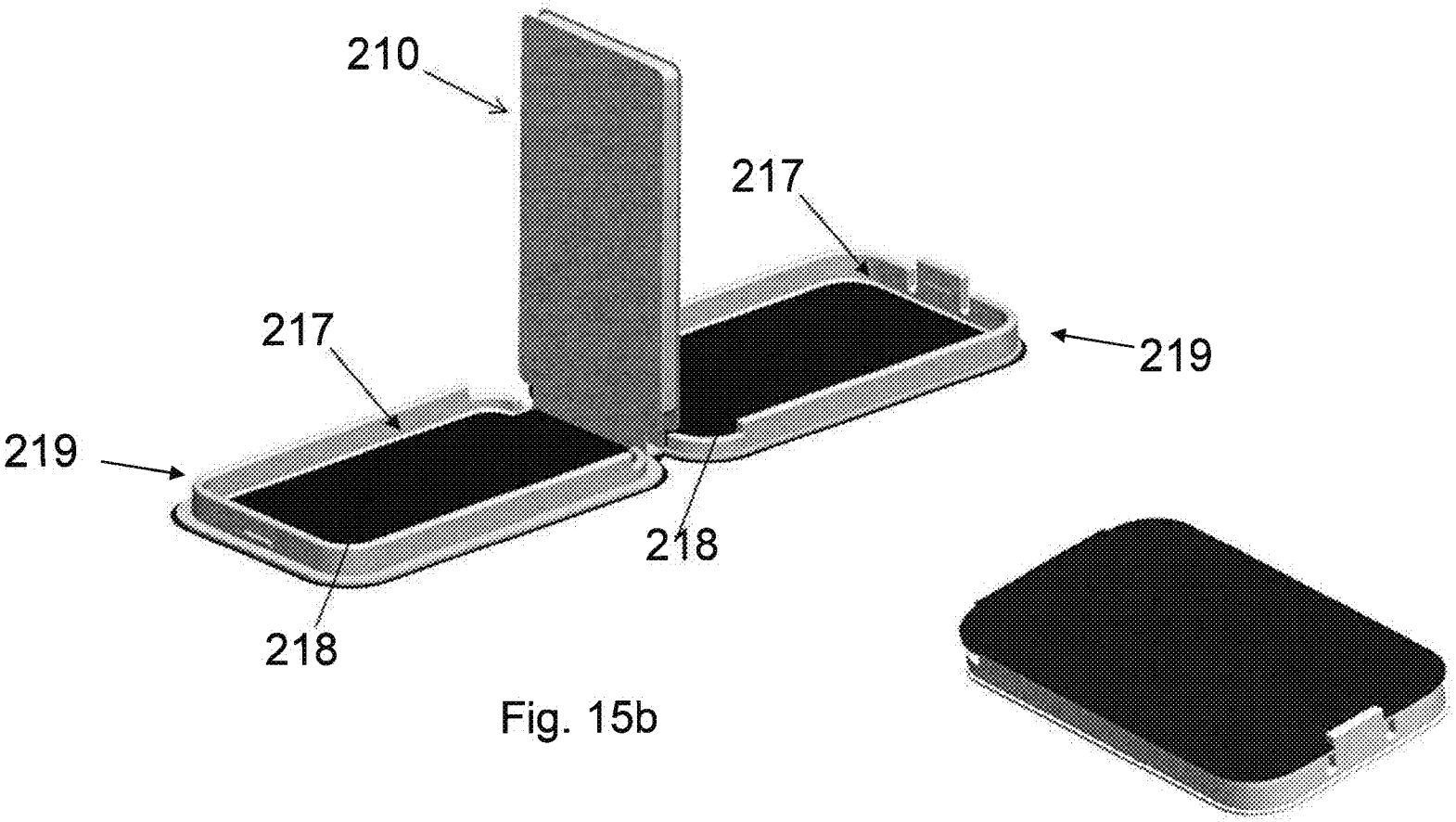
Figure 15C:
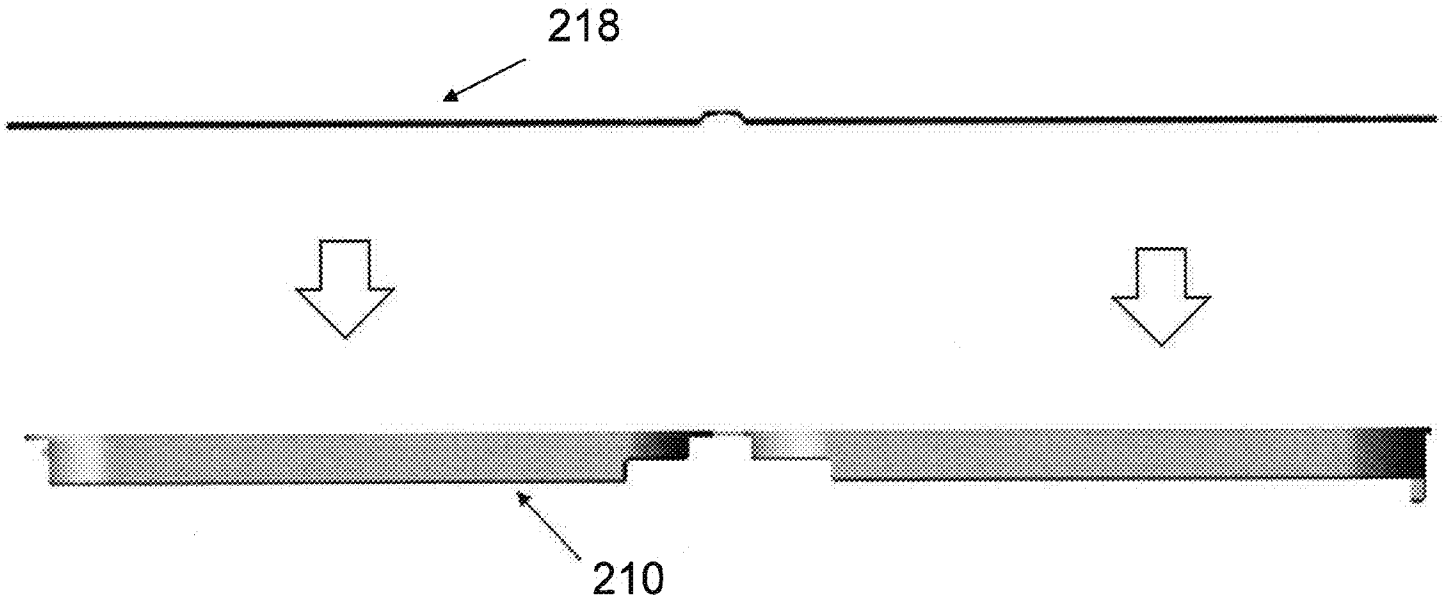
Figure 16A:
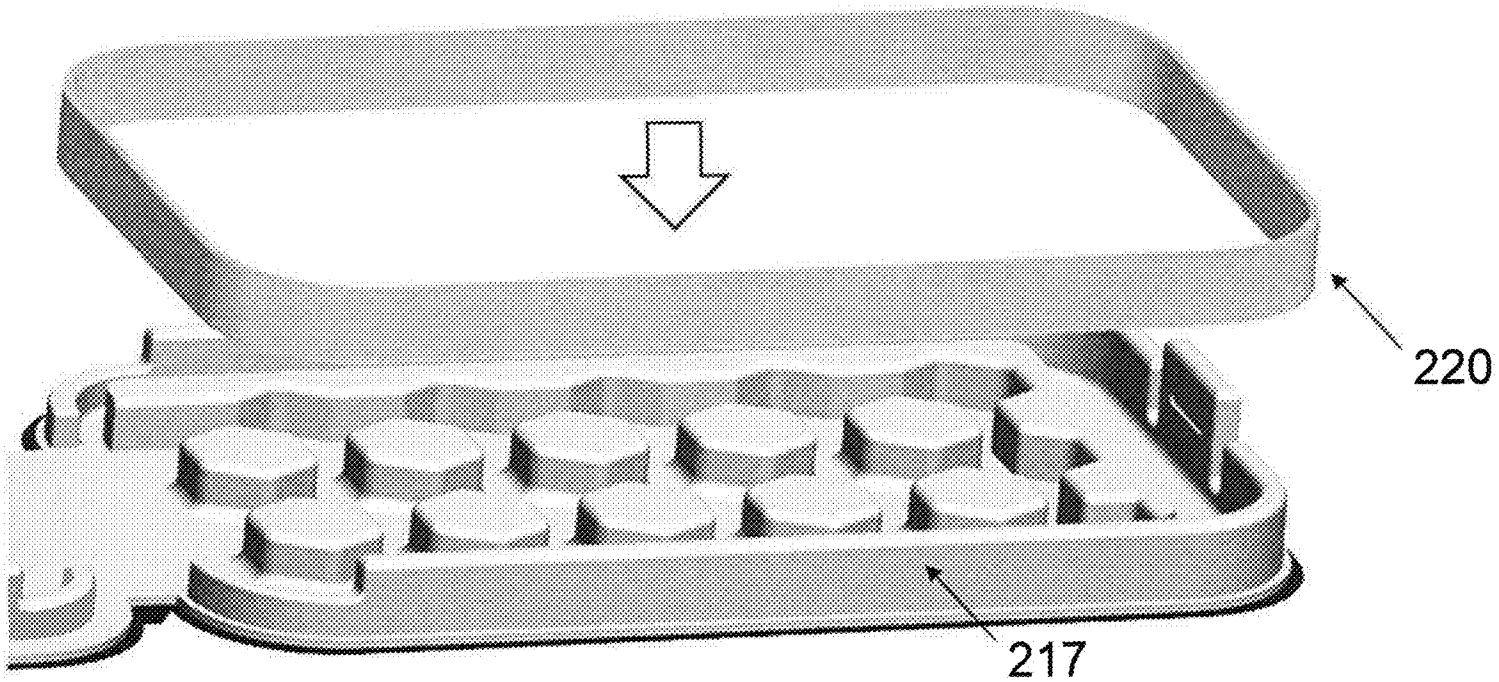
FIGS. 16*a* and 16*b* show schematically a 3-dimensional view of the embodiment of the invention of FIG. 15*a,b,c,d* before and after fastening of a supporting ring, respectively.
Figure 16B:
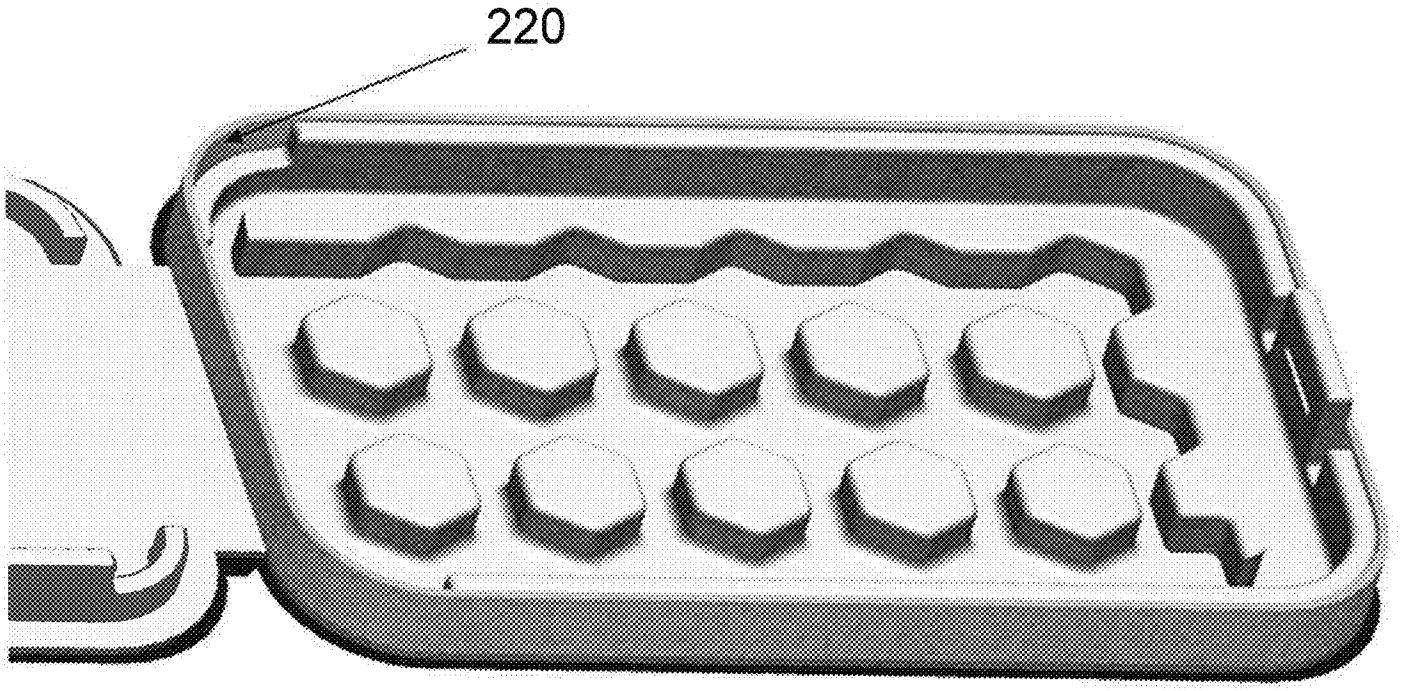

FIGS. 15*a,b,c,d* show an alternative embodiment based on the same principle of folding as in FIGS. 14*a* and 14*b*. FIG. 15*a* shows the unfolded carrier 210, where the broken lines 216 show the shape of the carrier 210 in FIG. 14*a*. The embodiment in FIG. 15*a,b,c,d* is provided with protruding rims 217 along the edges. The sheet to become the carrier 210 and the rims 217 is typically shaped by thermoforming a plastic sheet. After thermoforming to the shape in FIG. 15*a*, the sheet is punched along the broken lines 216 around the two halves 211,212 comprising the cavities 207. The two halves 211,212 are folded following arrows 230 as shown in FIG. 14*a* so as to reach the folded structure as shown in FIG. 15*b* which would leave the spaces between the rims 217 as holes. To obtain closed outer surfaces of the container, an outer foil material 218, such as a plastic foil, is fastened to the rim areas 217, preferably before the folding. The joining of the outer foil 218 and the rim area 217, and thereby to the carrier 210, is shown in FIG. 15*c*, and the resulting look is seen from FIGS. 15*b* and 15*d* in opened and closed state, respectively. In this way, the carrier 210 and thereby the pharmaceutical compositions will be protected by the sections 219 comprising the rims 217 and the outer foil 218 which will function as lids. If further rigidity and an even more closed design are desired, this can be obtained by adding a further ring 220 on top of each rim 217. This is shown in FIGS. 16*a* and 16*b* before and after fastening of the ring, respectively. The ring 220 can be fastened by any suitable means, such as by adhesive or by press fit.

In one embodiment the carrier 210 including the rims 217, following the punching along the broken lines 216, the filling with a pharmaceutical composition and the further covering by foil 218, is folded without separating rims 217 and carrier 210. Upon opening of the blister package, the foil 218 sealed to the rims 217 will act as lids and the package opens along the broken lines 216 which have been punched following the thermoforming process. In this way further rigidity of the structure is obtained as the breakage along lines 216 is only achieved after the first use of the package, so as to avoid undesired opening during transportation from the producer to the first user of the package.

A first step in a presently preferred manufacturing method for the embodiment in FIG. 15*a,b,c,d* would be to shape the sheet comprising the carriers 210 and the rims 217 to the geometry shown in FIG. 15*a*. This would typically be done by first thermoforming of a plastic sheet. The cavities 207 are then filled with the pharmaceutical compositions, and the cavities 207 are covered by a cover sheet 208, typically made from aluminium foil. The next step is punching where the carrier halves 211,212 are separated from the rim areas 217. In the same or in a subsequent punching step, flaps 201 can be made as previously described, e.g. in relation to FIG. 11*a,b*. Then the outer foil 218 is fastened to the rim areas 217 as shown in FIG. 15*c*. The outer foil 218 can be sealed and/or fastened e.g. by thermowelding or by gluing. The outer foil 218 can be a continuous foil providing further protection to the cover sheet 208, so that no access to the cover sheet 208 is possible unless the outer foil 218 is removed following the opening of the package.

In some embodiments the outer foil 218 may either have the desired shape before fastening to the rim area 217, or it can be fastened as a sheet material covering a large number of containers so that it has to be punched to the desired shape after fastening.

All the steps described up to now can be performed without the need to turn the material which is advantageous from a manufacturing point of view. The following steps are preferably performed after rotating the containers by 180° so that what was before the underside becomes the top side. If desired, adhesive, such as strings of hot-melt adhesive is applied, and if desired, rings 220 of thermoformed plastic are arranged on top of the rims 217. The two halves 211,212 of the carrier 210 are then folded together and joined, and the "lids" comprising the rims 217 with the outer foil 218 are closed around the carrier 210. If desired, instructions for use of the pharmaceutical compositions can be arranged inside the container; it can e.g. be glued to the inner side of the outer foil 218 before the container is closed.

An alternative medical package having a build-in covering lid will be described in the following with reference to FIGS. 17*a,b,c* and 18*a,b*.

For example a single use medical package, according to one aspect of the invention may comprises at least four sections arranged in a row and made from a single sheet, each section being pivotally connected to at least one of the other sections along a fold line in the single sheet.

By single sheet is meant a continuos sheet of, e.g. plastic.

Each of two middle sections of the at least four sections may constitute a carrier half containing at least one cavity for housing pharmaceutical compositions, the two carrier halves being pivotally connected to each other.

Each of the two end sections of the at least four sections constitutes an outer cover part for at least one of the carrier half, each of the two end sections being pivotally connected the correspondent carrier half.

Correspondent is herein defined as the complementary carrier half according to FIGS. 17 *a,b,c* and 18 *a* and 18*b*.

The at least four, sections are adapted to be folded into a folded configuration where the two carrier halves are located adjacent to each other with the cavities intermeshing and with the open sides of the cavities facing away from each other.

In this way each of the two outer cover parts is located adjacent a carrier half.

Figures 17A, 17B:
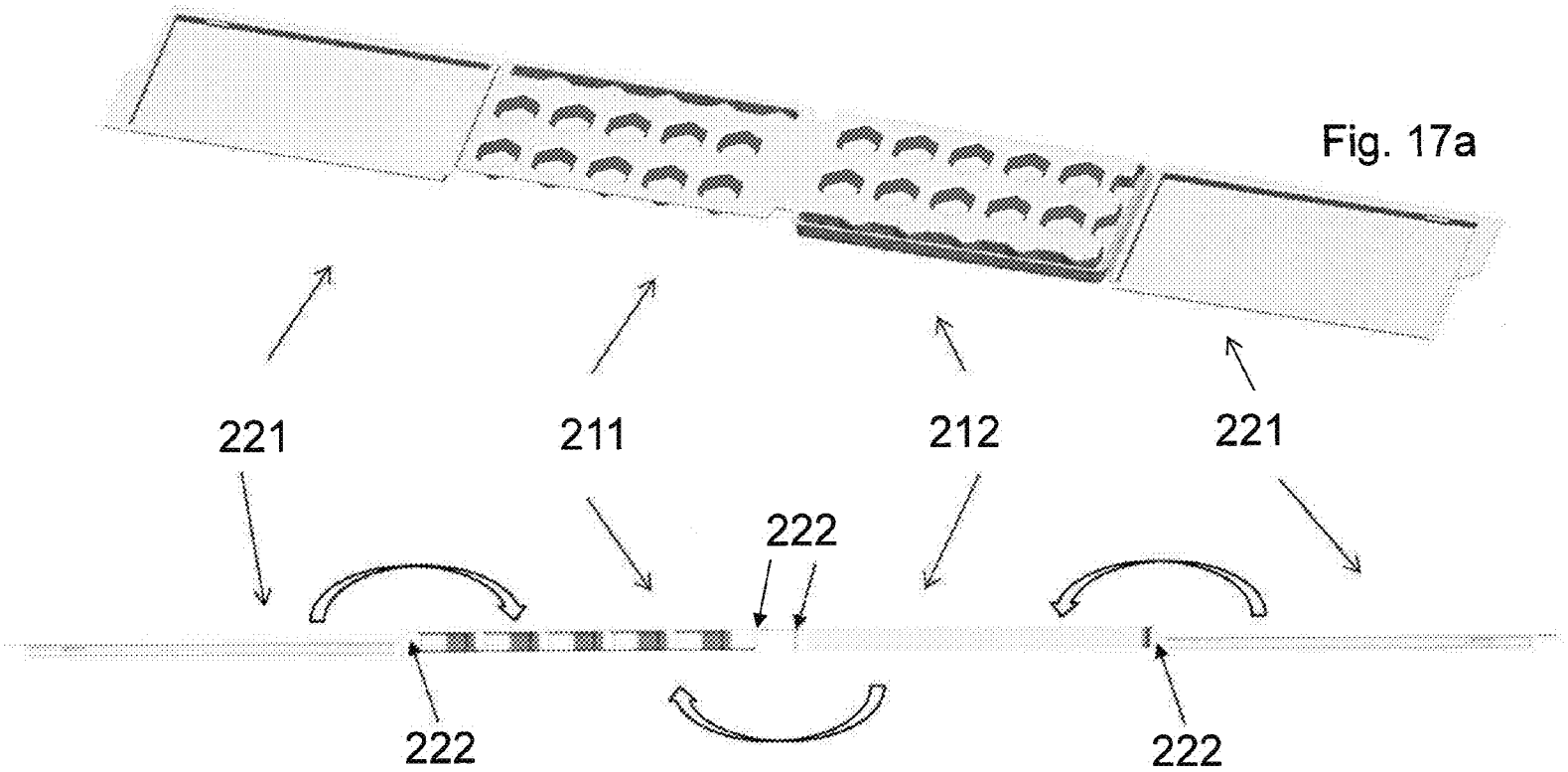
FIGS. 17*a, b, c
Figure 17C:
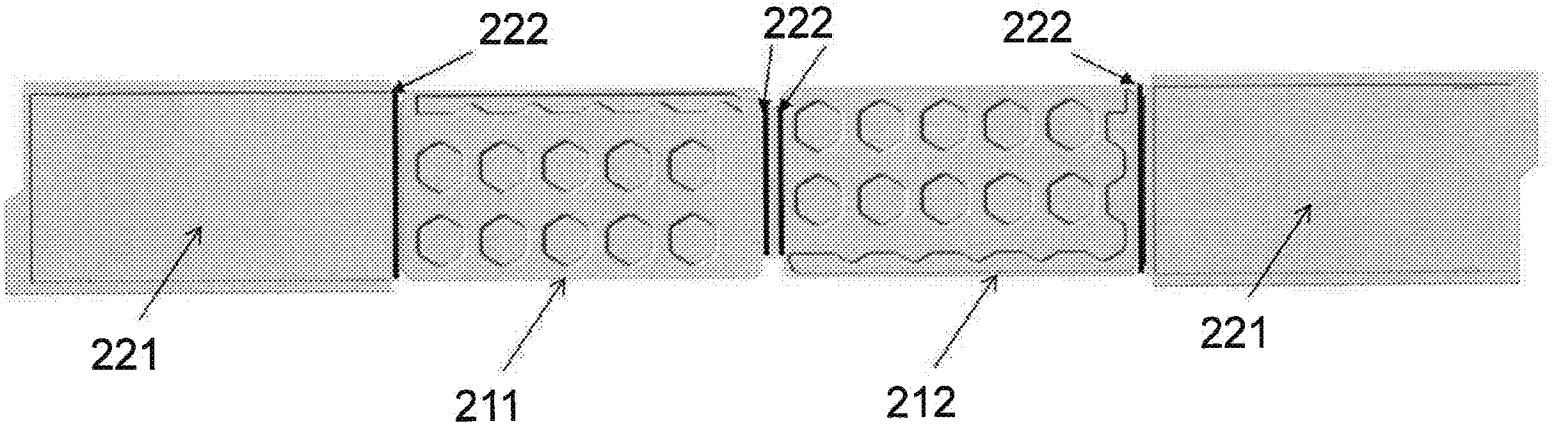
Figure 18B:
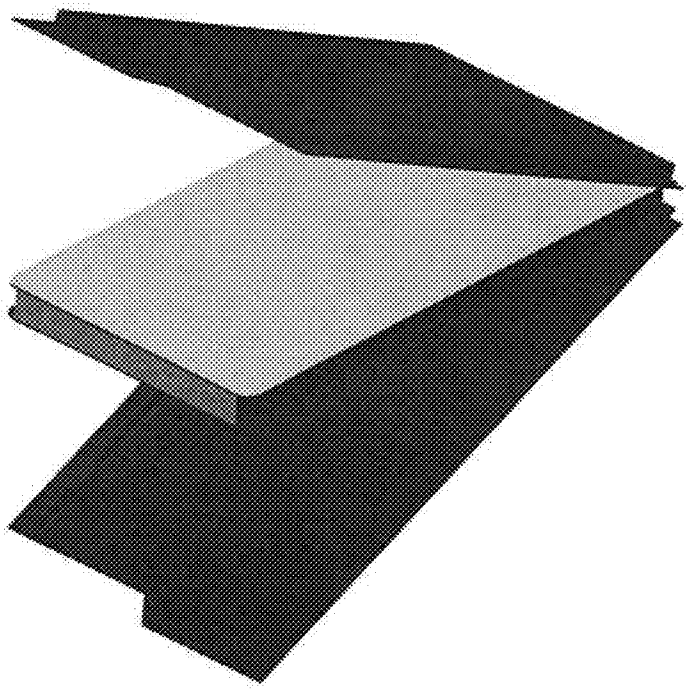
* and FIGS. 18*a* and 18*b* show schematically top view and 3-dimensional views of an embodiment of the invention having a build-in covering lid.
Figure 18A:
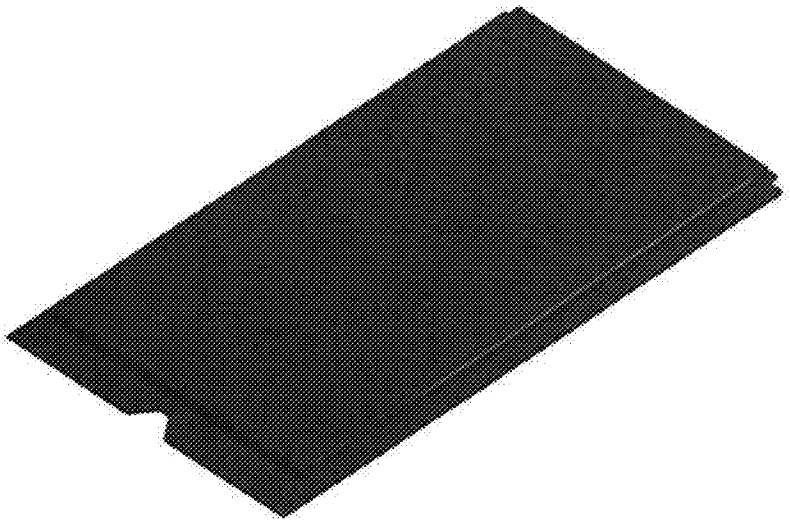
Figure 19:
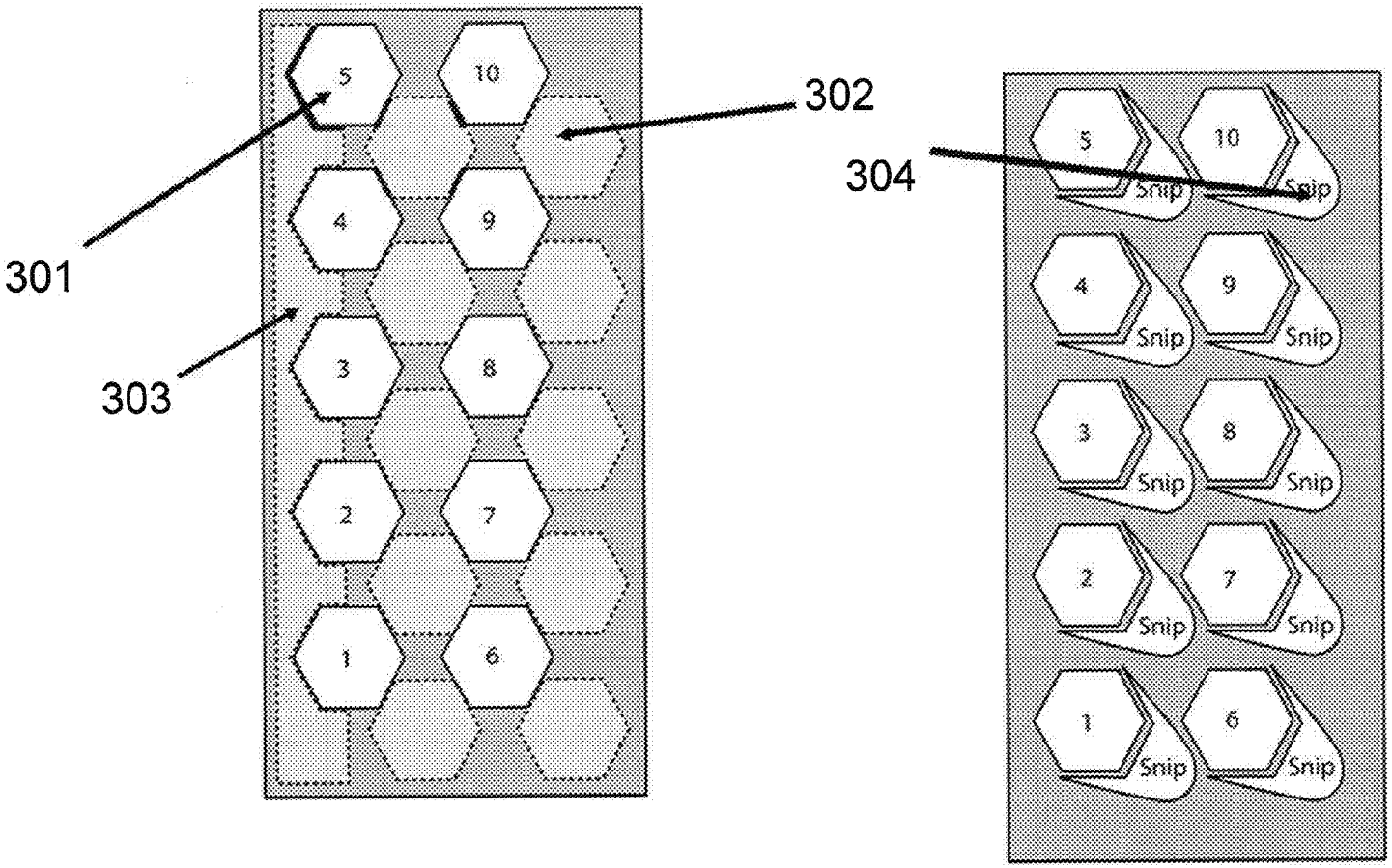
FIGS. 19-23 show examples of packages where the location of the cavities on the surface of the carrier sheet may provide an optimal structure to increase the rigidity of the package.

The design is based on the first step being thermoforming a plastic sheet to the shape shown in FIG. 17*a*. The sheet comprises a carrier sheet comprising two carrier halves 211,212 corresponding to the ones in FIG. 14*a*. The sheet further comprises two outer cover parts 221 at the two distal ends of the carrier halves 211,212. These are also referred to above as the end sections. These cover parts 221 are extensions of the carrier halves where the thermoforming has been performed so as to produce rims but not cavities for holding pharmaceutical compositions. It may be seen as an advantage that a single foil of plastic material may be thermoformed so as to identify parts having different functions, e.g. for carrying pharmaceutical composition or for providing further protection to the cover sheet protecting the cavities, without having to change its orientation. The plastic sheet is then folded into a container as shown schematically in the side view in FIG. 17*b* by folding along the fold lines 222 shown in FIG. 17*c*. In its folded state the blister package shows only the two cover part 221 as shown in FIG. 18*a*. When ready for use, it is possible to gain access to one side of the carrier 210 only by opening one of the outer cover parts 221 (not shown). FIG. 18*b* shows the container in a state where both outer cover parts 221 are partly opened. An advantage of this embodiment is that the carriers 210 and the outer cover parts 221 are made from the same sheet of material and no further covering is needed except for the cover sheets for covering the pharmaceutical compositions in the cavities 207.

In some embodiments a medical package with a larger capacity can be obtained by arranging more than two carrier halves in a row, which halves are then folded together and preferably joined by adhesive two-by-two. A double, triple or multiple structure can therefore be achieved where the carrier halves may be joined two-by-two. In this configuration the two distal ends, i.e. the outer covers provide cover for the most external carrier halves.

A multiple structure may provide better rigidity to the package and increase the number of cavities available for carrying pharmaceutical compositions, in turn increasing the amount of pharmaceutical compositions which can be carried by the medical package at the price of a limited increase of package thickness.

A further advantage of the medical package of the invention is that due to the rigid structure provided, e.g. by the flat hard cover and shape of the package, the invention may provide an easy to stack container, where flat hard covers can be stacked against each other into a stable stack for storage on shelves; thereby reducing the need of shelf space in relation to the amount of pharmaceutical compositions stored.

Figure 24:
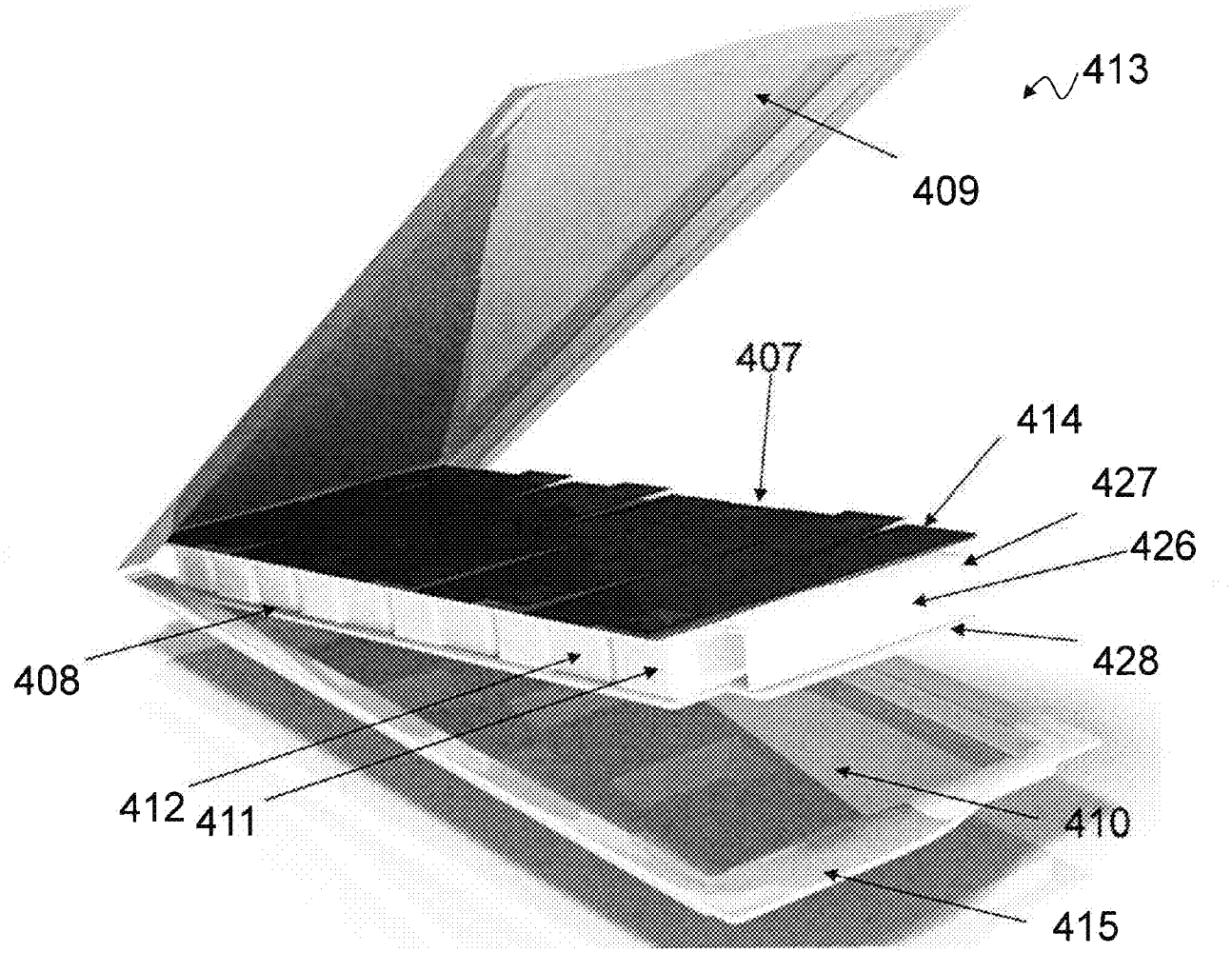
FIG. 24 shows schematically a 3-dimensional view of an embodiment of the invention in its folded state.

FIG. 24 shows schematically a 3-D view of an embodiment of the invention in its folded state. Carrier sections 407 and 408 have been folded and pressed on each other so as to provide a rigid structure. Intermeshing cavities, e.g. 411 and 412 engage in an interference fit by contacting their surfaces. In some embodiments the fastening of the carrier sections may be achieved by mechanically locking of intermeshing cavities, e.g. by interlocking due to complementary protrusions on the external surfaces of intermeshing cavities. In some other embodiments the fastening of the carrier sections may be achieved by mechanically locking of intermeshing cavities and gluing the complementary protrusions or the external surfaces of intermeshing cavities. In this way, the carrier sections 407 and 408 are locked together, and opening of the medical package 413 by opening of the end sections 409 and 410 do not cause unfolding of the carrier sections 407 and 408. Access to the cavities may be achieved by removal of cover sheets, e.g. 414. By peeling off cover sheet 414, carrier sections 407 and 408 maintain their folded state as fasten together. Access to the content of the cavities is therefore only achievable by peeling off the cover sheet.

Opening of the package 413 through the opening of end sections 409 and 410 may be facilitated by grasping elements located on the end sections, e.g. 415.

The fold lines of the single sheet may be located in different areas along the periphery of the carrier sections so as to achieve unfolded and folded structures having different degrees of stiffness.

By folding the single sheet along fold lines 427 and 428 a walled structure 426 is created. The wall structure 426 provides extra rigidity to the medical package, in particular from side handling, such as gripping by e.g. a robot during manufacturing.

Figure 25:
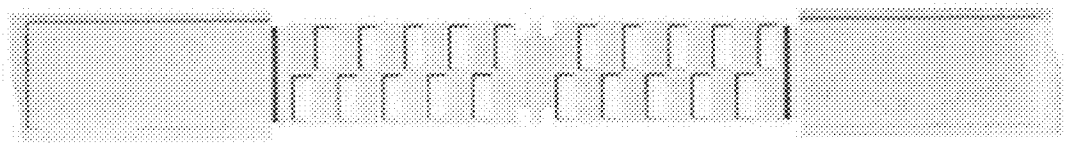
FIG. 25-31 show schematically 3-dimensional views of a medical package in its unfolded state according to embodiments of the invention.
Figure 25A:
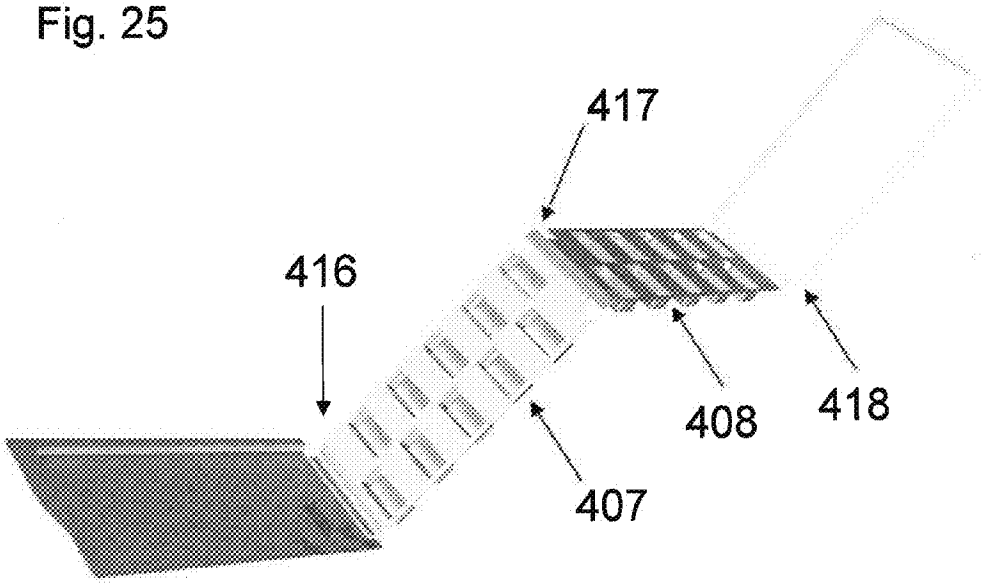

For example, in FIGS. 25 and 25*a* fold lines 416, 417 and 418 of the single sheet 419 once folded provide medical package 413. Fold lines 416, 417 and 418 are located along the shorter side of carrier sections 407 and 408.

Figure 26:
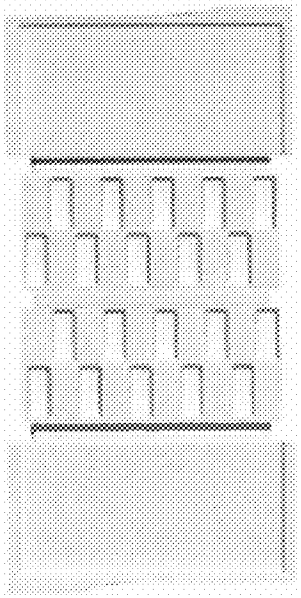
Figure 26A:
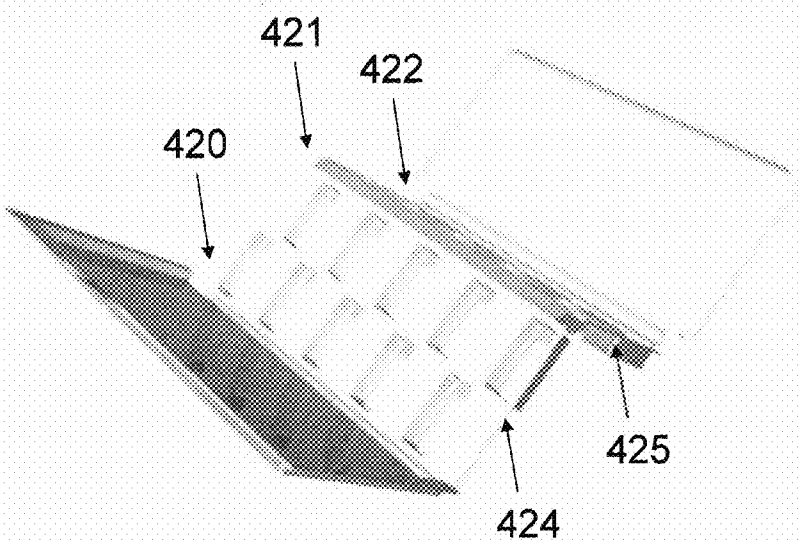
Figure 27:
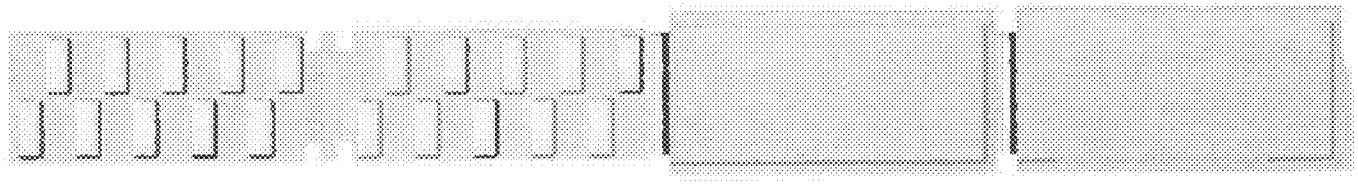
Figure 27A:
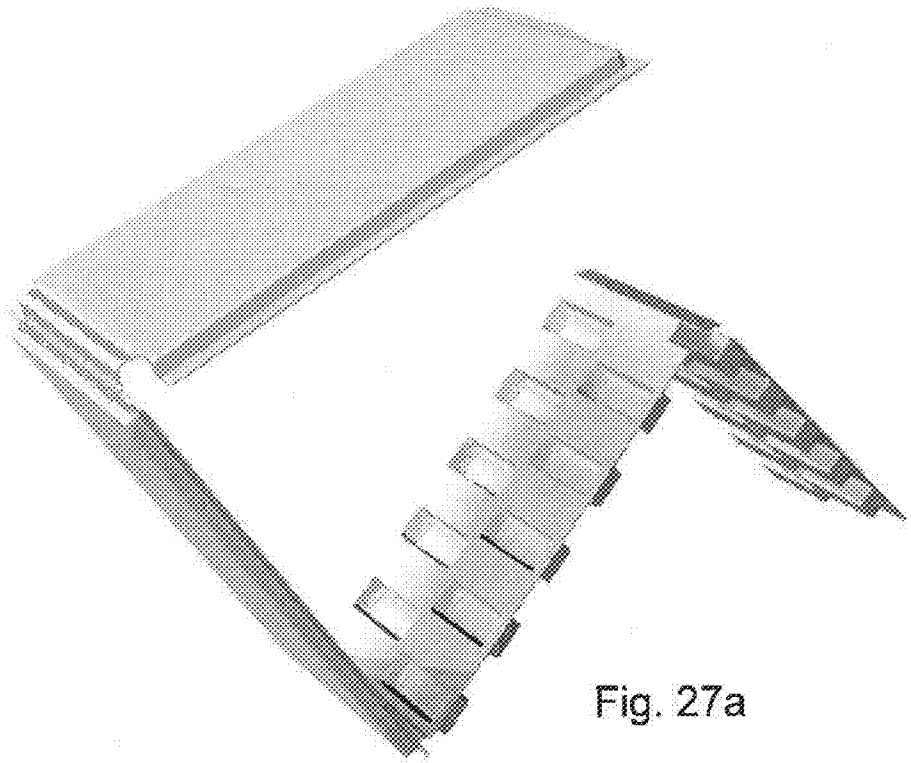
Figure 28A:
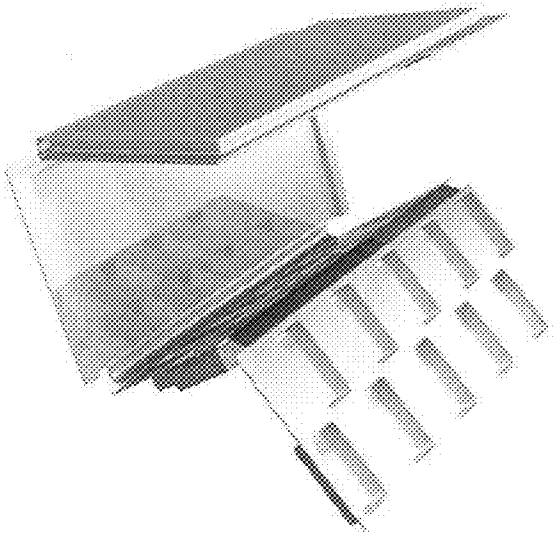
Figure 28:
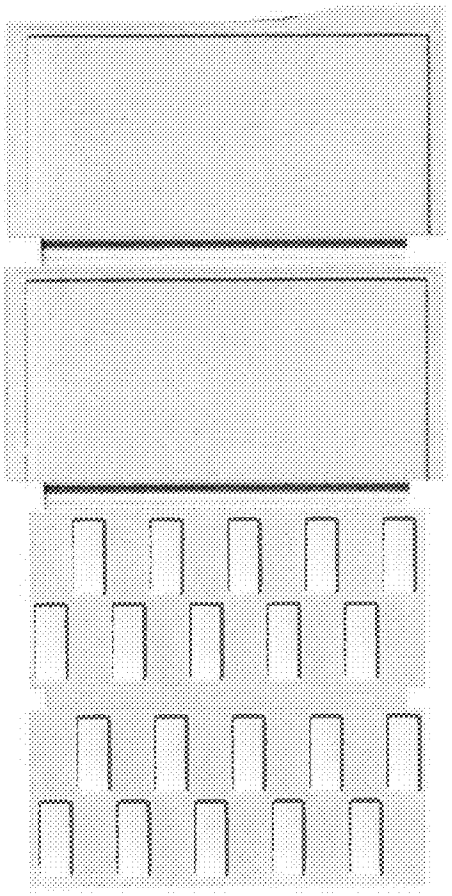
Figure 29A:
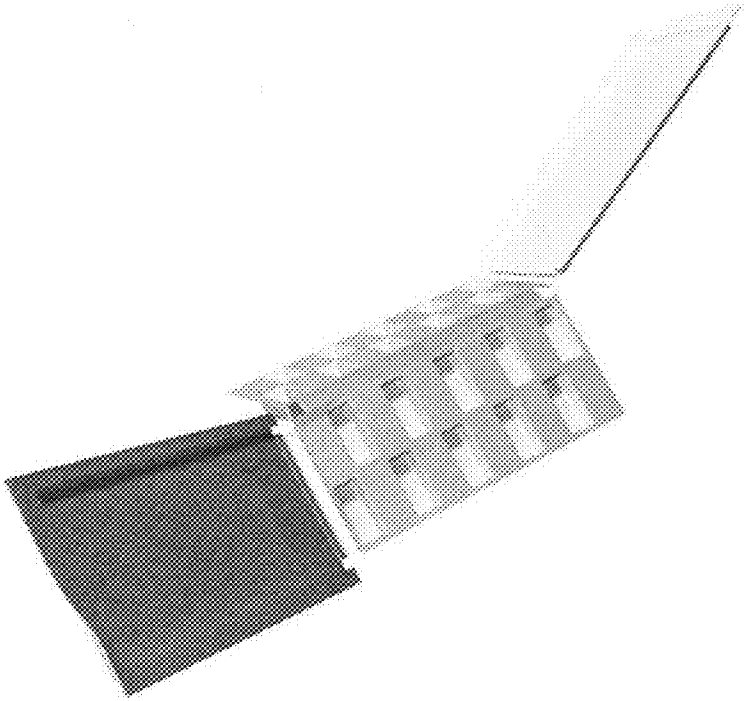
Figure 29:
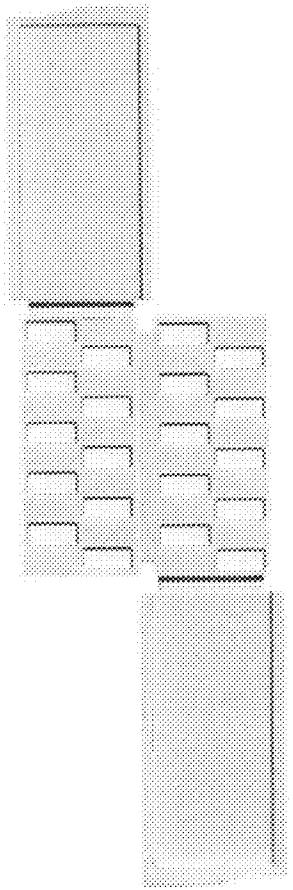
Figure 30A:
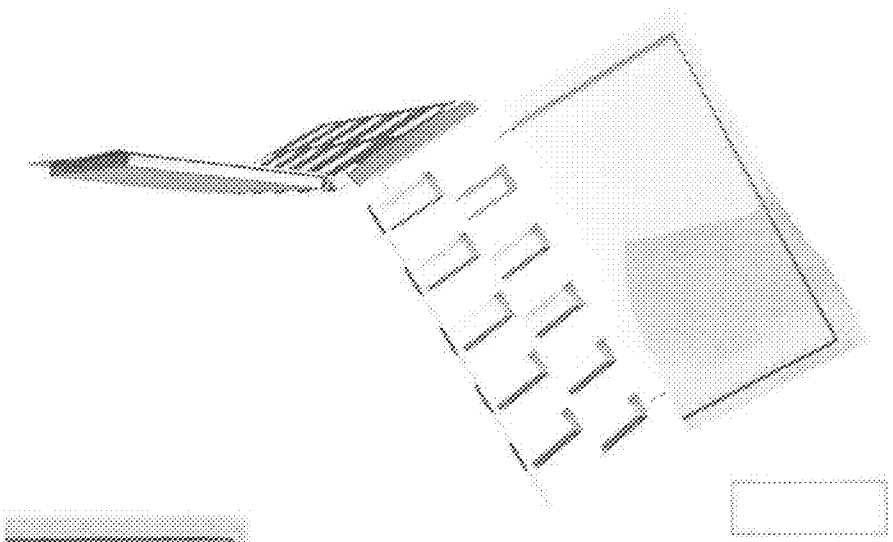
Figure 30:
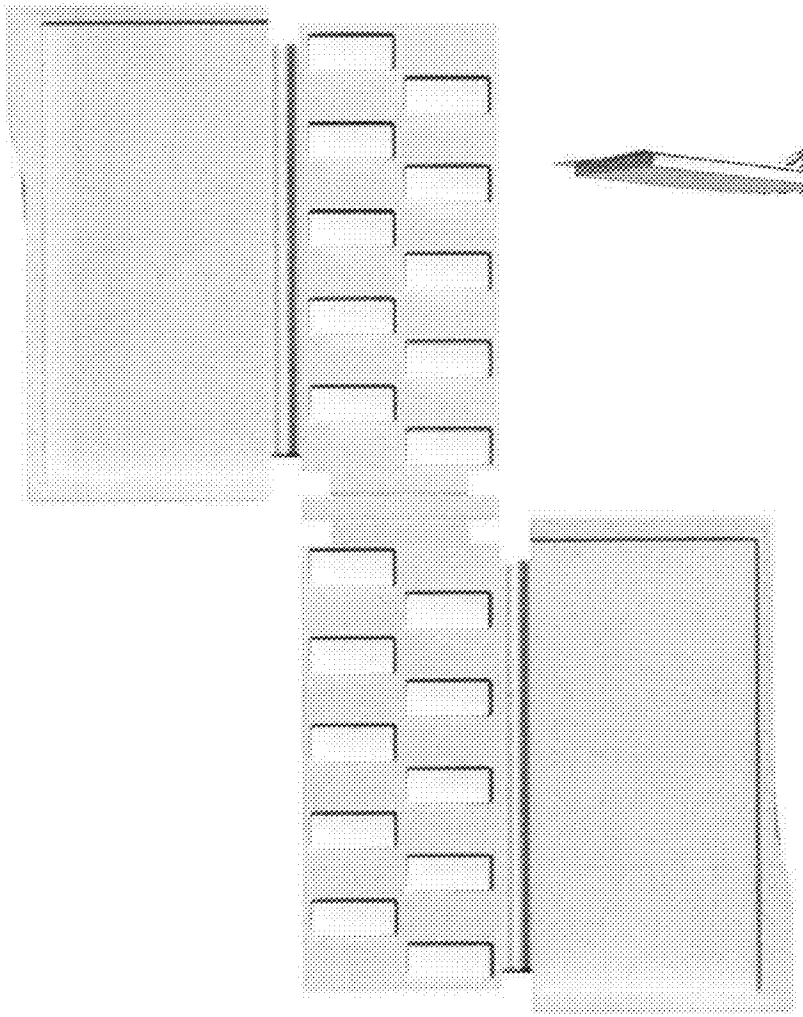

In FIGS. 26 and 26*a* the fold lines 420, 421 and 422 of the single sheet 423 are located along the longer side of carrier sections 424 and 425.

Folding along longer fold lines, 420, 421 and 422 as shown in FIG. 26*a* provides a structure which may have a lower degree of stiffness than a structure produced by the folding along a shorter fold lines such as lines 416, 417 and 418, as shown in FIG. 25*a*.

Once folded, the interlocking between the external surfaces of opposite cavities, i.e. cavities located on opposite carriers, provides a firm connection between the two carrier sections.

FIGS. 27-31 show schematically 3-D views of a medical package in its unfolded state where the pivotal connections between carrier sections and end sections are along different fold lines.

In some embodiments, the carrier sections are more than two. In these embodiments not all the carrier sections are covered by the end sections as it becomes apparent from FIGS. 31 and 31*a*. Once the medical package is folded, the terminal end sections 401 and 402 lie on the surfaces of carrier sections 403 and 404 respectively. The carrier sections are folded two-by-two so the bottom surfaces of sections 403 and 405 and the one of 406 and 404 engage respectively so as to interlock by mechanical interaction.

Figures 31, 31A:
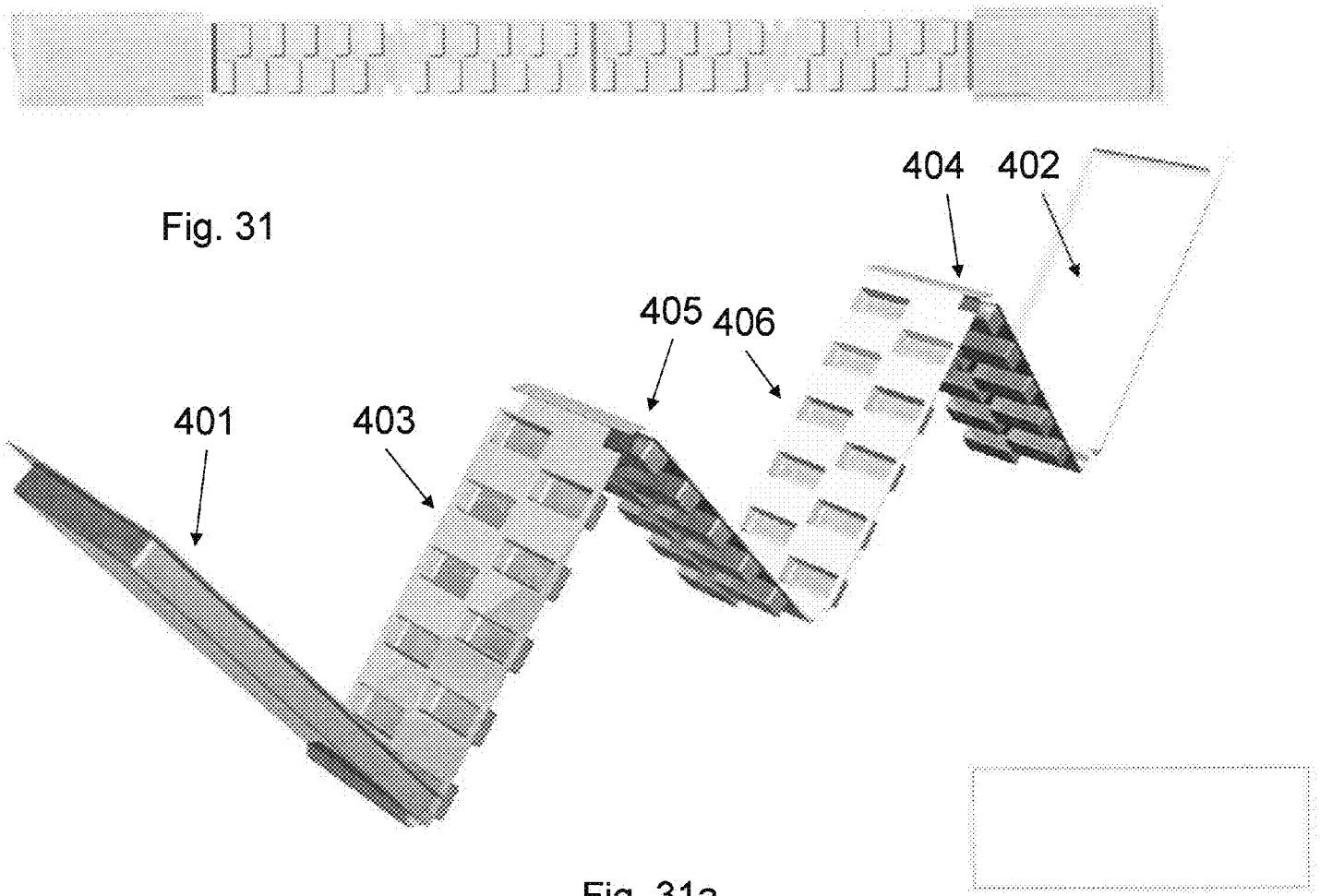

The embodiment shown in FIGS. 31 and 31*a* has the advantage of providing a package with a larger capacity. The carrier sections folded two-by-two may preferably be joined by adhesive or an interlocking mechanism. In this way a medical package having double, triple or multiple carrier sections joint two-by-two may be obtained. In this configuration the two distal ends, i.e. the outer covers provide direct cover only over the external carrier sections.

A package with multiple carrier sections joined two-by-two may provide better rigidity to the package and increase the volume of cavities available for carrying pharmaceutical compositions, with a limited increase of the package thickness.

FIG. 32 shows schematically a 3-D view of carrier sections 430 and 431 in their folded state having members 432 and 433 located on the external surface, in particular on the side walls, of the cavities 434 and 435. FIG. 32*a* shows carrier sections 430 and 431 in their unfolded state.

As shown, members may be present at least in two opposite pairs of cavities so as to provide a fast locking of the carrier sections. Alternatively, as shown in FIG. 32*b*, all cavities may have complementary members.

FIG. 32*b* shows a magnification of carrier section 431 where the geometrical form of member 433 can be seen. For example, the geometrical form or shape of the members 432 and 433 is so that the members will pass each other upon folding and pressing of the carrier sections 430 and 431 and will provide a locking so that the two carrier sections will not be able to be re-opened upon the application of the force necessary to open the end sections, i.e. the lids.

In some embodiments more than one member is present on the same side wall of a cavity.

Figure 34B:
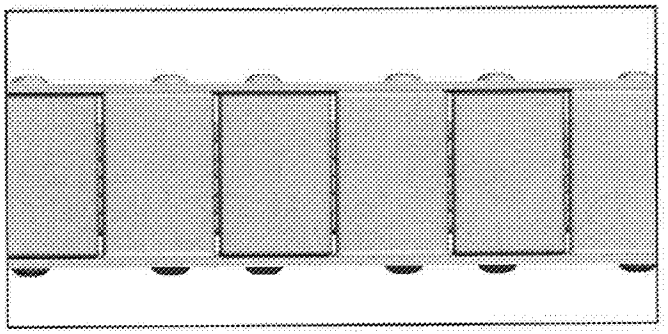
FIGS. 34, 34*a* and 34*b* show schematically 3-dimensional views of carrier sections in their unfolded and folded state having more members located on the side walls of the cavities according to one embodiment of the invention.
Figure 34A:
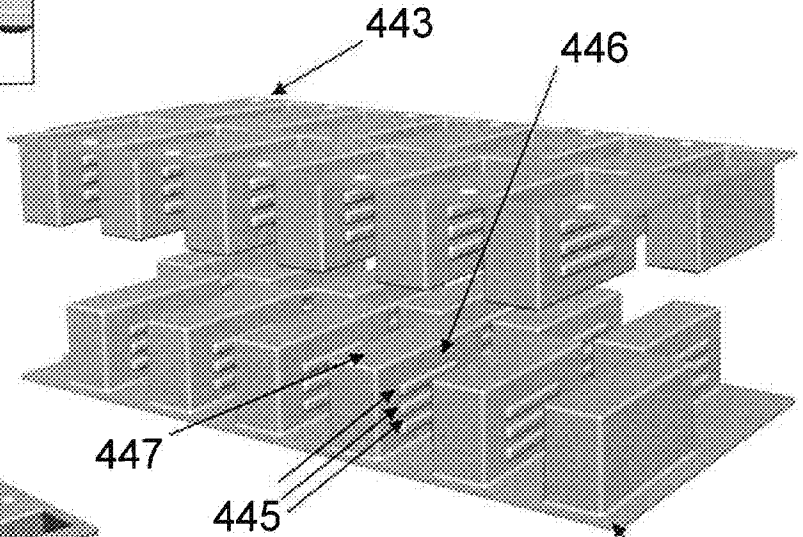

FIG. 34*a* shows schematically a 3-D view of carrier sections 443 and 444 in their unfolded state. Carrier sections 443 and 444 are characterized by having more than one member on the same side wall of a cavity, e.g. members 445 on side wall 446 of cavity 447.

Figure 34:
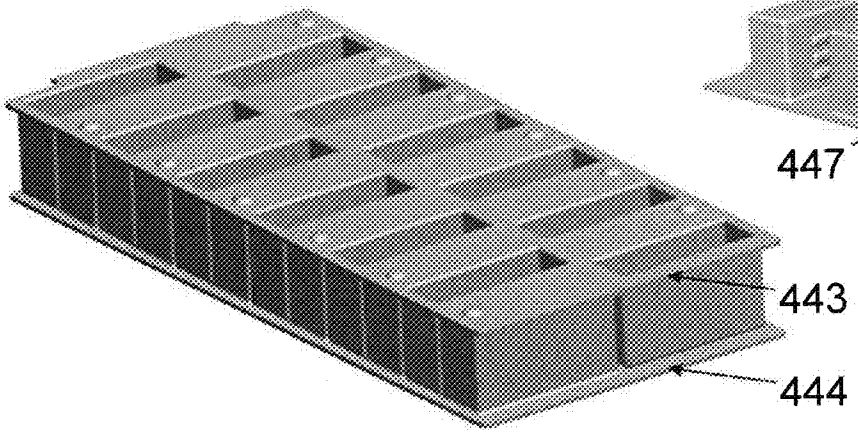

FIG. 34 shows schematically a 3-D view of carrier sections 443 and 444 in their folded state. FIG. 34*b* shows a magnification of carrier sections 443 and 444 where opposite multiple members located on the side walls of cavities mutually engage and interlock when the carrier sections are folded and pressed onto each other.

Figure 33A:
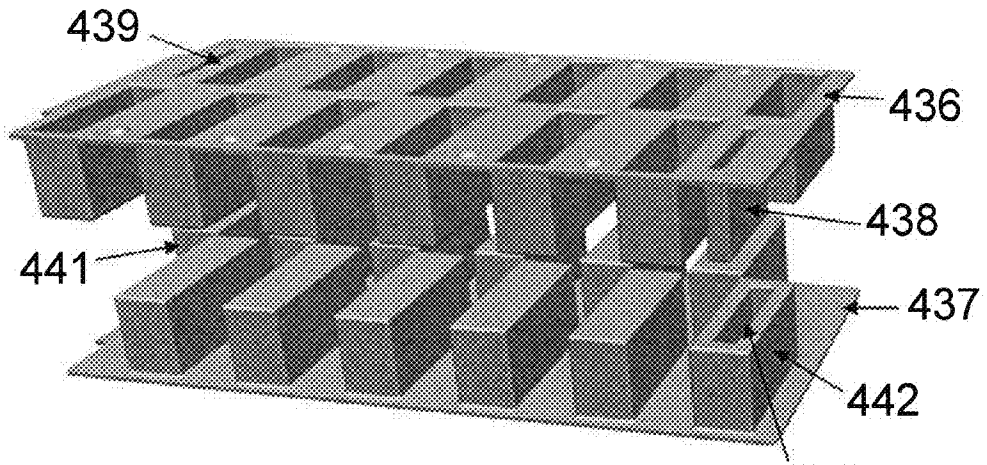
FIGS. 33, 33*a* and 33*b* show schematically 3-dimensional views of carrier sections in their unfolded and folded state having hollow protrusions and hollow spaces according to one embodiment of the invention.

FIG. 33*a* shows schematically a 3-D view of carrier sections 436 and 437 in their unfolded state. Carrier section 436 is characterized by a pair of hollow protrusions 438 and 439. The hollow protrusions 438 and 439 extend out of a bottom surface of the carrier section 436. Carrier section 437 is characterized by a pair of hollow spaces 440 and 441. Once folded and pressed on top of each other, carrier sections 436 and 437 provide a rigid structure as shown in FIG. 33, where hollow protrusions 438 and 439 and hollow spaces 440 and 441 mutually engage, e.g. in an interference fit.

The hollow spaces may be characterized by walls structure, e.g. 442, raised above the surface of the carrier section, e.g. 437.

Figure 33B:
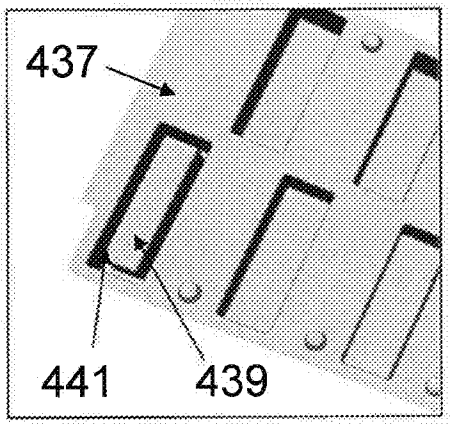
Figure 33:
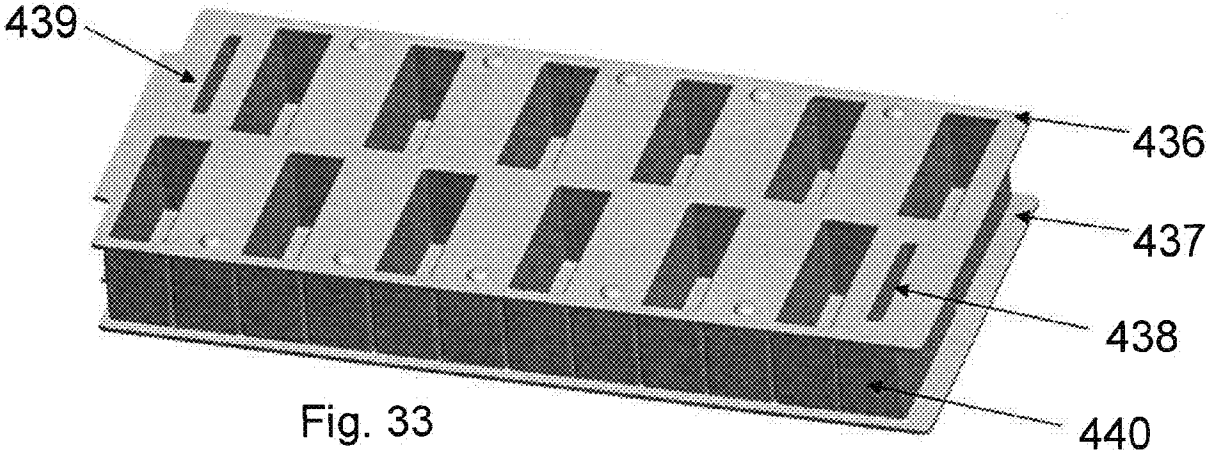

As shown in the magnification of FIG. 33*b*, the walls structure defines an interior region 441 where the hollow protrusions 439 engage by interlocking or by interference fit upon folding and/or pressing of the carrier section 436 onto carrier section 437.

In some embodiments more than one pair of hollow spaces/hollow protrusions are present.

Figure 35A:
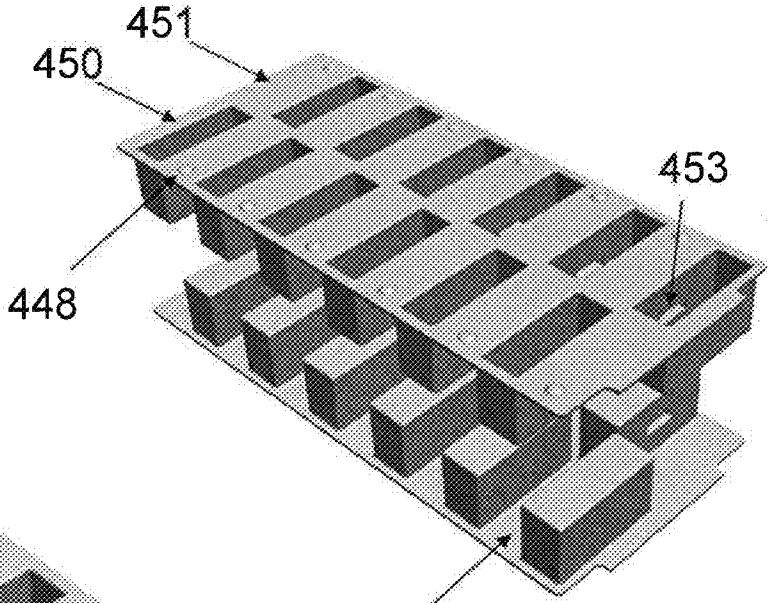
FIGS. 35, 35*a* and 35*b* show schematically 3-dimensional views of carrier sections in their, unfolded and folded state having protrusions and depressions according to one embodiment of the invention.
Figure 35B:
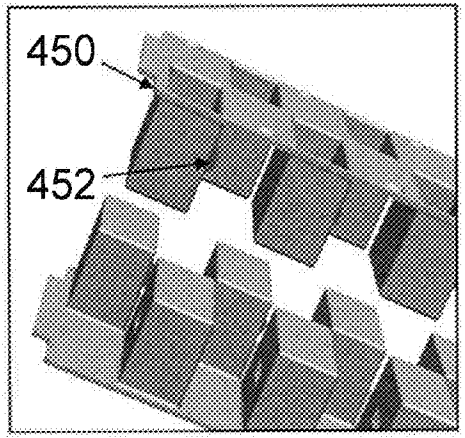
Figure 35:
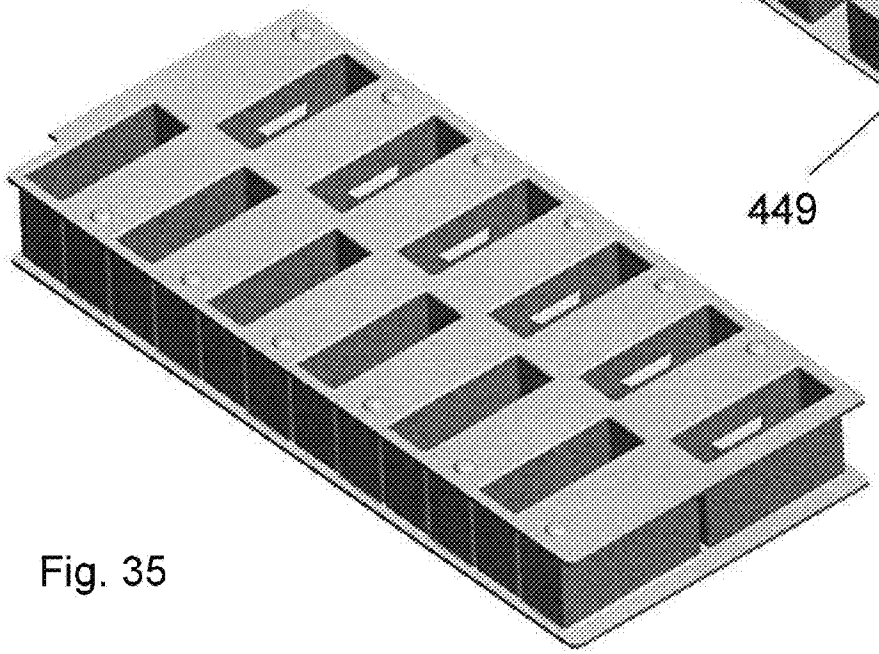

FIGS. 35, 35*a* and 35*b* show schematically a 3-D view of carrier sections 448 and 449 in their folded and unfolded state. Carrier section 448 is characterized by a row 450 of cavities having protrusions, e.g. 452 extending out the side walls of the cavities; and by a row 451 of cavities having depressions, e.g. 453 on their external walls. Carrier 449 has complementary protrusions and depressions so that upon folding and/or pressing of the two carriers on each other, depressions and protrusions on the external surface of the adjacent cavities mutually engage, such as in a male/female locking.

Similar locking system may be placed in different areas of the external surfaces of the cavities and may be also used between the end sections so as to close the medical package.

Figure 36A:
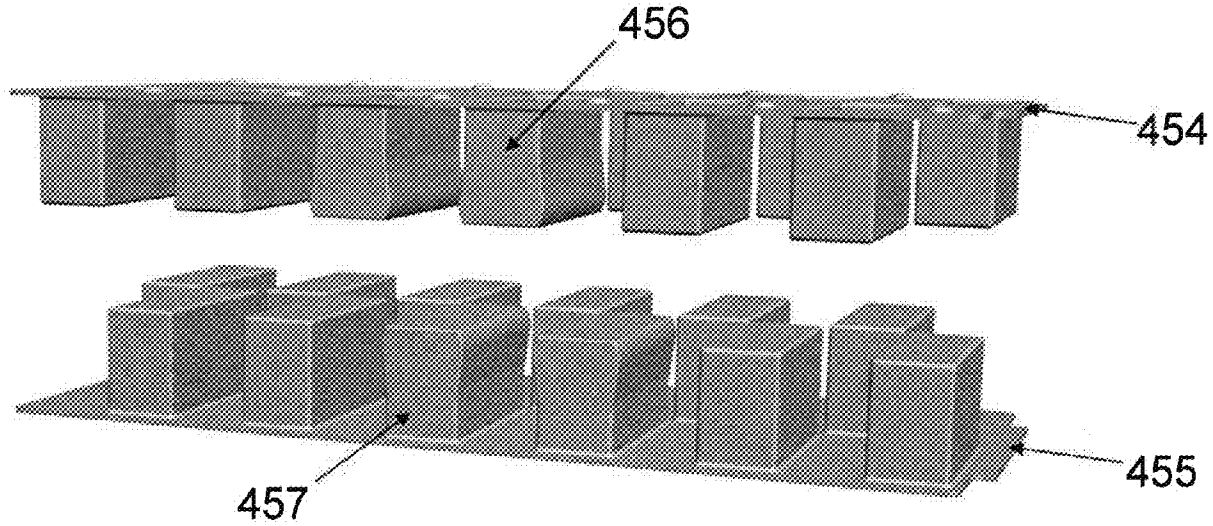
FIG. 36, 36*a* show schematically 3-dimensional views of carrier sections in their unfolded and folded state having cavities having complementary shapes according to one embodiment of the invention.
Figure 36:
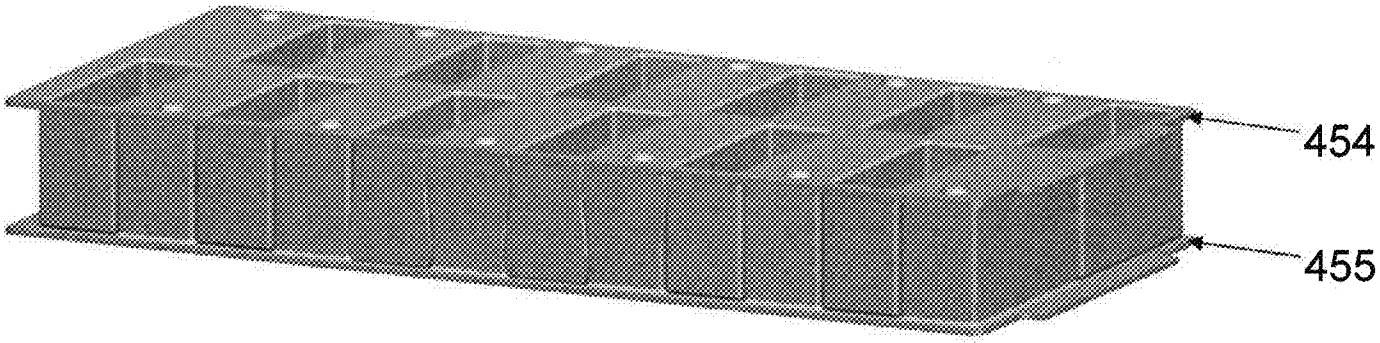

FIGS. 36, 36*a* show schematically 3-dimensional views of carrier sections 454 and 455 in their folded and unfolded state having cavities having complementary shapes, e.g. 456 and 457. Cavities, e.g. 456 on carrier section 454 are adapted to engage in an interference fit with cavities, e.g. 457 on carrier section 455 when the medical package is folded. Complementary shapes may be complementary curvatures, or distal end having an external diameter complementary to proximal end in opposite cavities of opposite carrier sections. In some embodiments only some of the cavities of opposite carrier sections have complementary shape, e.g. carrier section 454 and carrier 455 have four pairs of cavities located in the middle having complementary curvatures. In some other embodiments all cavities have complementary curvatures.

Figure 37A:
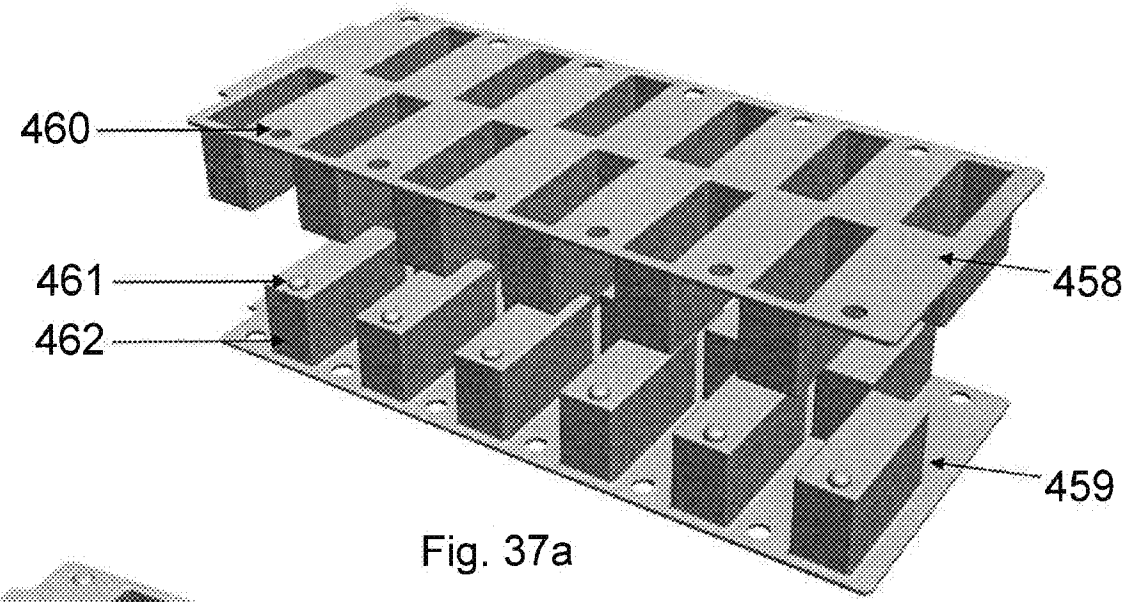
FIG. 37, 37*a* show schematically 3-dimensional views of carrier sections in their unfolded and folded state having apertures and protrusions according to one embodiment of the invention.
Figure 37:
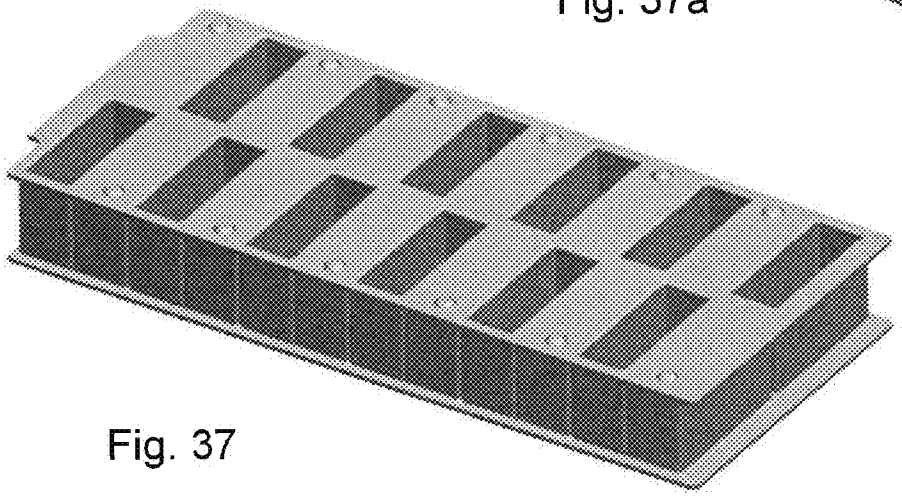

FIGS. 37, 37*a* show schematically 3-dimensional views of carrier sections 458 and 459 in their folded and unfolded state having apertures, e.g. 460, and protrusions, e.g. 461, according to one embodiment of the invention.

Apertures, e.g. 460, are located on carrier section 458 extending through all the thickness of the carrier section 458, while protrusions, e.g. 461, are located on the bottom surface of cavities, e.g. 462, of the carrier section 459.

Upon folding and pressing of the two carriers, protrusions, e.g. 461, engage with corresponded apertures, e.g. 460 proving a botton-bottonhole interaction.

FIGS. 38, 38*a* and 39 and 39*a* show schematically a 3-dimensional views of a medical package in their unfolded and folded state having a rims protruding out of end sections.

End sections 463 and 464 are characterized by rims 465 and 466 extending out of the internal surfaces, located around the internal peripheral edge of the end sections. When folded, rim 465 is press fit with at least part of rim 466. Optionally protrusions 473 and depressions 467 may be present to avoid undesired opening of the medical package.

Figure 38:
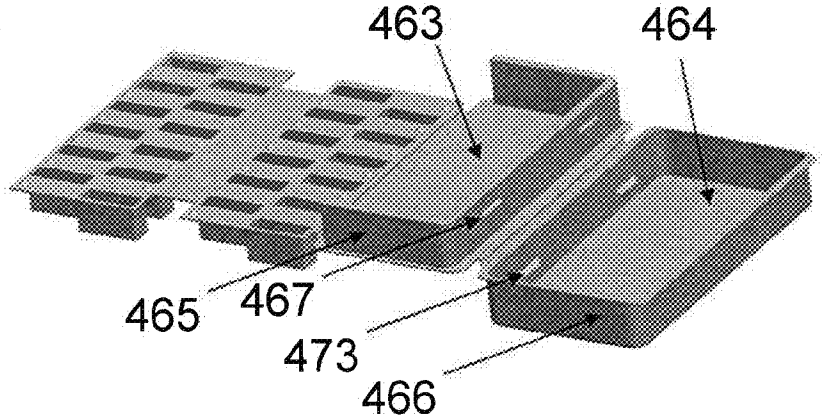
FIGS. 38, 38*a* and 39 and 39*a* show schematically 3-dimensional views of a medical package in its unfolded and folded state having rims protruding out of end sections.
Figure 39:
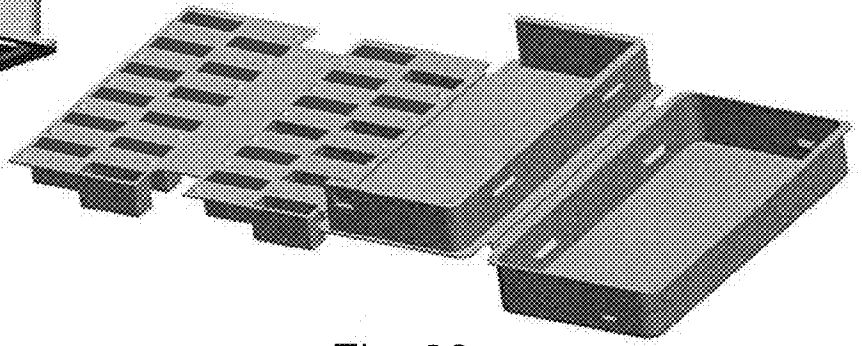
Figure 38A:
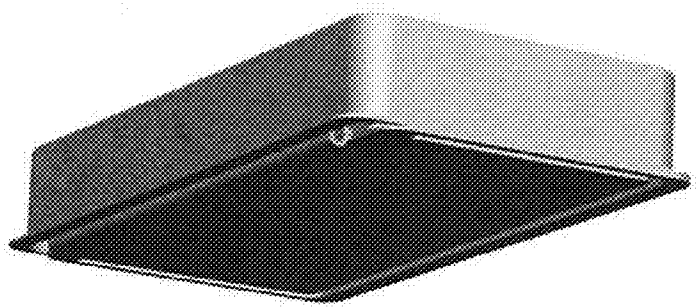
Figure 39A:
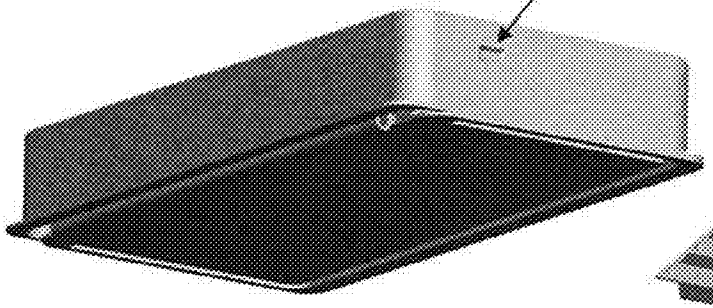

In FIGS. 39 and 39*a* a similar package to the one shown in FIGS. 38 and 38*a* is depicted characterized by an area 468 on the rim of the most external end section. Area 468 may be advantageous for side handling of medical package as robotic suckers applied to this area would avoid bending of the rim surface upon application of vacuum.

Figure 40:
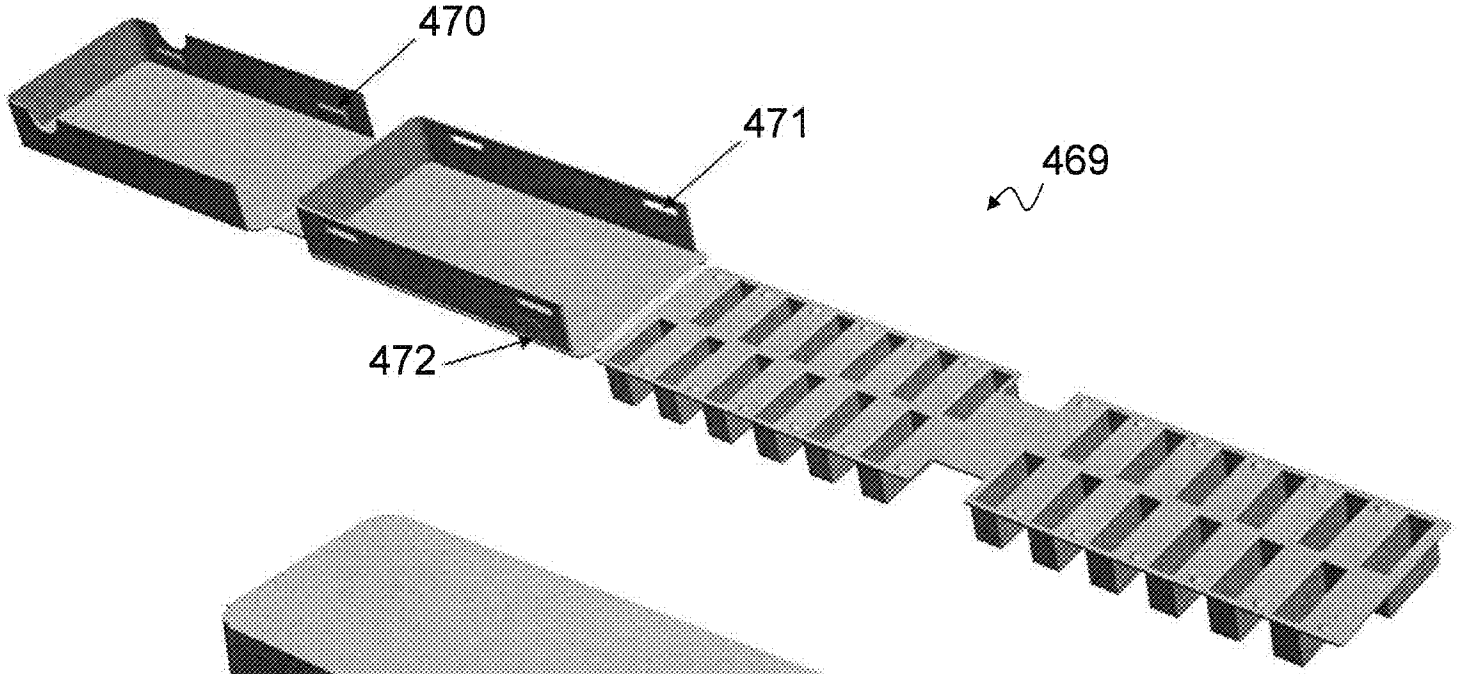
FIGS. 40 and 40*a* show schematically 3-dimensional views of a medical package in its unfolded and folded state having rims protruding out of end sections according to one embodiment of the invention.
Figure 40A:
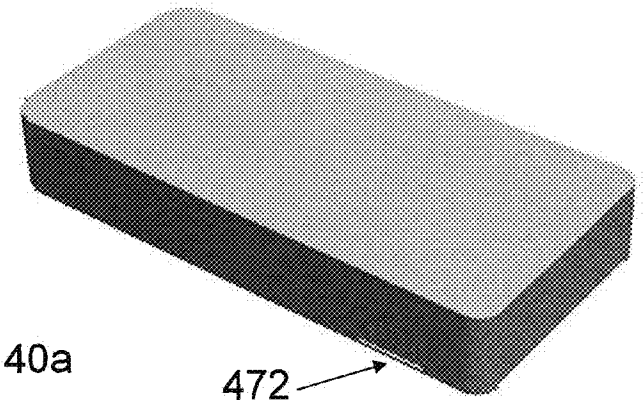

FIGS. 40 and 40*a* show schematically 3-dimensional views of a medical package 469 in its unfolded and folded state having rims protruding out of end sections according to one embodiment of the invention. The package is characterized by protrusions, e.g. 470, and apertures, e.g. 471, as locking system and by grabbing elements, e.g. 472, for easy handling and opening of the medical package.

Figures 41, 41A:
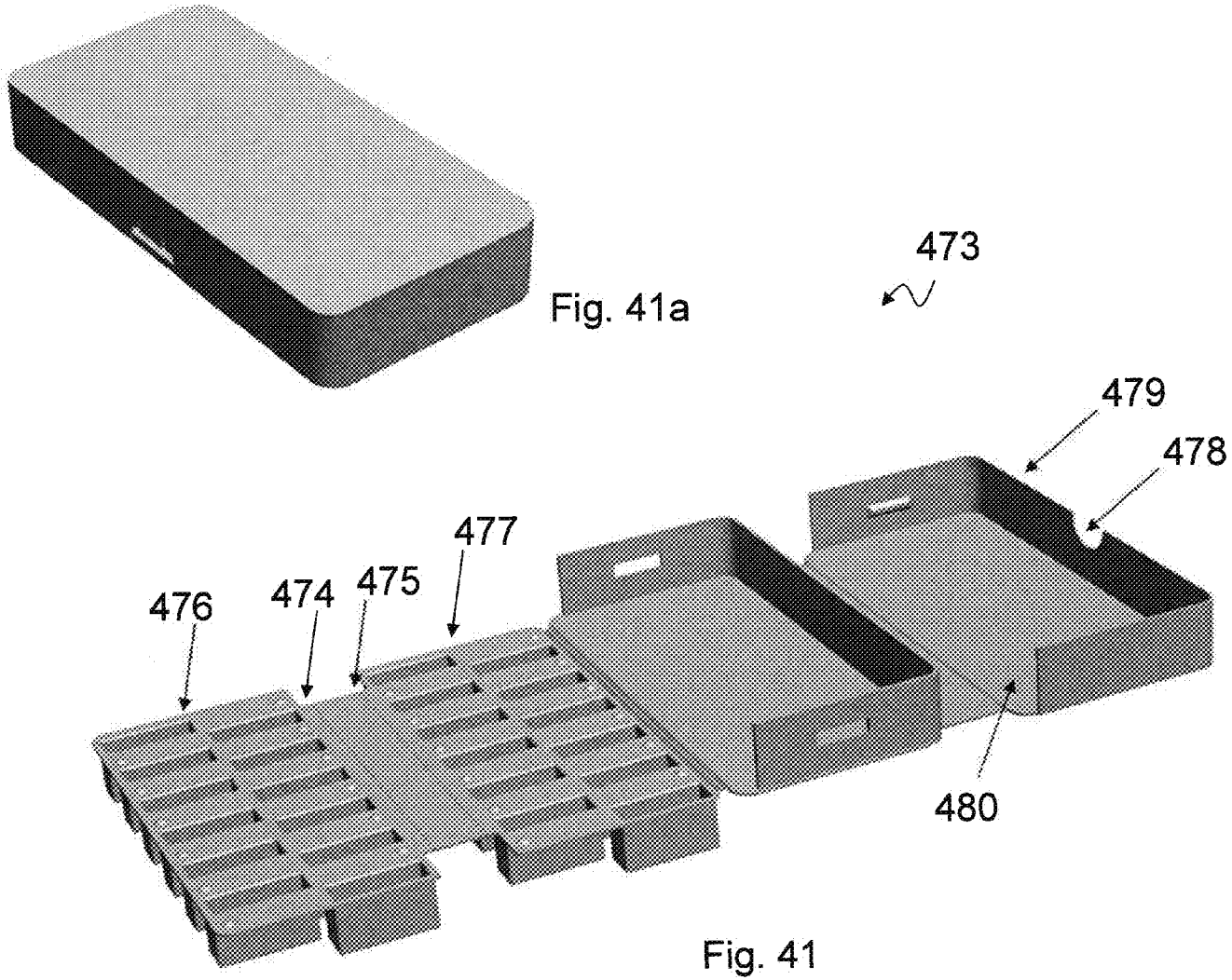
FIGS. 41 and 41*a* show schematically 3-dimensional views of a medical package in its unfolded and folded state having rims protruding out of end sections according to another embodiment of the invention.

FIGS. 41 and 41*a* show schematically 3-dimensional views of a medical package 473 in its unfolded and folded state having rims protruding out of end sections according to another embodiment of the invention. The package 473 differs from package 469 as the folding the fold lines 474 and 475 of the single sheet are located along the longer side of carrier sections 476 and 477. Further, an aperture 478 is present on the rim 479 of end section 480 for easy handling and opening of the medical package.

Figure 42:
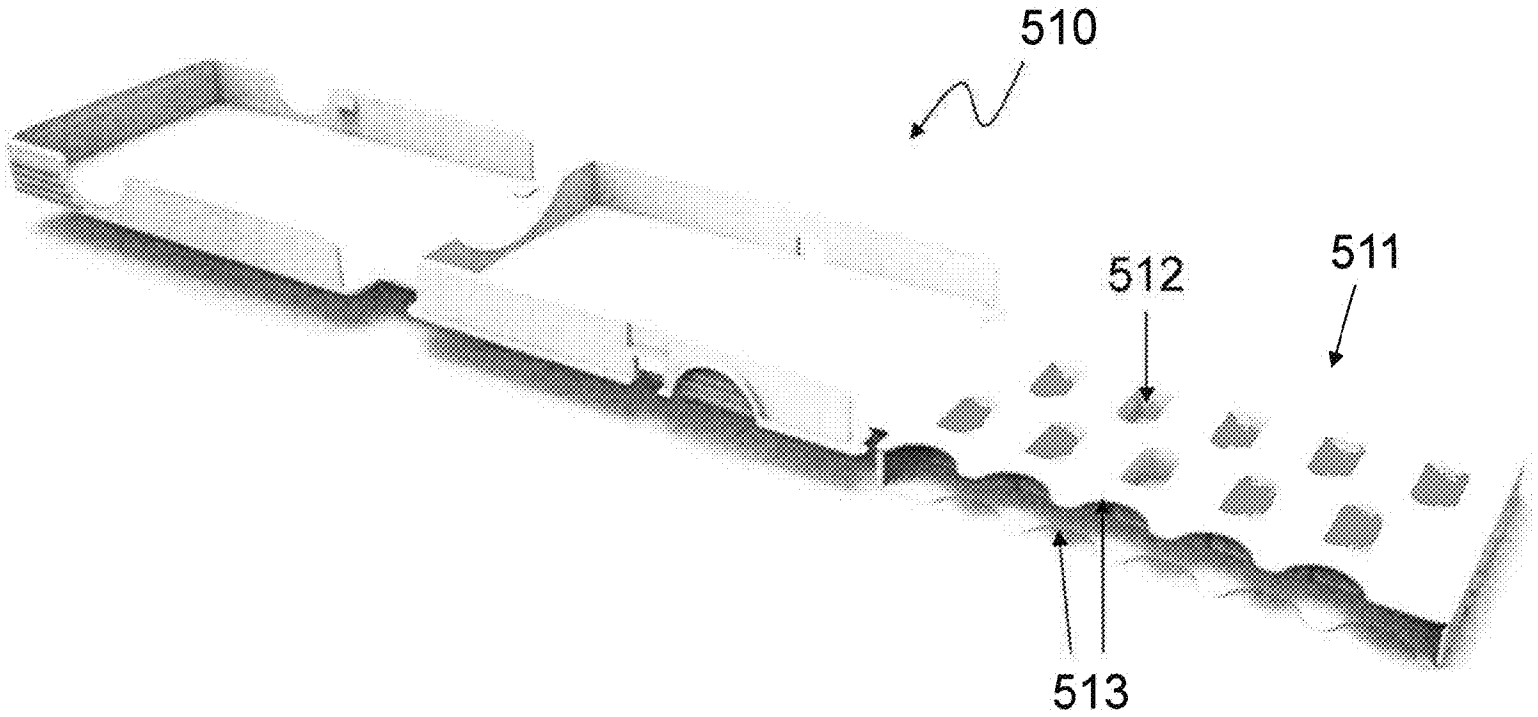
FIG. 42 shows schematically a 3-dimensional view of a medical package having profiled edges of the carrier sections.

FIG. 42 shows schematically a 3-dimensional view of a medical package 510 having profiled edges of the carrier sections 511. The edge comprises notches 513 which will make it easier to get a good grip of the cover sheet (not shown in this figure) provided that the cover sheet extends beyond the notches 513. Hereby it will be easier to gain access to the cavities 512.

Figure 43:
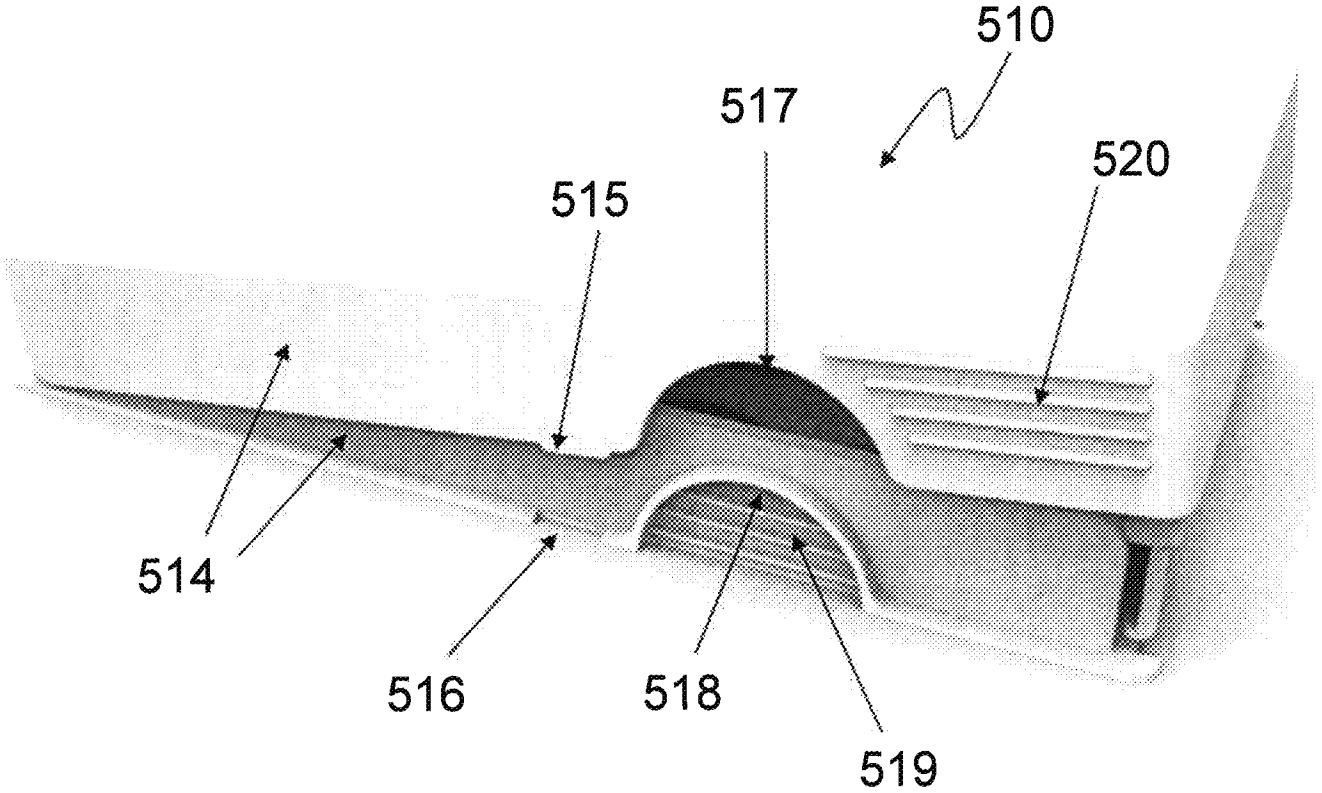
FIG. 43 shows schematically a 3-dimensional side view of a medical package having means for retaining the package in a closed position when in a closed state.

FIG. 43 shows schematically a 3-dimensional side view of rims or edges 514 of a medical package 510 having retaining means 515, 516 for retaining the package in a closed position when in a closed state. In the illustrated embodiment, the retaining means are a notch 516 and a protruding edge 515, respectively, but other shapes and configurations are also covered by the present invention. The illustrated package also has gripping means 519, 520 arranged on rims of the end sections for facilitating the opening of the medical package 510. One of the gripping means 519 is delimited by a curved protrusion 518 which engages with a curved opening 517 in rim of the opposite end section.

Although the present invention has been described in connection with the specified embodiments, it should not be construed as being in any way limited to the presented examples. For example the carrier has been described as being made by thermoforming or injection moulding a plastic sheet. However, other manufacturing processes, such as 3-dimensional printing, are also covered by the scope of the present invention. The materials may also differ so that parts of the containers can be made e.g. polymer foam, composite materials or from paper-based materials, such as cardboard. Correspondingly, other joining methods than the ones mentioned are covered; such methods will be well known to a person skilled in the art. Any of the embodiments could be provided with closing and opening means as shown in the figures. Other possible designs of closing and opening means will lie within the person skilled in the art.

The scope of the present invention is set out by the accompanying claim set. In the context of the claims, the terms "comprising" or "comprises" do not exclude other possible elements or steps. Also, the mentioning of references such as "a" or "an" etc. should not be construed as excluding a plurality. The use of reference signs in the claims with respect to elements indicated in the figures shall also not be construed as limiting the scope of the invention. Furthermore, individual features mentioned in different claims, may possibly be advantageously combined, and the mentioning of these features in different claims does not exclude that a combination of features is not possible and advantageous.

The following numbered items provide in term of conceptual statements further disclosure of the present subject matter.

1. A single use medical package comprising a carrier with at least one cavity for housing pharmaceutical compositions on at least one of the carrier surfaces and at least one cover sheet, wherein said carrier comprises a rigid structure, wherein said rigid structure is or comprises an internal hollow structure, wherein said internal hollow structure is at least partially hollow between the top and the bottom surface of said carrier.
2. A single use medical package according to item 1 wherein said carrier has at least one cavity for housing pharmaceutical compositions on the top and at least one cavity for housing pharmaceutical compositions on the bottom surface of said carrier.
3. A single use medical package according to item 2 wherein at least one cavity for housing pharmaceutical compositions on the top and at least one cavity for housing pharmaceutical compositions on the bottom surface of said carrier are located off-set in respect to each other in an intermeshing fashion.
4. A single use medical package according to any of the preceding items wherein said carrier comprises at least two pivotally connected halves each comprising at least one cavity for housing pharmaceutical compositions, and wherein said at least two halves are made from one single sheet foldable into a folded configuration thereby producing said rigid structure.
5. A single use medical package according to item 4 wherein the at least one cavity on one of said at least two halves of said carrier is located off-set with respect to the at least one cavity on the other of said at least two halves so that the cavities intermesh when the two halves are folded into said folded configuration.
6. A single use medical package according to any of the preceding items comprising at least four sections arranged in a row and made from a single sheet, each section being pivotally connected to at least one of the other sections along a fold line in said single sheet.
7. A single use medical package according to item 6 wherein each of two middle sections of said at least four sections constitutes a carrier half containing at least one cavity for housing pharmaceutical compositions, the two carrier halves being pivotally connected to each other.
8. A single use medical package according to item 7 wherein each of the two end sections of said at least four sections constitutes an outer cover part for at least one of said carrier half, each of the two end sections being pivotally connected the correspondent carrier half.
9. A single use medical package according to items 6-8 wherein said at least four sections are adapted to be folded into a folded configuration where said two carrier halves are located adjacent to each other with said cavities intermeshing and with the open sides of said cavities facing away from each other.
10. A single use medical package according to items 4 or 5 wherein said carrier sheet further comprises at least two rims areas each at least partly surrounding a carrier half, the rims protruding in a direction perpendicular to said cover sheet and adapted to engage with each other, when said medical package is closed.
11. A single use medical package according to item 10 wherein an outer foil is attached to areas adjacent said rims at a surface of said carrier sheet being the outer surface of the package when the package is closed.
12. A single use medical package according to any of the preceding items wherein said rigid structure may be internally filled with air or one or more other gases.
13. A single use medical package according to any of the preceding items, wherein the access to said at least one cavity is achieved by removal of said at least one cover sheet.
14. A single use medical package according to any of the preceding items wherein the removal of said at least one cover sheet is achieved by peeling off said at least one cover sheet.
15 A single use medical package use according to any of the preceding items wherein said at least one cover sheet is protected by at least one lid.
16. A single use medical package use according to item 15 wherein at least one lid is opened through a rotation of said lid along at least one rotational joint located on the carrier.

17. A single use medical package use according to items 15 or 16 wherein said at least one lid is or comprise at least one hollow body.
18. A single use medical package use according to items 15-17 wherein said at least one lid is or comprise at least one adhesive element.
19. A single use medical package use according to items 15-18 wherein said at least one lid contains a leaflet with information of interest to the user.
20. A single use medical package use according to items 15-19 wherein said at least one cover sheet may be protected by a slidable shutter system.
21. A single use medical package according to any of the preceding items comprising at least two cover sheets wherein said carrier has at least two cavities for housing pharmaceutical compositions, said at least two cover sheets are at least partially sealed to the carrier around said at least two cavities for housing pharmaceutical compositions, and said at least two cover sheets overlap and delimit at least one element characterized in that the access to said at least one element is gained by removal of the precedent overlapping cover sheet and that the access to further elements is gained by sequential removal of the respectively precedent overlapping cover sheets.
22. A method of manufacturing a medical package according to items 6-9, the method comprising:
processing a sheet of plastic material,
filling the cavities with pharmaceutical compositions,
attaching at least one cover sheet to said carrier halves so that the open sides of the cavities are sealingly covered by said at least one cover sheet,
folding said carrier halves together so that said cavities intermesh, and
folding said outer cover parts to adjacent said carrier halves.
23. A method of manufacturing a medical package according to item 22, wherein said folding of said carrier halves comprises:
folding said carrier halves by 180° into an overlapping configuration so that said carrier halves lie on top of each other.
24. A method of manufacturing a medical package according to items 22-23 wherein said folding of said outer cover parts comprises:
folding said outer cover parts by 180° into an overlapping configuration onto said carrier halves so that each outer cover part overlaps the carrier half to which is pivotally connected to.
25. A method of manufacturing a medical package according to items 10-11, the method comprising:
processing a sheet of a plastic material,
filling the cavities with pharmaceutical compositions,
attaching at least one cover sheet to said carrier halves so that the open sides of the cavities are sealingly covered by said at least one cover sheet,
punching fully or partly through the sheet of plastic material at locations where said carrier halves are to be separated from said rims areas,
attaching the outer foil to said rims areas
folding said carrier halves together so that said cavities intermesh, and
joining said carrier halves.
26. A method according to item 25, wherein said folding of said carrier halves comprises:
folding, before separating said carrier halves from said rims areas, said carrier halves and said rims areas by 180° into an overlapping configuration so that said carrier halves lie on top of each other.
27. A method according to item 25, wherein said folding of said carrier halves comprises:
folding, after separating said carrier halves from said rims areas, said carrier halves by 180° into an overlapping configuration so that said carrier halves lie on top of each other.
28. A method according to items 25-27, wherein said punching is fully through said sheet of the plastic material allowing for folding of said carrier halves by 180° into an overlapping configuration so that said carrier halves lie on top of each other, while said rims areas remains unfolded in the same plane.

The invention claimed is:

1. A single use medical package comprising:
a single unitary one piece molded structure comprising at least four sections made from a single sheet foldable into a folded configuration thereby producing a rigid structure, each section being pivotally connected to at least one of the other sections along fold lines in said single sheet,
wherein at least two sections of said at least four sections are a first and a second carrier sections pivotally connected to each other, each comprising cavities for housing pharmaceutical compositions, each cavity comprising a compartment substantially encapsulating at least one pharmaceutical component on all sides, said first and second carrier sections being adapted to mutually engage upon folding and/or pressing of said first and said second carrier sections onto each other, and
wherein two sections are end sections not comprising cavities, the end sections being positioned on opposite ends of the single folded sheet when in an unfolded configuration, the end sections being foldable to adjacent to and at least partly covering said carrier sections when the sheet is folded so as to protect the carrier sections.

2. The single use medical package according to claim 1, wherein said two carrier sections are located adjacent to each other with said cavities intermeshing.

3. The single use medical package according to claim 1, wherein said first and second carrier sections comprise members, which mutually engage upon folding and/or pressing of said first and said second carrier sections onto each other.

4. The single use medical package according to claim 3, wherein said mutual engagement comprises interlocking between said members.

5. The single use medical package according to claim 3, wherein said mutual engagement comprises interference fit between said members.

6. The single use medical package according to claim 3, wherein said members are members located on external surfaces of said cavities for housing pharmaceutical compositions.

7. The single use medical package according to claim 3, wherein said members are protrusions extending out of the external surface of the cavities of said first carrier section and depressions on the external surface of the adjacent cavities of said second carrier section.

8. The single use medical package according to claim 3, wherein said members are apertures on a top surface of said first and second carrier sections and protrusions on a bottom surface of said cavities.

9. The single use medical package according to claims 3, wherein said members are hollow protrusions on said first carrier section, said hollow protrusions extending out of the bottom surface of said first carrier section, and hollow spaces on said second carrier section, which hollow protrusions and hollow spaces mutually engage upon folding and/or pressing of said first and said second carrier sections onto each other.

10. The single use medical package according to claim 1, wherein said cavities have complementary shapes so that cavities on a first carrier section are adapted to engage in an interference fit with cavities on a second carrier section when the sheet is folded.

11. The single use medical package according to claim 1, wherein said cavities have side walls having complementary curvatures so that the side walls of cavities on a first carrier section are adapted to mutually engage with side walls of cavities on a second carrier section when the sheet is folded.

12. The single use medical package according to claim 1, wherein said cavities of said first carrier section have a distal end having an external diameter, which is complementary to a proximal end of said cavities of a second carrier section.

13. The single use medical package according to claim 1, wherein said cavities of said first carrier section have a proximal end having an external diameter, which is complementary to a distal end of said cavities of a second carrier section.

14. The single use medical package according to claim 1, wherein proximal ends of the cavities of a first carrier section have a shape engaging with corresponding terminal ends of the cavities of a second carrier section so as to interlock.

15. The single use medical package according to claim 1, wherein said fold lines between said first and second carrier sections pivotally connected to each other are at least two fold lines defining a walled structure upon folding and/or pressing of said first and said second carrier sections onto each other.

16. The single use medical package according to claim 1, wherein at least a first end section has a rim, said rim protruding out of said first end section, said rim being located at least partially around an internal peripheral edge of said first end section thereby when folded said rim is press fit with at least part of a wall of a second end section.

17. The single use medical package according to claim 1, wherein said rigid structure may be internally filled with air or one or more other gases.

18. The single use medical package according to claim 1, wherein the access to said at least one cavity is achieved by removal of at least one cover sheet.

19. The single use medical package according to claim 18, wherein the removal of said at least one cover sheet is achieved by peeling off said at least one cover sheet.

20. The single use medical package according to claim 18, wherein said at least one cover sheet is protected by at least one lid.

* * * * *